US011402066B2

(12) United States Patent
Zhang et al.

(10) Patent No.: US 11,402,066 B2
(45) Date of Patent: Aug. 2, 2022

(54) INFLATION METHOD FOR AIR CUSHION BODY, INFLATION SYSTEM OF SAME, AND INFLATION APPARATUS THEREOF

(71) Applicants: Jiaying Zhang, Shanghai (CN); Huiping Nie, Shanghai (CN)

(72) Inventors: Jiaying Zhang, Shanghai (CN); Huiping Nie, Shanghai (CN); Yupeng Zhang, Shanghai (CN); Jiulong Hu, Shanghai (CN)

( * ) Notice: Subject to any disclaimer, the term of this patent is extended or adjusted under 35 U.S.C. 154(b) by 1159 days.

(21) Appl. No.: 15/576,270

(22) PCT Filed: May 20, 2016

(86) PCT No.: PCT/CN2016/082724
§ 371 (c)(1),
(2) Date: May 23, 2018

(87) PCT Pub. No.: WO2016/188365
PCT Pub. Date: Dec. 1, 2016

(65) Prior Publication Data

US 2019/0170298 A1 Jun. 6, 2019

(30) Foreign Application Priority Data

May 22, 2015 (CN) ..... 201510266686.3

(51) Int. Cl.

| | |
|---|---|
| ***F17C 5/06*** | (2006.01) |
| ***B65D 81/03*** | (2006.01) |
| ***F17C 5/00*** | (2006.01) |
| ***B65D 81/05*** | (2006.01) |
| ***B31D 5/00*** | (2017.01) |
| ***B65D 85/30*** | (2006.01) |

(52) U.S. Cl.
CPC ..... *F17C 5/06* (2013.01); *B31D 5/0073* (2013.01); *B65D 81/03* (2013.01); *B65D 81/052* (2013.01); *B65D 85/30* (2013.01); *F17C 5/00* (2013.01); *F17C 2221/031* (2013.01)

(58) Field of Classification Search
CPC .... B31D 5/0073; B65D 81/03; B65D 81/052; B65D 85/30
See application file for complete search history.

(56) References Cited

U.S. PATENT DOCUMENTS 3,868,285 A * 2/1975 Troy ..... B29C 66/83511 156/147
4,049,854 A * 9/1977 Casey ..... B29C 65/18 428/72

(Continued)

*Primary Examiner* — Chelsea E Stinson
*Assistant Examiner* — Scott A Howell

(57) ABSTRACT

An inflation method for an air cushion body which includes one or more air storing units formed by at least two air cell films, an inflation valve formed by at least two valve films, and an inflation unit integrally connected with the air storing units and formed by two inflation end portions overlapping with each other to define an inflation channel, includes the following steps: sealing off two ends of the inflation channel to form an inflatable cavity, filling air into the inflatable cavity where the air that enters the inflatable cavity enters the corresponding air storing units through the air inlet channel, and releasing the two ends of the inflation channel upon completion of inflation to acquire the air cushion body that is inflated.

4 Claims, 31 Drawing Sheets

(56) References Cited

U.S. PATENT DOCUMENTS 5,469,966 A * 11/1995 Boyer ..... B65D 31/14 206/522
6,889,739 B2 * 5/2005 Lerner ..... B29C 66/8161 156/498
6,932,134 B2 * 8/2005 Selle ..... B29C 65/7841 156/145
7,040,073 B2 * 5/2006 Perkins ..... B31D 5/0073 53/403
7,448,803 B2 * 11/2008 Ootsubo ..... B65D 81/2038 383/100
7,708,464 B2 * 5/2010 Tanaka ..... B65D 31/14 383/100
7,784,131 B2 * 8/2010 Genaro ..... A61G 7/05776 5/713
7,913,848 B2 * 3/2011 Liao ..... B65D 31/145 206/522
8,016,110 B2 * 9/2011 Zhang ..... B65D 81/03 206/522
8,272,510 B2 * 9/2012 Frayne ..... F16K 15/20 206/522
8,360,641 B2 * 1/2013 Kim ..... B65D 81/03 383/3
8,419,278 B2 * 4/2013 Tanaka ..... B65D 77/225 383/44
8,590,574 B2 * 11/2013 Jian ..... B65D 81/052 137/846
9,199,596 B2 * 12/2015 Zhang ..... B65D 81/022
9,199,597 B2 * 12/2015 Zhang ..... F16K 15/202
9,616,634 B2 * 4/2017 Liao ..... B31D 5/0073
9,724,902 B2 * 8/2017 Liao ..... B32B 37/24
9,725,066 B2 * 8/2017 Zhang ..... B32B 37/0076
10,730,679 B2 * 8/2020 Zhang ..... B65D 23/08
10,850,907 B2 * 12/2020 Zhang ..... B65D 31/14
10,894,652 B2 * 1/2021 Bates ..... B65D 81/052
2009/0064418 A1 * 3/2009 Genaro ..... A61G 7/05776 5/713
2009/0094939 A1 * 4/2009 Wetsch ..... B31D 5/0073 53/79
2010/0251665 A1 * 10/2010 Sperry ..... B31D 5/0073 53/79
2011/0172072 A1 * 7/2011 Wetsch ..... B31D 5/0073 493/227
2011/0233101 A1 * 9/2011 Baines ..... B31D 5/0073 206/522
2013/0291956 A1 * 11/2013 Zhang ..... F16K 15/202 137/224
2017/0144402 A1 * 5/2017 Liao ..... B65D 31/14
2021/0309435 A1 * 10/2021 Zhang ..... B65D 5/563

* cited by examiner

A

B

INFLATION METHOD FOR AIR CUSHION BODY, INFLATION SYSTEM OF SAME, AND INFLATION APPARATUS THEREOF

BACKGROUND OF THE PRESENT INVENTION

Field of Invention

The present invention relates to an inflation method and its apparatus for air cushion body, and more particularly to an automatic inflation method, its inflation system, and its inflation apparatus for air cushion body.

Description of Related Arts

With the change of modern lifestyle and the rapid development of logistics industry, numerous goods, such as electronic products, chemical products, medical products, ceramics, glass, and other daily necessities, are traded through logistics. Nevertheless, serious loss can happen when these goods are damaged or distorted due to incidents like squeezing, collision, dropping, etc., which are sometimes inevitable during the storing or transportation processes.

In order to protect the goods, people utilize packaging boxes or the like to package the products before storing or transportation, which provides a predetermined cushioning function for the products so as to protect them. Currently, common packaging boxes include paper packaging boxes and air packaging bags. Conventional paper packaging boxes cannot offer ideal cushioning function to serve as a good protection solution. As a result, it usually requires the products to be packaged by foams or soft plastics of several layers before putting into the packaging box in order to provide a good anti-collision quality. Unfortunately, this will definitely increase its transportation cost, make packaging process harder, waste time, decrease working efficiency, and raise labor cost, which has failed to meet the demands of modern transportation industry.

Air packaging materials provide cushioning functions by filling air into films, they can be inflated and utilized right on the packaging site. Therefore, in comparison with conventional packaging materials, air packaging materials have the advantages of lower transportation cost, being easier for storing, better cushioning performance, and being more environmental friendly.

Nonetheless, the inflation way of conventional air packaging materials, such as air packaging cushion pads or air packaging bags is still difficult. Specifically, FIG. 1 illustrates an on-site inflation method for a conventional air packaging bag. The air packaging bag has an inflation inlet. An inflation nozzle of an inflation device is arranged at the inflation inlet so as to fill the air into the air packaging bag through the inflation inlet. When the pressure in the air packaging bag is enough, the inflation nozzle will be pulled out and the inflation inlet will be closed. Thus, the air will be sealed in the air packaging bag, such that the air packaging bag can be utilized as a filling material of a packaging box and serve as an air cushion material. According to another practice, the position of the inflation inlet of the air packaging bag may be provided with an inflation valve of various types, such as a mechanical one-way valve. As a result, the inflation nozzle of the inflation device can be coupled to the inflation valve to inflate the air packaging bag, while after the inflation is finished, the inflation valve can serve to prevent an air leakage.

FIG. 2 illustrates another air packaging bag, it comprises a one-way valve formed by at least two films and a plurality of inflation chambers formed by multiple films allowing air to be stored therein. That is to say, the one-way valve formed by two films is utilized for inflating the inflation chambers. After the inflation, the films that form the one-way valve will automatically attach with each other due to the air pressure in the inflation chambers, so as to prevent the air leakage. This type of air packaging bag usually has an inflation inlet and the rest parts of the air packaging bag are all sealing structures. The inflation inlet is also suitable for arranging an inflation nozzle of an inflation device so as for air to be filled from the inflation inlet into each inflation chamber of the air packaging bag. When the air pressure in the inflation chamber is sufficient, the inflation nozzle can be pulled out without sealing the inflation inlet thereafter. Then the air will be enclosed in each of the inflation chambers, such that the air packaging bag is available to accommodate articles for storing and transportation.

It can be seen that the films that form the inflation inlet are preferred to lean closely on the inflation nozzle during the conventional inflation process. Besides, air has to enter an inflation inlet of the air packaging material first, and then enter into corresponding inflation chambers subsequently via the inflation inlet. If the size of the air packaging material is large, it will require a deeper inflation process. However, the above inflation process that inflates with only a single inflation inlet may not be able to inflate the inflation chambers timely and well. In other words, the inflation chambers may not attain desired inflation air pressures. For example, the air packaging bag illustrated in FIG. 2 comprises a plurality of inflation chambers arranged in parallel. If the above conventional inflation method is utilized, it is likely that some inflation chambers are fully inflated before the others. In other words, the conventional inflation method can not ensure that all inflation chambers are inflated for the predetermined air pressure in a short time, nor avoid the shaking of the air packaging bag caused by uneven force of inflation.

In addition, inflation devices, such as regular small air pumps, can not inflate efficiently in a packaging site. It often causes insufficient inflation, which not only wastes labor and time, but also fails to meet the requirement of inflation well. Besides, it is costly and inconvenient to use compressed air source, such as gas tank, which contains a high pressure gas to inflate the air packaging materials through the inflation nozzle. Moreover, the conventional inflation process for air packaging material costs too much labor. For example, if a small air pump is utilized to inflate the above air bag, it requires an operator to hold the small air pump with one hand and hold the air packaging bag at the position next to the inflation inlet with the other hand so as to conduct the inflation process or perhaps it takes two persons to cooperate for this process. If a compressed air source is utilized, it requires the operator to hold the air packaging bag with both hands and put the inflation nozzle of the inflation device at the inflation inlet of the air packaging bag so as to start the inflation process. Besides, the operator has to hold the air packaging bag tight during the inflation process to avoid the air packaging bag from fleeing due to the inflation. Furthermore, the conventional inflation practice basically only inflates one air packaging bag rather than continuously inflates a plurality of air packaging bags, so that the market lacks a continual automatic inflation technology.

SUMMARY OF THE PRESENT INVENTION

An advantage of the present invention is to provide an inflation method, inflation system, and inflation apparatus for the air cushion body, wherein the inflation method increases inflation efficiency, ensures inflation results, and is suitable for inflating various types of air cushion bodies.

Another advantage of the present invention is to provide an inflation method, inflation system, and inflation apparatus for the air cushion body, wherein the inflation method is suitable for automatically implementing inflation process for continuous type air cushion body, so as to decrease labor input or even eliminate labor input.

Another advantage of the present invention is to provide an inflation method, inflation system, and inflation apparatus for the air cushion body, wherein the continuous type air cushion body comprises a plurality of interconnected air-storing units, wherein the inflation method can inflate the air-storing units of designated quantity of a plurality of the air-storing units at once and move the inflated air-storing units of designated quantity forward, so that the inflation system can be ready to inflate the air-storing units of the next batch, and thus a continuous and automatic inflation technology is achieved.

Another advantage of the present invention is to provide an inflation method, inflation system, and inflation apparatus for the air cushion body, wherein according to some embodiments, the inflation pipe of the inflation apparatus can inflate all the air-storing units of the batch of the air-storing units in one inflation process at once so as to boost inflation efficiency.

Another advantage of the present invention is to provide an inflation method, inflation system, and inflation apparatus for the air cushion body, wherein according to some embodiments, the inflation side of the continuous type air cushion body comprises an inflation unit having two sides which are not heat sealing, wherein the inflation unit is suitable for moving forward along the inflation pipe for the implementation of continuous inflation process.

Another advantage of the present invention is to provide an inflation method, inflation system, and inflation apparatus for the air cushion body, wherein according to some embodiments, the inflation unit at the inflation side of the continuous type air cushion body may comprise an inflation end portion formed by sealing at least two air cell films through a fringe heat sealing seam, wherein the inflation end portion can be split along the fringe heat sealing seam before or after the inflation process so as to allow the continuous type air cushion body to move forward.

Another advantage of the present invention is to provide an inflation method, inflation system, and inflation apparatus for the air cushion body, wherein according to some embodiments, the inflation pipe is extended in the inflation unit of the continuous type air cushion body and the two sides of the inflation unit are clamped and sealed so as to form an inflation channel in the inflation unit in a single inflation process. However, in the conventional art, a main duct for inflation is preformed, and an end of the main passage has an inflation inlet, while the other end of the main passage has to be closed.

Another advantage of the present invention is to provide an inflation method, inflation system, and inflation apparatus for the air cushion body, wherein according to some embodiments, the inflation pipe may comprise an elongated inflation groove arranged along the inflation channel, such that air released from the inflation groove can enter the air storage chamber of each air-storing unit immediately, so as to implement parallel inflation.

Another advantage of the present invention is to provide an inflation method, inflation system, and inflation apparatus for the air cushion body, wherein according to some embodiments, the inflation method also provides a wrapping step to wrap the inflated air-storing units, so as to save the required space thereof and facilitate a subsequent use.

Another advantage of the present invention is to provide an inflation method, inflation system, and inflation apparatus for the air cushion body, wherein according to some embodiments, the continuous type air cushion body may comprise a plurality of interconnected air cushion bodies, wherein each air cushion body can serve the cushion function independently, such as becoming an air packaging bag, an air cushion pad, etc., wherein the air packaging bag or air cushion pad can be inflated in a single inflation process cycle.

Another advantage of the present invention is to provide an inflation method, inflation system, and inflation apparatus for the air cushion body, wherein according to some embodiments, the inflation method also provides a product splitting step, such that the inflated air cushion body can be split into air packaging bag for packing goods or air cushion pad for cushioning.

Another advantage of the present invention is to provide an inflation method, inflation system, and inflation apparatus for the air cushion body, wherein the continuous type air cushion body can be continuously moved forward in a substantially horizontal condition, so that the operation is easy.

Another advantage of the present invention is to provide an inflation method, inflation system, and inflation apparatus for the air cushion body, wherein the continuous type air cushion body can be continuously moved forward in a substantially vertical condition, wherein the inflation apparatus is located above the continuous type air cushion body so as to save the required space of the inflation system in the inflation process.

Another advantage of the present invention is to provide an inflation method, inflation system, and inflation apparatus for the air cushion body, wherein the inflation system comprises a pressure detector so as to determine that the air storage chambers of the air-storing units of the air cushion body have attained the required pressure and complete one inflation process to keep the inflation result in the air-storing units when a predetermined air pressure is detected in the inflation pipe.

Another advantage of the present invention is to provide an inflation method, inflation system, and inflation apparatus for the air cushion body, wherein according to some embodiments, a plurality of air storing units of the continuous type air cushion body are simultaneously heat sealed and inflated, so as to form various individual sealed air cushion products.

In order to achieve the above objects, the present invention provides an inflation method for an air cushion body, wherein the air cushion body comprises one or more air storing units formed by at least two air cavity films, an inflation valve formed by at least two valve films, and an inflation unit integrally connected with the air storing units and formed by two inflation end portions overlapping with each other, wherein an inflation channel is formed between the two inflation end portions and the inflation valve forms at least one air inlet channel for inflating the corresponding air storing units, wherein the method comprises the following steps: sealing off two ends of the inflation channel to form an inflatable cavity, filling air into the inflatable cavity to allow the air enters the corresponding air storing units via the air inlet channel, and loosening the two ends of the inflation channel upon completion of inflation to obtain the air cushion body that is inflated.

Preferably, a plurality of the air cushion bodies are connected to form a continuous type air cushion body, wherein the method further comprises the following step: driving the continuous type air cushion body to move forward and splitting the inflation units so as to continuously and automatically inflate the air cushion bodies.

Preferably, the inflation method further comprises the following steps: determining if an air pressure in the air storing unit of the air cushion body has reached a predetermined level and stopping the inflation if so.

According to another aspect of the present invention, the present invention provides an inflation method for an air cushion body, wherein the air cushion body comprises one or more air storing units formed by at least two air cavity films, an inflation valve formed by at least two valve films, and an inflation unit integrally connected with the air storing units and formed by two inflation end portions overlapping with each other, wherein an inflation channel is formed between the two inflation end portions and the inflation valve forms at least one air inlet channel for inflating the corresponding air storing units, wherein the method comprises the following steps:

(a) arranging a vent hole of an inflation pipe connected with an air supply device into the inflation channel;

(b) closing openings on two ends of the inflation channel of the inflation unit to form a sealed inflatable cavity;

(c) inflating air into the inflatable cavity through the vent hole, and guiding air pumped into the inflatable cavity to enter the corresponding air storing units through the air inlet channel; and (d) releasing the openings of the two ends of the inflation channel of the inflation unit, such that the air cushion body is ready to leave away from the inflation pipe for obtaining the air cushion body that is inflated.

Preferably, in the step (a), the sealed distal end portion of the inflating portion of the inflation pipe enters the opening of an end of the inflation channel and penetrate through the opening of another end thereof, such that the main portion of the inflating portion is remained in the inflation channel and the vent hole formed in the main portion is located between the two inflation end portions of the inflation unit.

Preferably, in the step (a) and the step (d), the two ends of the inflation channel are closely clamped or released via two complementary clamping portions of a clamping device, so as to close or release the openings.

Preferably, the inflation method for the air cushion body further comprises the following step: starting or stopping the air supply of the air supply device to the inflation pipe through switching on or off the inflation control solenoid valve arranged in a pipeline between the air supply device and the inflation pipe.

Preferably, the step (c) further comprises the following step: detecting air pressure in the pressure control pipeline connected with the inflation pipe and switching off the inflation control solenoid valve arranged in the pipeline between the air supply device and the inflation pipe to stop the inflation if the air pressure reached the predetermined value.

Preferably, the inflation method for air cushion body further comprising the following steps:

(e) splitting the inflated inflation unit of the air cushion body, and detaching the inflated air cushion body from the inflation pipe along the length direction of the inflating portion of the inflation pipe.

Preferably, a plurality of the air cushion bodies are connected to form a continuous type air cushion body, wherein the inflation channel continuously communicating two adjacent air cushion bodies is formed respectively between the continuous type inflation units of the continuous type air cushion body, wherein the method further comprises the following step after the step (e): (f) driving the inflated air cushion body of the continuous type air cushion body to move forward to allow another adjacent air cushion body to reach at an inflation position, so as to continuously automatically inflate a plurality of air cushion bodies of the continuous type air cushion body.

Preferably, in the step (f), the driving force is provided by two conveying gears which are driven by a motor and are applied on the splitted inflation end portions of the inflation unit.

Preferably, the transfer rate and the transfer time of the two conveying gear are controlled and utilized for determining if the next air cushion body has reached at the inflation position.

Preferably, the inflation method for the air cushion body further comprises the following step: splitting the inflated air cushion body from the continuous type air cushion body so as to provide independent inflated air cushion bodies.

Preferably, the inflation method for the air cushion body further comprises the following step: continuously rolling up the inflated air cushion bodies together.

Preferably, the inflation method for the air cushion body further comprises the following step: driving the continuous type air cushion body arranged on a reel to rotate by rotation of the reel of a feeding device so as to continuously convey the air cushion body that is to be inflated to the inflation pipe.

According to another aspect of the present invention, the present invention provides an inflation apparatus for an air cushion body, wherein the air cushion body comprises one or more air storing units formed by at least two air cavity films, an inflation valve formed by at least two valve films, and an inflation unit integrally connected with the air storing units and formed by two inflation end portions overlapping with each other, wherein an inflation channel is formed between the two inflation end portions and the inflation valve forms at least one air inlet channel for inflating the corresponding air storing units, wherein the inflation apparatus comprises:

an inflation pipe, made of rigid material and adapted for being connected to an air supply device, wherein the inflation pipe comprises an inflating portion, wherein the inflating portion comprises a main portion and a sealed distal end portion extended from the main portion, wherein the main portion has at least a vent hole, wherein after the main portion of the inflating portion is arranged in the inflation channel, two ends of the inflation channel are sealed off to form an inflatable cavity, wherein air is inflated into the inflatable cavity through the vent hole, wherein air entered the inflatable cavity will enter the corresponding air storing units through the air inlet channel, so as to inflate the air cushion body.

Further, the inflation apparatus comprises a bracket, wherein the bracket comprises a mounting plate, wherein the inflation pipe comprises a mounting portion curvedly extended from the inflating portion for connecting with the air supply device, wherein the mounting portion is mounted on the mounting plate, wherein the inflating portion and the mounting plate are substantially arranged in a parallel manner.

Further, the main portion of the inflating portion either has one vent hole which is elongated in shape along the length direction thereof or has a plurality of the vent holes spacedly arranged.

Further, the inflation apparatus for the air cushion body comprises a clamping device, which comprises a first clamping unit, a second clamping unit, and a clamping power source, wherein the inflating portion of the inflation pipe is positioned between the first clamping unit and the second clamping unit, wherein the first clamping unit and the second clamping unit move towards or away from each other under the effect of the clamping power source, so as to close or release the two ends of the inflation channel of the air cushion body.

Further, the first clamping unit comprises two spaced first clamping portions, wherein the second clamping unit comprises two spaced second clamping portions coordinating with two of the first clamping portions respectively, wherein each first clamping portion has a first clamping surface and a first clamping groove arranged at a bottom thereof, wherein each second clamping portion has a second clamping surface and a second clamping groove arranged on a bottom thereof, wherein in a clamped state the first clamping portions and the second clamping portions clamp the two sides of the inflation unit with the first clamping surfaces and the second clamping surfaces in response to actuation of the clamping power source, such that each first clamping groove and second clamping groove form an entire clamping groove to accommodate the sealed distal end portion of the inflation pipe.

Further, the first clamping unit further comprises a first connecting portion connecting the two first clamping portions, wherein the second clamping unit further comprises a second connecting portion connecting the two second clamping portions.

Further, the clamping power source comprises two clamping air cylinders and two driving portions connected with the two clamping air cylinders, wherein the two driving portions are respectively connected with the first connecting portion and the second connecting portion, wherein the two clamping air cylinders drive the first clamping unit and the second clamping unit of the first clamping portion and the second clamping portion respectively to move towards or away from each other.

Further, the mounting plate has a clamping device retaining slot, wherein the two driving portions pass through the clamping device retaining slot to be mounted on the first connecting portion and the second connecting portion respectively, such that the two clamping air cylinders and the first and second clamping unit are respectively arranged at opposite sides of the mounting plate.

Further, the clamping device further comprises at least a holding unit that comprises two holding blocks and a guide rod arranged between the two holding blocks, wherein each of the first clamping unit and the second clamping unit further forms a top-to-bottom through guide rod hole in the corresponding first connecting portion and the second connecting portion for the guide rod to pass through, such that both the first clamping unit and the second clamping unit are located between the two holding blocks and the holding blocks are further affixed on the mounting plate.

Further, the clamping device further comprises the two holding units, wherein each of the first clamping unit and the second clamping unit has two spaced guide rod holes.

Further, a plurality of the air cushion body are connected to form a continuous type air cushion body, wherein the inflation apparatus further comprises a conveyor and a splitting device, wherein the conveyor brings the continuous type air cushion body to move forward along the inflating portion of the inflation pipe, wherein the splitting device comprises a splitting tool extended from the proximal end of the main portion of the inflating portion of the inflation pipe so as to stay out of the position of the vent hole and to split the inflation unit of inflated air cushion body, so as to allow the inflated air cushion body to be detached from the inflation pipe.

Further, the splitting device further comprises a holding device, which comprises a tool carrier for holding the splitting tool and a holding body connected with the tool carrier, wherein the holding body is affixed on the mounting plate.

Further, the inflating portion of the inflation pipe further comprises a tool mounting groove arranged on the inner side of the proximal end thereof for accommodating a sharp edge of the splitting tool.

Further, the splitting tool is inclinedly extended from the proximal end of the inflating portion of the inflation pipe.

Alternatively, the splitting device further comprises a holding device, which has a mounting hole, wherein the splitting tool has a stationary axle rotatably mounting the splitting tool at the mounting hole of the holding device.

Further, the splitting tool is a rotary cutting tool which has a continuous plane blade edge.

Alternatively, the splitting tool is a rotary cutting tool which has a continuous serrated blade edge.

Further, the conveyor comprises a first conveying unit, a second conveying unit, and a conveying power source driving the first conveying unit and the second conveying unit, wherein the two conveying units apply on split inflation unit to drive the continuous type air cushion body to move forward.

Further, the conveying power source comprises a conveying motor and an output shaft connected with the conveying motor, wherein the first conveying unit comprises a first connecting shaft connected thereon, a first conveying gear and a first driving gear mounted on two ends of the first connecting shaft respectively, wherein the second conveying unit comprises second connecting shaft connected thereon, a second conveying gear and a second driving gear mounted on two ends of the second connecting shaft respectively, wherein the first conveying gear and the second conveying gear are engaged with each other, wherein the first driving gear and the second driving gear are engaged with each other, wherein the second conveying unit further comprises a first roller mounted on the output shaft, a second roller mounted on the second connecting shaft and located at an outer side of the second driving gear, and a transmission belt rolled on the first roller and the second roller.

Further, the inflation apparatus also comprises a shifting device mounted on the mounting plate to drive the air cushion body to move along the moving direction thereof during the inflation process.

Further, the shifting device comprises an actuating mechanism, a clamping mechanism, and a shifting mechanism, wherein the clamping mechanism is affixed on the shifting mechanism, wherein the actuating mechanism provides driving force for the clamping mechanism and the shifting mechanism to drive the air cushion body to move along the moving direction thereof during the inflation process.

Further, the actuating mechanism comprises two identical second clamping air cylinders, wherein the clamping mechanism comprises a first clamping block and a second clamping block, which are respectively connected with the two second clamping air cylinders, so as to be controlled to move for clamping or loosening the clamping mechanism.

Further, the actuating mechanism further comprises two identical driving air cylinders connected with the shifting mechanism so as to move the shifting mechanism.

Further, the actuating mechanism is affixedly mounted on the back side of the mounting plate, wherein the shifting device comprises a guide rail, wherein the shifting mechanism and the clamping mechanism drive the air cushion body to move along the guide rail toward the moving direction thereof during the inflation process.

Further, the guide rail comprises two first guide rails and two second guide rails, wherein the shifting device further comprises a first shifting block and a second shifting block, wherein two ends of the first shifting block are respectively slidably connected with the first guide rail, so as to slide along the first guide rail, wherein two ends of the second shifting block are respectively slidably connected with the second guide rail, so as to slide along the second guide rail.

Further, the inflation apparatus also comprises a hanging support to hangingly support the bracket, so as to be suitable for keeping the continuous type air cushion body upright and be moved forward for the inflation.

Further, the inflation apparatus for the air cushion body further comprises a collecting device adapted for gathering and arranging the inflated air cushion body.

Further, the collecting device is a receiving rack arranged in the extended moving direction of the inflated air cushion body.

Further, the receiving rack is a cane-shaped hollow structure comprising an inlet, an outlet, a receiving shaft arranged internally, and a rotating motor driving the receiving shaft to bring the inflated air cushion body to enter the inlet and exit from the outlet.

Further, the receiving rack is cane-shaped and comprises a vertical portion and a lateral portion extended from the top of the vertical portion toward a direction away from the bracket, wherein the inlet is arranged in the vertical portion, wherein the outlet is arranged in the end of the lateral portion.

Further, the inlet is arranged in a side of the vertical portion facing the inflated air cushion body and the height of the inlet is not lower than the position and height of the inflated air cushion body.

Further, the collecting device further comprises a winding rack, which comprises a winding reel to roll up the air cushion bodies emerged from the outlet of the receiving rack via rotation of the winding reel.

Further, the winding reel is power driven.

Further, the rotating motor is connected with the winding reel so as to drive the winding reel to rotate and automatically roll up the products.

According to another aspect of the present invention, the present invention provides an inflation system for an air cushion body, wherein the air cushion body comprises one or more air storing units formed by at least two air cavity films, an inflation valve formed by at least two valve films, and an inflation unit integrally connected with the one or more air storing units and formed by two inflation end portions overlapping with each other, wherein an inflation channel is formed between the two inflation end portions and the inflation valve forms at least one air inlet channel for inflating the corresponding air storing units, wherein the inflation system comprises:

an inflation apparatus comprising a bracket and a rigid inflation pipe, wherein the bracket comprises a mounting plate, wherein the inflation pipe comprises an inflating portion and a mounting portion curvedly extended from the inflating portion, wherein the mounting portion is mounted on the mounting plate, wherein the inflating portion has a distal end portion thereof sealed off and at least a vent hole;

an air supply device, wherein the inflation pipe is communicatively connected with the air supply device;

a control device, wherein the inflation channel provides an inflatable cavity formed by sealing off the two ends thereof, wherein the vent hole of the inflating portion is arranged in the inflation channel, such that when the inflation pipe is communicated with the air supply device by the control of the control device, air is inflated into the inflatable cavity through the vent hole and then enter the corresponding air storing units through the air inlet channel so as to inflate the air cushion body.

Further, the inflation apparatus further comprises a clamping device, wherein the clamping device is driven by the control device to clamp the two sides of the inflation unit of the air cushion body that is to be inflated.

Further, the clamping device comprises a first clamping unit, a second clamping unit, and a clamping power source, wherein the inflation pipe is positioned between the first clamping unit and the second clamping unit, wherein the first clamping unit and the second clamping unit move towards or away from each other under the effect of the clamping power source, so as to close or loosen the two sides of the inflation unit of the air cushion body.

Further, a plurality of the air cushion body are connected to form a continuous type air cushion body, wherein the inflation apparatus further comprises a conveyor and a splitting device, wherein the conveyor brings the continuous type air cushion body to move forward along the inflating portion of the inflation pipe, wherein the splitting device comprises a splitting tool extended from the proximal end of the inflation pipe so as to stay out of the position of the vent hole and to split the inflation unit of inflated air cushion body, so as to allow inflated air cushion body to be detached from the inflation pipe.

Further, the conveyor comprises a first conveying unit, a second conveying unit and a conveying power source, wherein the first conveying unit and the second conveying unit apply on split inflation unit under the drive of the conveying power source, so as to move the continuous type air cushion body forward.

Further, the control device comprises a main control unit which comprises a main control module, wherein the control device further comprises an inflation control solenoid valve operatively connected with the main control module, wherein the inflation control solenoid valve is arranged in a pipeline structure between the air supply device and the inflation pipe so as to communicate the pipeline between the air supply device with the inflation pipe or disconnect the pipeline between the air supply device and the inflation pipe in response to the control command of the main control module.

Further, the inflation system for the air cushion body further comprises a pressure control duct communicatively connected with the inflation pipe, wherein the control device further comprises a pressure control unit operatively connected with the main control module, wherein the pressure control duct is connected with the pressure control unit to detect air pressure of the pressure control pipeline so as to determine if the inflation of the air storing unit of the air cushion body has attained the required air pressure, wherein the main control unit sends out a control command to stop the inflation if so.

Further, the inflation system for the air cushion body further comprises two air cylinder ducts communicatively connected with the air supply device, wherein the clamping power source comprises two clamping air cylinders respectively connected with the two air cylinder ducts to control the connection and disconnection of the two air cylinder ducts via cylinder control solenoids.

Further, the conveying power source of the conveyor comprises a conveying motor operatively connected with the main control module so as to start or stop conveying the continuous type air cushion body under the control of the main control module.

According to another aspect of the present invention, the present invention also provides a continuous type air cushion body, comprising a plurality of connected air cushion bodies, wherein each air cushion body comprises one or more air storing units formed by at least two air cavity films, an inflation valve formed by at least two valve films, and an inflation unit integrally connected with the one or more air storing units and formed by two inflation end portions overlapping with each other, wherein an inflation channel is formed between the two inflation end portions and the inflation valve forms at least one air inlet channel for inflating corresponding air storing units, wherein the inflation channel is formed by communicating two adjacent air cushion bodies, wherein in a continual automatic inflation process, two ends of the inflation channel are sealed so as to form an inflatable cavity, such that air that enters the inflatable cavity enters corresponding air storing units through the air inlet channel, wherein the two ends of the inflation channel are released upon completion of inflation, such that the inflated air cushion body is available.

Further, the inflation unit and the two air cell films are integrally formed, while preferably, the continuous type air cushion body further comprises a continuously heat sealing fringe heat sealing seam and an inflation channel heat sealing seam, wherein the fringe heat sealing seam heat seals the edges of the two inflation end portions of the inflation unit together, wherein the inflation channel heat sealing seam connects the two valve films with the two air cell films respectively, wherein the inflation channel is formed between the fringe heat sealing seam and the heat sealing seam.

Further, the two inflation end portions are formed by the two air cell films folded from one piece film.

Further, the inflation unit and the two valve films are integrally formed, while preferably, the continuous type air cushion body further comprises a continuously heat sealing fringe heat sealing seam and an inflation channel heat sealing seam, wherein the fringe heat sealing seam heat seals the edges of the two inflation end portions of the inflation unit together, wherein the inflation channel heat sealing seam connects the two valve films and the two air cell films respectively, wherein the inflation channel is formed between the fringe heat sealing seam and the heat sealing seam Further, the two inflation end portions are formed by the two valve films folded from one piece film.

Further, the continuous type air cushion body also comprises a heatproof layer arranged between the two valve films.

Further, the heatproof layer comprises a heatproof layer main body and a plurality of heatproof layer branches extended from the heatproof layer main body and spacedly arranged in each of the air storing units, wherein the heatproof layer main body is continuously extended in the inflation channel.

Further, the air cushion body is an inflatable cushion pad.

Further, the air cushion body is a three-dimensional packaging bag formed through a first thermoplastic sealing process and a secondary thermoplastic sealing process.

According to another aspect of the present invention, the present invention also provides an air cushion body, comprising one or more air storing units formed by at least two air cell films, an inflation valve formed by at least two valve films, and an inflation unit integrally connected with the one or more air storing units and formed by two inflation end portions overlapping with each other, wherein an inflation channel is formed between the two inflation end portions and the inflation valve forms at least one air inlet channel for inflating corresponding air storing units, wherein the inflation channel comprises two openings formed on the two sides respectively, wherein the openings at the two ends of the inflation channel are sealed off so as to form an inflatable cavity during inflation, wherein an inflation pipe for inflation is placed into the inflation channel to inflate into the inflatable cavity, wherein air that enters the inflatable cavity enters corresponding air storing units through the air inlet channel, wherein the two ends of the inflation channel are released upon the completion of inflation, such that the inflated air cushion body is available.

The inflation unit is integrally formed with the air cell films or the valve films.

According to another aspect of the present invention, the present invention provides an inflation method for an air cushion body, wherein the air cushion body comprises one or more air storing units formed by at least two air cell films, an inflation valve formed by at least two valve films, and an inflation unit integrally connected with the one or more air storing units and formed by two inflation end portions overlapping each other, wherein an inflation channel is formed between the two inflation end portions and the inflation valve forms at least one air inlet channel for inflating the corresponding air storing units, wherein the method comprises the following steps:

(a) closing the openings at the two ends of the inflation channel of the inflation unit so as to form a sealed inflatable cavity;

(b) moving the air cushion body forward;

(c) inflating the inflatable cavity through the vent hole, such that air filled into the inflatable cavity enters the corresponding air storing units through the air inlet channel; and (d) releasing the openings of the two ends of the inflation channel of the inflation unit, such that the air cushion body is ready to leave away from the inflation pipe, so as to obtain the air cushion body that is inflated.

Preferably, in the step (a) and the step (d), the two ends of the inflation channel are clamped or loosened via a complementary clamping device, so as to close or open the openings.

Preferably, it further comprises the following step before the step (c): detecting the air pressure connected with the inflation pipe and stopping the inflation if the air pressure reached a predetermined value.

Preferably, it further comprises the following step: (e) splitting the inflated inflation unit of the air cushion body and detaching the inflated air cushion body from the inflation pipe along the length direction of the inflating portion of the inflation pipe.

Preferably, a plurality of the air cushion bodies are connected to form a continuous type air cushion body, wherein the inflation channel continuously communicating two adjacent air cushion bodies is formed respectively between the continuous type inflation units of the continuous type air cushion body, wherein the method further comprises the following step after step (e): (f) driving the inflated air cushion body of the continuous type air cushion body to move forward to allow another adjacent air cushion body reach to an inflation position and to continuously automatically inflate a plurality of air cushion bodies of the continuous type air cushion body.

Preferably, in the step (f) the driving force is provided by two conveying gears which are driven by a motor and are applied on the splitted inflation end portions of the inflation unit.

Preferably, it further comprises the following step before the step (a): determining if the air cushion body has arrived at the inflation position.

Preferably, it further comprises the following step: cutting down the inflated air cushion body from the continuous type air cushion body so as to provide independent inflated air cushion bodies.

Preferably, it further comprises the following step: continuously rolling up the inflated air cushion bodies together.

Preferably, it further comprises the following step: guiding the moving direction of the air cushion body in the inflation process.

Preferably, it further comprises the following step: driving the continuous type air cushion body arranged on a reel to rotate so as to continuously convey the air cushion body that is to be inflated to the inflation pipe by rotating the reel of the feeding device.

According to another aspect of the present invention, the present invention provides an operating system of the inflation apparatus for the air cushion body for controlling the operation of the inflation apparatus for the air cushion body. The operating system comprises a man-machine interface panel and a circuit board electrically connected with the man-machine interface panel in order to receive the commands sent from the man-machine interface panel and control the operations of corresponding components of the inflation apparatus for the air cushion body.

Preferably, the man-machine interface panel comprises a start-stop button and a setting button arranged thereon. The start-stop button and the setting button are both electrically connected with the circuit board to control the start and stop of the inflation apparatus for the air cushion body and set up specific operating parameters of the inflation apparatus for the air cushion body during the operation.

Preferably, the setting button comprises a temperature setting button electrically connected with the circuit board to control the temperature for the inflation of the inflation apparatus for the air cushion body.

Preferably, the setting button comprises an air volume setting button electrically connected with the circuit board to control the air volume for the inflation of the inflation apparatus for the air cushion body.

Preferably, the setting button comprises a rate setting button electrically connected with the circuit board to control the inflating rate of the inflation apparatus for the air cushion body.

Preferably, the setting button comprises an operating mode setting button electrically connected with the circuit board to control the operating mode that the inflation apparatus for the air cushion body applies during the inflation process.

Preferably, the setting button comprises a default mode button electrically connected with the circuit board to control if the inflation apparatus for the air cushion body applies the default mode during the inflation.

Preferably, the setting button comprises a custom button electrically connected with the circuit board to adjust the inflation temperature, inflation volume, and inflating rate of the inflation apparatus for the air cushion body based on the needs.

Preferably, the setting button comprises an accessibility button electrically connected with the circuit board to control the inflation apparatus for the air cushion body to rotate the air cushion body forward or backward.

Preferably, the accessibility button comprises a forward button and a backward button, wherein the forward button is electrically connected with the circuit board to control the inflation apparatus for the air cushion body to rotate forward, wherein the backward button is electrically connected with the circuit board to control the inflation apparatus for the air cushion body to rotate backward.

Preferably, the start-stop button is a touch screen button.

Preferably, the setting button is a touch screen button.

Preferably, the start-stop button is a physical keyboard.

Preferably, the start-stop button is a physical keyboard.

According to another aspect of the present invention, the present invention further provides an operational method of the inflation apparatus for the air cushion body, comprising the following steps:

(1) turning on the power of the inflation apparatus for the air cushion body;

(2) setting up the operational parameters of the inflation apparatus for the air cushion body;

(3) starting or stopping the operation of the set parameters; and (4) turning off the power of the inflation apparatus for the air cushion body.

Preferably, the step (2) comprises a step of setting up a temperature parameter.

Preferably, the step of setting up a temperature parameter comprises a step of directly setting up the inflation temperature of the inflation apparatus for the air cushion body.

Preferably, the step of setting up a temperature parameter further comprises a step of adjusting the temperature during the inflation process of the inflation apparatus for the air cushion body, so as to increase or decrease the inflation temperature of the inflation apparatus for the air cushion body during the inflation process.

Preferably, the step (2) comprises a step of setting up an air volume parameter.

Preferably, the step of setting up an air volume parameter comprises a step of directly setting up the inflation volume of the inflation apparatus for the air cushion body.

Preferably, the step of setting up an air volume parameter further comprises a step of adjusting the inflation volume during the inflation process of the inflation apparatus for the air cushion body, so as to increase or decrease the inflation volume of the inflation apparatus for the air cushion body during the inflation process.

Preferably, the step (2) comprises a step of setting up a rate parameter.

Preferably, the step of setting up a rate parameter comprises a step of directly setting up the inflating rate of the inflation apparatus for the air cushion body.

Preferably, the step of setting up a rate parameter further comprises a step of adjusting the inflating rate during the inflation process of the inflation apparatus for the air cushion body, so as to increase or decrease the inflating rate of the inflation apparatus for the air cushion body during the inflation process.

Preferably, the step (2) comprises a step of setting up operating modes.

Preferably, the step of setting up operating modes comprises a step of setting up a counting mode and a step of setting up a continual mode.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

FIGS. 3-13 illustrate the inflation system for the air cushion body 10 according to a preferred embodiment of the present invention. The inflation system comprises an inflation apparatus 30, an air supply device 40, and a control device 50. The air cushion body 10 is an air cushion material that is able to store gas and is formed by heat sealing two or more layers of flexible films. The inflation apparatus 30 is for conducting the inflation process to the air cushion body 10. The air supply device 40 is for providing filling gas to the inflation apparatus 30. The control device 50 is for controlling the operation of the entire system.

Figure 20:
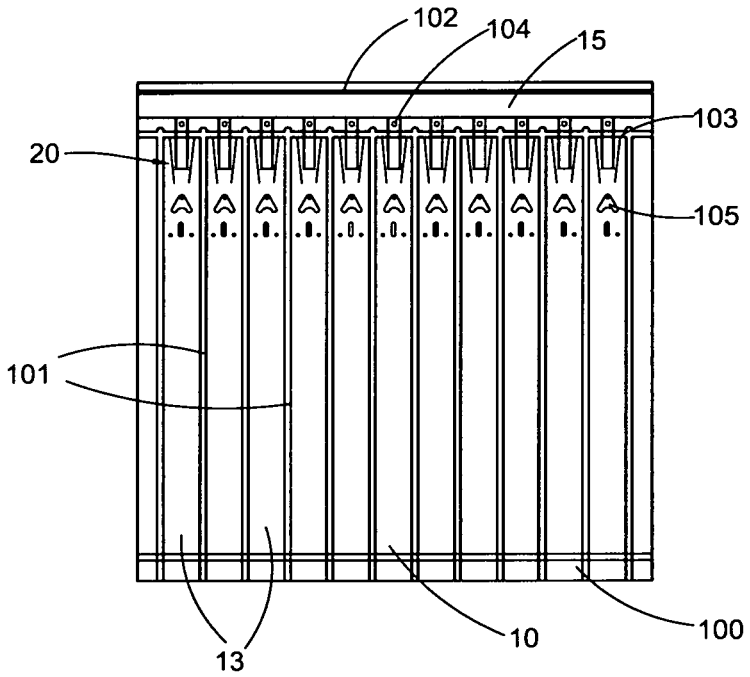
FIG. 20 is a 3D perspective view of the continuous type air cushion body according to the above preferred embodiment of the present invention.
Figure 21:
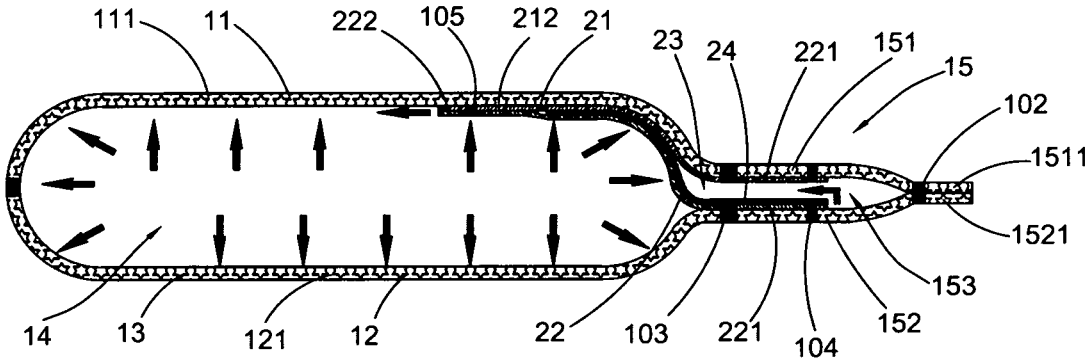
FIG. 21 is a sectional view of the continuous type air cushion body according to the above preferred embodiment of the present invention.

According to this preferred embodiment, a plurality of the air cushion bodies 10 is connected to form a continuous type air cushion body 100. Each of the air cushion bodies 10 comprises one or more connected air storing unit s 13 formed by heat sealing at least two layers of air cell films 11 and 12. Referring to FIGS. 20 and 21, the continuous type air cushion body 100 is equivalent to a plurality of interconnected air storing units 13 and each of the air storing units 13 forms an air storage chamber 14 that can store gas internally. In a single inflation process of the inflation apparatus 30 to the continuous type air cushion body 100, it can inflate the one or more air storing units 13 of one of the air cushion body 10.

More specifically, the two layers of air cell films 11 and 12 are divided into a plurality of the air storing units 13 by numerous rows of dividing seams 101. Specifically, each row of the dividing seams 101 is formed by heat-sealing technology that the seam connects two layers of the air cell films 11 and 12 so as to form a row of the dividing seam 101 between two adjacent air storing units 13. The dividing seam 101 may be a continuous heat sealing line so as to allow a plurality of the air storing units 13 be independent to one another. The dividing seam 101 may also be an interrupted heat sealing line so as to have a plurality of the air storing units 13 be interconnected. The air storing unit 13 can be in various shapes, such as linear, circular, polygon, irregular, etc. Referring to FIG. 20, the air cushion body 10 according to the present invention may comprise a plurality of inflation columns abreast arranged, but the present invention shall not be limited thereto.

According to this preferred embodiment, the air cushion body 10 further comprises an inflation valve 20 formed by at least two valve films 21 and 22. The two valve films 21 and 22 of the inflation valve 20 and the air cell films 11 and 12 are overlappedly arranged. Besides, an air inlet channel 23 is formed between the valve films 21 and 22 for inflating to the air storage chamber 14. When the air storage chamber 14 is inflated via the air inlet channel 23 and the air pressure in the air storage chamber 14 has attained the predetermined required value, the air pressure in the air storage chamber 14 will act on the valve films 21 and 22 so as to attach the valve films 21 and 22 on one of the air cell film, which closes the air inlet channel 23 and makes the inflation valve 20 serve as a one-way valve. When each air storing unit 13 has at least an air inlet channel 23 formed therein and each of the air storing units 13 is independent to one another, even if one of the air storing units 13 is damaged and leaks, the rest of the air storing units 13 will not be affected, but still serve as air cushions.

The air cushion body 10 further comprises an inflation unit 15 connected with each of the air storing units 13 or, preferably, integrally formed with each of the air storing units 13. More specifically, according to this preferred embodiment, the air cell films 11 and 12 respectively form air cell film main portions 111 and 121 and inflation end portions 151 and 152 respectively integrally extended from the air cell film main portions 111 and 121. The air cell film main portions 111 and 121 are formed in the air storing unit 13 through heat-sealing technology. The inflation end portions 151 and 152 of the inflation unit 15 are respectively formed by part of the air cell films 11 and 12 at the inflation side. The inflation end portions 151 and 152 overlap with each other and each has a terminal fringe 1511 and 1521 interconnected through a fringe heat sealing seam 102. The fringe heat sealing seam 102 is formed through heat-sealing technology and is to heat-sealingly connect the fringes 1511 and 1521 of the inflation end portions 151 and 152.

Figure 22:
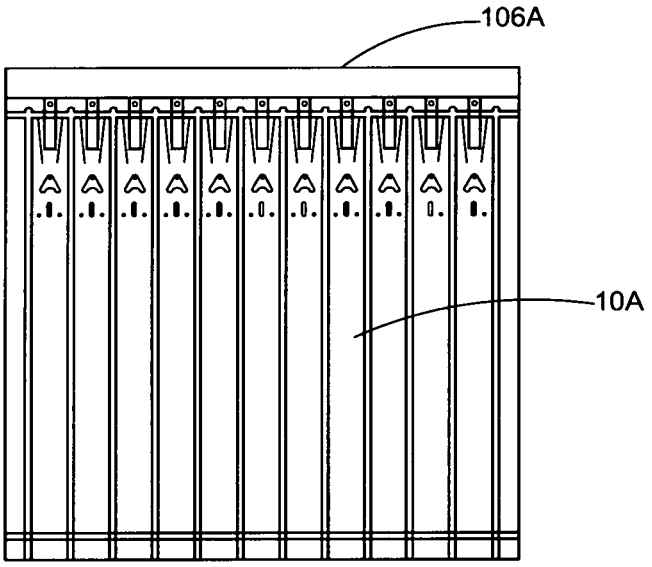
FIG. 22 is a 3D perspective view of the continuous type air cushion body according to an alternative mode of the above preferred embodiment of the present invention.
Figure 23:
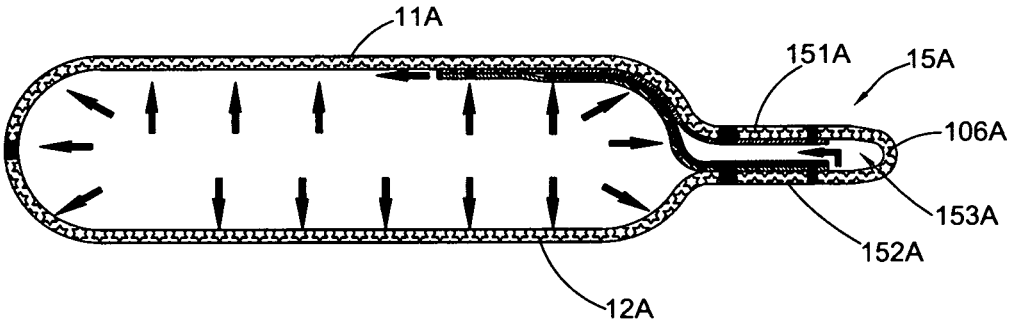
FIG. 23 is a sectional view of the continuous type air cushion body according to the above alternative mode of the above preferred embodiment of the present invention.

Referring to FIGS. 22-23, according to another alternative mode, the two air cell films 11A and 12A may also be formed by folding up one piece of film along the folding line 106A. In other words, the two air cell films 11A and 12A are integrally extended. Moreover, the inflation unit 15A can also correspondingly be formed by folding up the integrally connected inflation end portions 151A and 152A. Therefore an inflation channel 153A can be formed between the folding line 106A and the inflation channel heat sealing seam 103A. In other words, according to the embodiment illustrated in FIGS. 22-23, the fringe heat sealing seam 102 in the above embodiment is not required.

The air cell films 11 and 12 are respectively connected with the valve films 21 and 22 through an inflation channel heat sealing seam 103 at the positions where the air cell film main portions 111 and 121 of the air cell films 11 and 12 respectively connected with the inflation end portions 151 and 152. For example, the inflation channel heat sealing seam 103 can make it through heat-sealing four layers of films at once. It heat-sealingly connects and encloses the air cell film 11 and the valve film 21 and heat-sealingly connects and encloses the air cell film 12 and the valve film 22, but does not heat-sealingly connect and enclose the valve films 21 and 22, such that the air inlet channel 23 for inflating to the air storing unit 13 can be formed between the valve films 21 and 22.

It is worth mentioning that when the inflation channel heat sealing seam 103 is formed through heat-sealing technology, there can be a heatproof barrier applied between the valve films 21 and 22, so as to prevent the valve films 21 and 22 from be heat sealed together. According to this embodiment, the valve films 21 and 22 may also have a plurality of heatproof layers 24, such as thermostable inks, etc., arranged therebetween, to be spacedly arranged in correspondence to the air inlet channel(s) 23 and be attached on the inner surface of either of the valve films 21 and 22, such that the heatproof layer 24 can prevent the valve films 21 and 22 from being connected due to the heat-sealing operation of the inflation channel heat sealing seam 103 in the heat-sealing technology. Therefore, the air inlet channels 23 can be formed between the valve films 21 and 22 for connecting and communicating with the inflation channel 153 in the inflation unit 15.

More specifically, the inflation unit 15 of the air cushion body 10 has the inflation channel 153 formed between the fringe heat sealing seam 102 and the inflation channel heat sealing seam 103. Referring to FIG. 20, in this embodiment, it is simply configured that the air storing unit 13 is arranged longitudinally and the inflation channel 153 is arranged laterally. Therefore, the longitudinally arranged air storing units 13 can all be connected with the same laterally arranged inflation channel 153 through corresponding air inlet channels 13 before inflation. In other words, the inflation channel 153 is extended along the width direction of the air cushion body 10 and is connected with each of the air storing units 13 arranged along the length direction.

The valve films 21 and 22 are respectively defined into proximal end portions 211 and 221 and distal end portions 212 and 222 along the length thereof. The proximal end portions 211 and 221 of the valve films 21 and 22 are extended into the inflation channel 153 of the inflation unit 15. The distal end portions 212 and 222 of the valve films 21 and 22 are overlapped to each other and extended into the air storage chamber 14 to form the air inlet channel 23. The inflation end portions 151 and 152 of the inflation unit 15 are respectively heat-sealingly connected with the proximal end portions 211 and 221 of the valve films 21 and 22 through the connecting seam 104 at a proper position below the top of the heatproof layer 24. Therefore, during the inflation, the proximal end portions 211 and 221 of the valve films 21 and 22 can respectively be synchronizedly expanded with the inflation end portions 151 and 152 of the inflation unit 15, which means to respectively be synchronizedly expanded with the inflation end portions formed by the air cell films 11 and 12 respectively, so as to open the channel between the valve films 21 and 22. Similarly, because there is the heatproof layer 24 in the technology of heat-sealing four films, though the inflation end portion 151 and the proximal end portion 211 of the valve film 21 is heat-sealingly connected and the inflation end portion 152 and the proximal end portion 221 of the valve film 22 is heat-sealingly connected so as to form the connecting seam, nonetheless, the proximal end portions 211 and 221 of the valve films 21 and 22 will not be heat-sealingly connected. According to this embodiment, a plurality of the connecting seams 104 have interrupted heat sealing spots arranged along the extending direction of the inflation channel 153 of the inflation unit 15.

The distal end portion 212 and 222 of the valve films 21 and 22 further have a plurality of blocking seams 105 formed by heat-sealingly connecting the distal end portion 212 and 222 of the valve films 21 and 22 with the air cell film 11 through heat-sealing technology. In other words, the blocking seam 105 heat-sealingly connects three layers of films. The shape and size of the arrangement of the blocking seam 105 will not affect the air intake function of the air inlet channel 23, but it can block the air in the air storage chamber 14 of the air storing unit 13 from reversing into the inflation channel 153 after the inflation is done. Besides, because the blocking seam 105 heat-sealingly connects three layers of films, when the air storage chamber 14 of the air storing unit 13 has attained a predetermined air pressure, the distal end portions 212 and 222 of the valve films 21 and 22 can be expanded with the air cell film 11 at the same time so as to eventually attach on the air cell film 11 to close the air inlet channel 23.

The dividing seam 101 is not extended to the fringe heat sealing seam 102 on the two sides of each of the air cushion bodies 10 of the continuous type air cushion body 100, but connected to the inflation channel heat sealing seam 103, such that the two sides of the inflation channel 153 respectively have an opening 154 correspondingly extended between the fringe heat sealing seam 102 and the inflation channel heat sealing seam 103. According to the prior art illustrated in FIG. 2, an end of an inflation cushion substance has an inflation opening for inflation, while the other side thereof has to be closed so as to allow the inflation opening to be used for inflation operation. However, according to the present invention, the opening 154 is not utilized as an inflation inlet, which will be further illustrated in detail in the following content.

Preferably, the continuous type air cushion body 100 can have a continuously communicated inflation channel 153 formed therein. That is to say, the inflation channels 153 of the adjacent air cushion bodies 10 are interconnected and communicated, so as to form an overall interconnected inflation channel 153. When an air cushion body 10 having one or more of the air storing units 13 is inflated, the two sides of the inflation channel 153 is sealed, so as to form a sealed inflatable cavity 155, such that air enters the inflatable cavity 155 will be able to further enter the air storage chamber 14 of each air storing unit 13 through each corresponding air inlet channel 23.

In addition, the air cell films 11 and 12 of the air cushion body 10 and the valve films 21 and 22 of the inflation valve 20 can respectively be made of various suitable membrane materials, such as polyethylene film, polypropylene film, polyvinyl chloride film, polyester film, polystyrene film, composite film, and etc., wherein the present invention shall not be limited thereto, as long as suitable flexible films are utilized. It is worth mentioning that in order to enhance the one-way sealing function, the valve films 21 and 22 of the inflation valve 20 can also be self-adhesive films acquired by adding chemical composition to the above films.

It is worth mentioning that the air cushion body 10 of the continuous type air cushion body 100 according to the above embodiment is a plane cushion body, while the air cushion body 10 according to another alternative mode will be further introduced as follows.

Figure 24:
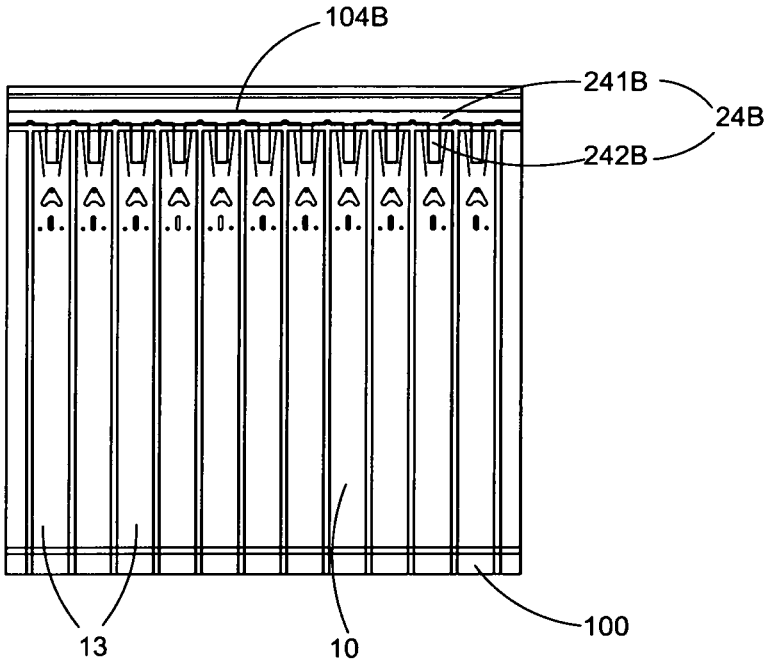
FIG. 24 is a 3D perspective view of the continuous type air cushion body according to an alternative mode of the above preferred embodiment of the present invention.
Figure 25:
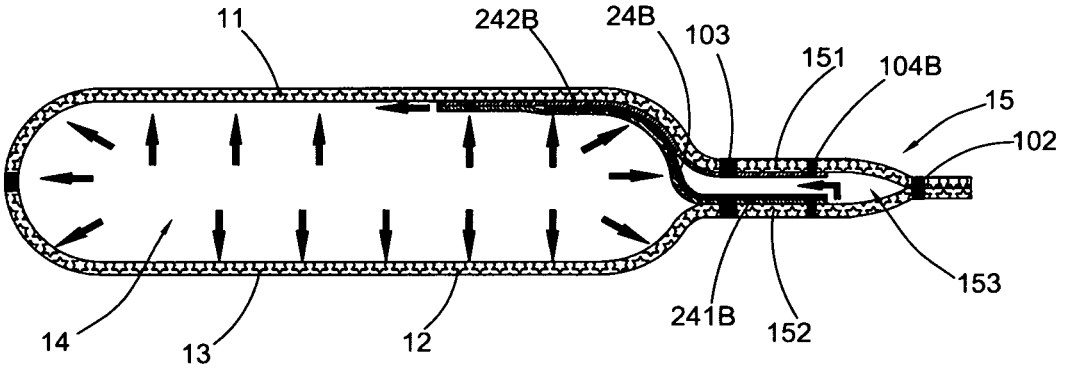
FIG. 25 is a sectional view of the continuous type air cushion body according to the above alternative mode of the above preferred embodiment of the present invention.

Referring to FIGS. 24-25, similarly, the continuous type air cushion body 100 comprises a plurality of the air cushion bodies 10, wherein each of the air cushion body 10 comprises a plurality of air storing units 13 and an inflation unit 15. The valve films 21 and 22 have a heatproof layer 24B arranged therebetween attached on the inner surface of either one of the valve films. The heatproof layer 24B comprises a heatproof layer main body 241B and a plurality of heatproof layer branch 242B spacedly extended from the heatproof layer main body 241B The heatproof layer main body 241B is integrally extended along the direction of the inflation channel 153. Each heatproof layer branch 242B is extended into each air storing unit 13 so as to ensure the formation of the air inlet channel 23.

The air cell films 11 and 12 further respectively heat-sealingly connect with the valve films 21 and 22 through continuous connecting seam 104B. Because there is the heatproof layer main body 241B, the connecting seam 104B will not heat-sealingly connect between the valve films 21 and 22. Therefore, when the inflatable cavity 155 is formed during the inflation operation, the valve films 21 and 22 can respectively be synchronizedly expanded with the air cell films 11 and 12 respectively, which helps to open each of the air inlet channels 23.

Figure 26:
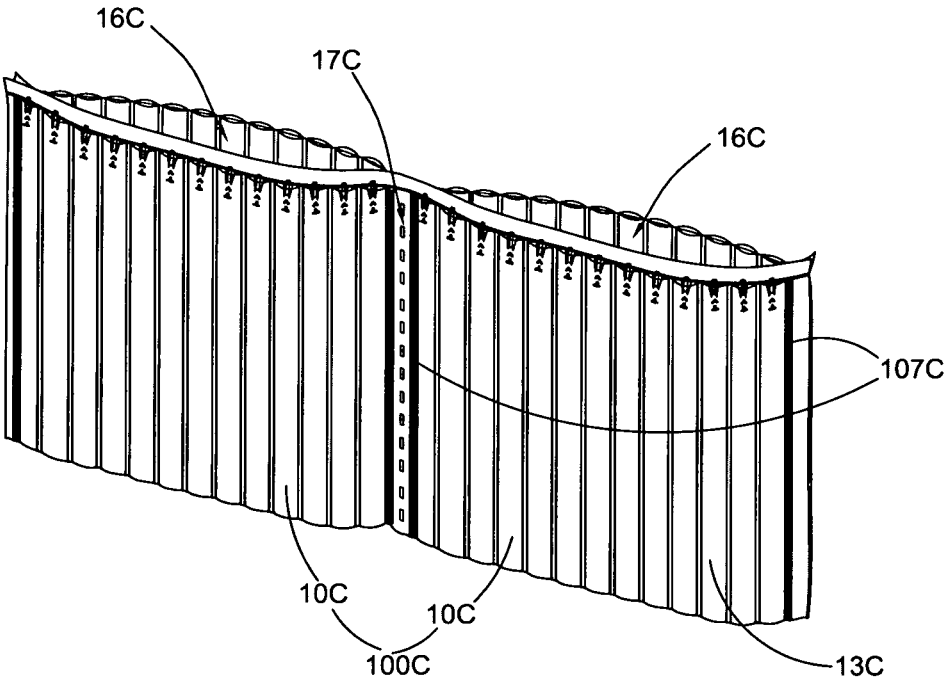
FIG. 26 is a 3D perspective view of the continuous type air cushion body according to another alternative mode of the above preferred embodiment of the present invention.
Figure 27:
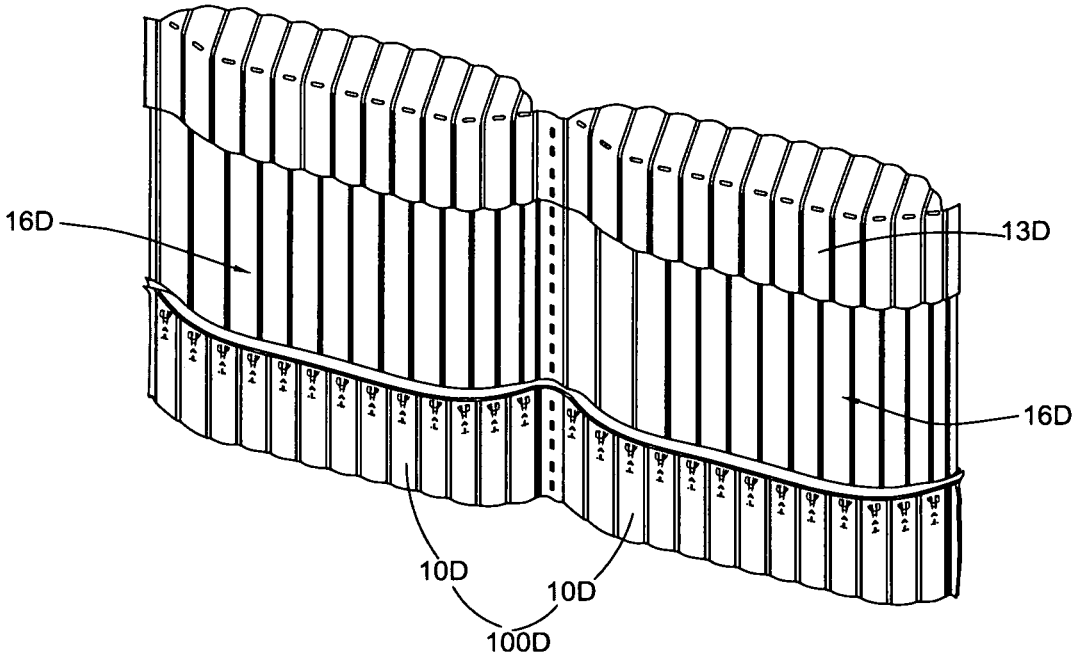
FIG. 27 is a 3D perspective view of the continuous type air cushion body according to another alternative mode of the above preferred embodiment of the present invention.
Figure 28:
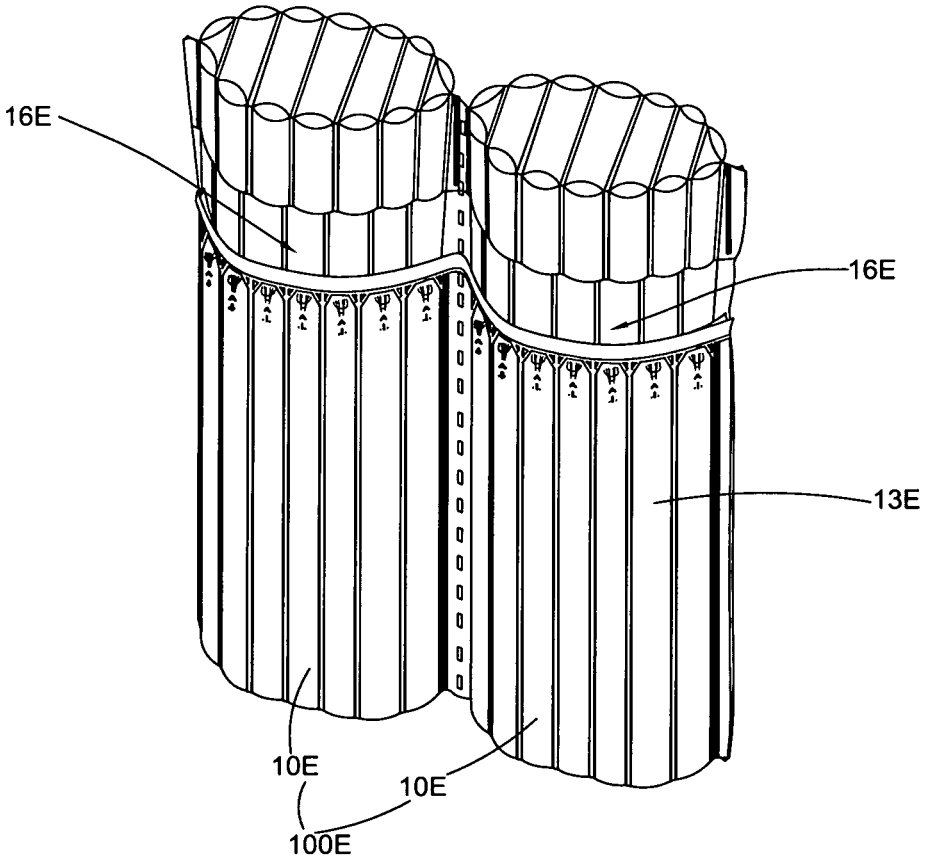
FIG. 28 is a 3D perspective view of the continuous type air cushion body according to another alternative mode of the above preferred embodiment of the present invention.

FIGS. 26-28 illustrated the continuous type air cushion body 100 according to another alternative mode, where inflated structures thereof are illustrated and the continuous type air cushion body 100 can be embodied as a three-dimensional air packaging material. Specifically, referring to FIG. 26, the continuous type air cushion body 100C comprises a plurality of air cushion bodies 10C that can be directly utilized as packing bags to pack goods. In other words, in contrast to the air cushion body 10 of the plane cushion material formed by a first thermoplastic sealing process according to the above embodiment, the air cushion body 10C according to this embodiment further has a secondary thermoplastic sealing seam 107C, which means the air cushion body 10C has been through a first thermoplastic sealing process and a second thermoplastic sealing process to become a packing bag. The first thermoplastic sealing step is to form a plane cushion material. Then the secondary thermoplastic sealing seam 107C further forms a plurality of side walls by bending the plane cushion material, so as to construct a three-dimensional packaging bag that has an accommodating chamber 16C. According to the embodiment illustrated in FIG. 26, the second thermoplastic sealing seam 107C is formed on the two sides of the plane cushion substance respectively so as to make a U-shaped three-dimensional packaging bag. Referring to FIGS. 27-28, a plurality of the air storing units 13D and 13E are further bent, such that a plurality of side walls can make the air cushion body 10D form into a C-shaped bag style or in an O-shaped bag style after the second thermoplastic sealing. Person skilled in the art should be able to understand that the above styles of the three-dimensional bag are just examples rather than limits to the present invention. The inflation technology of the present invention may also be utilized for making three-dimensional packaging bags in other styles.

In addition, referring to FIG. 26, two adjacent air cushion bodies 10C also have a tearing line 17C formed therebetween by, for example, a plurality of interrupted processing lines formed on the air cell films and the valve films by means of a serrated tool.

Figure 29:
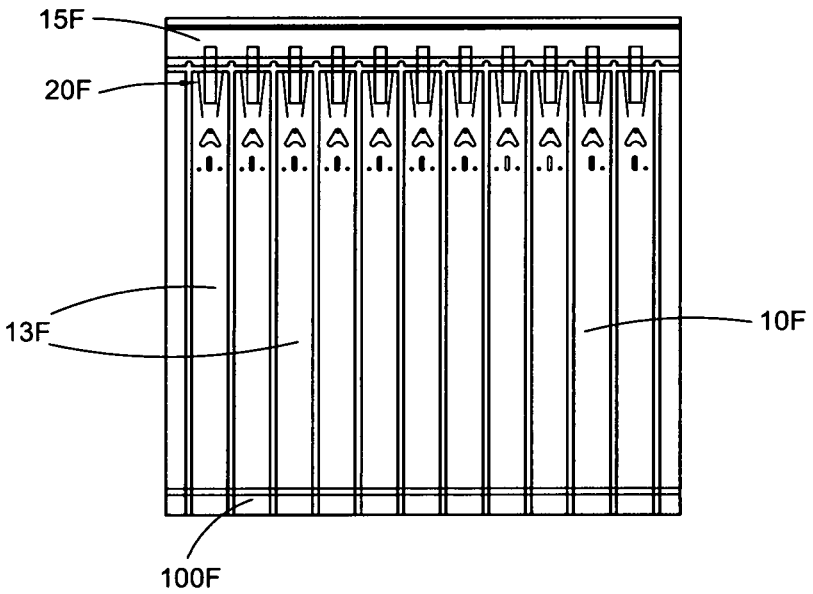
FIG. 29 is a 3D perspective view of another continuous type air cushion body according to the above preferred embodiment of the present invention.
Figure 30:
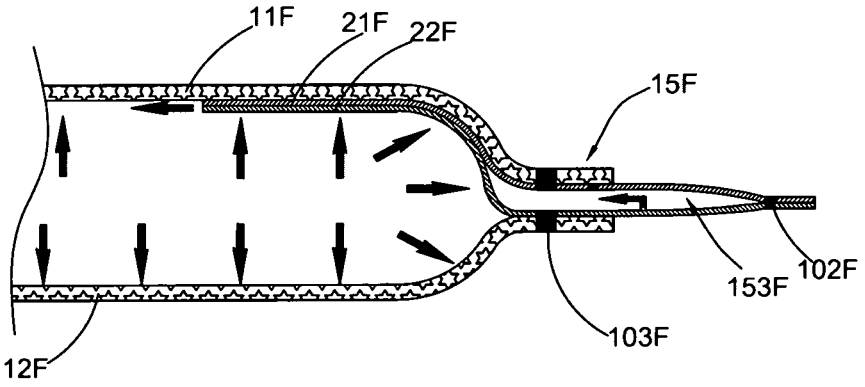
FIG. 30 is a sectional view of the above continuous type air cushion body according to the above preferred embodiment of the present invention.

Referring to FIGS. 29-30, according to this alternative mode, the air cushion body 10F comprises a plurality of air storing units 13F and an inflation unit 15F integrally connected and formed with the two valve films 21F and 22F. In other words, the inflation unit 15F is formed by integrally extending the two valve films 21F and 22F.

Specifically, the inflation unit 15F comprises two inflation end portions 151F and 152F respectively integrally extended from the valve films 21F and 22F, while the air cell films 11F and 12F is only extended to the position of the inflation channel heat sealing seam 103F. Therefore, as the inflation starts, the gas in the inflation pipe 32 will enter the inflation channel 153F defined by the inflation end portions 151F and 152F formed by the external end of the two valve films 21F and 22F directly, so as to further enter each of the air inlet channels 23F. Correspondingly, the splitting tool 35 will split the inflation unit 15F formed by the two valve films 21F and 22F in the splitting operation. Besides, the conveyor 34 will also act on the inflation unit 15F formed by the two valve films 21F and 22F.

Figure 31:
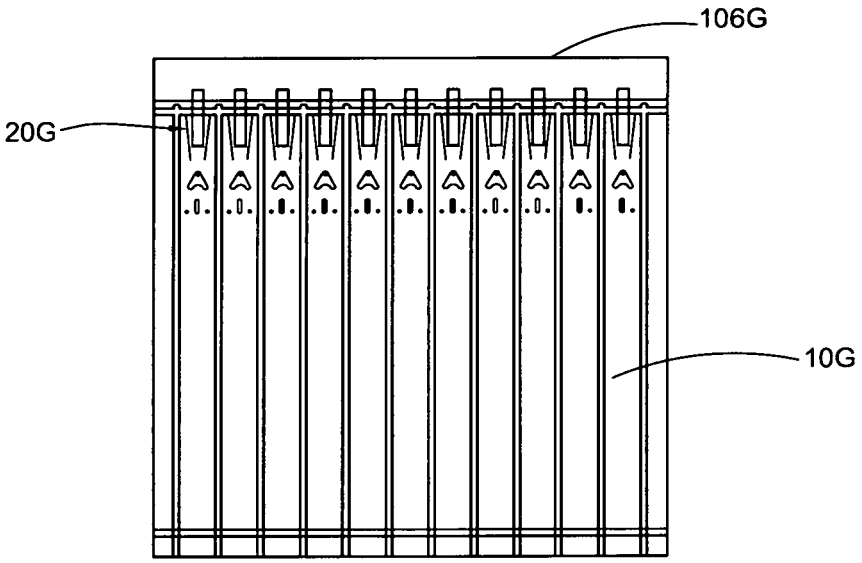
FIG. 31 is a 3D perspective view of another continuous type air cushion body according to the above preferred embodiment of the present invention.
Figure 32:
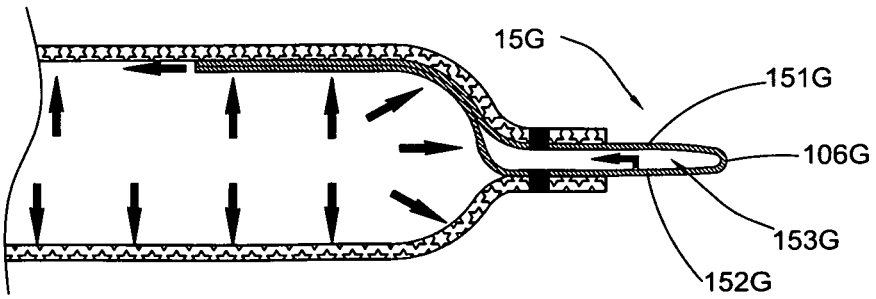
FIG. 32 is a sectional view of the above continuous type air cushion body according to the above preferred embodiment of the present invention.

In addition, according to this alternative mode, the two inflation end portions 151F and 152F can be formed by two independent films and heat-sealingly connected through a continuous fringe heat sealing seam 102F. Nevertheless, referring to FIGS. 31-32, the two inflation end portions 151G and 152G can also be formed by a single film by folding along the folding line 106G, which does not require the heat-sealingly connection and the continuous fringe heat sealing seam 102F.

The inflation system of the present invention can continuously and automatically inflate the continuous type air cushion bodies 100. Specifically, the inflation apparatus 30 comprises a bracket 31, an inflation pipe 32 arranged on the bracket 31, a clamping device 33, a conveyor 34, and a splitting device 35.

Figure 3:
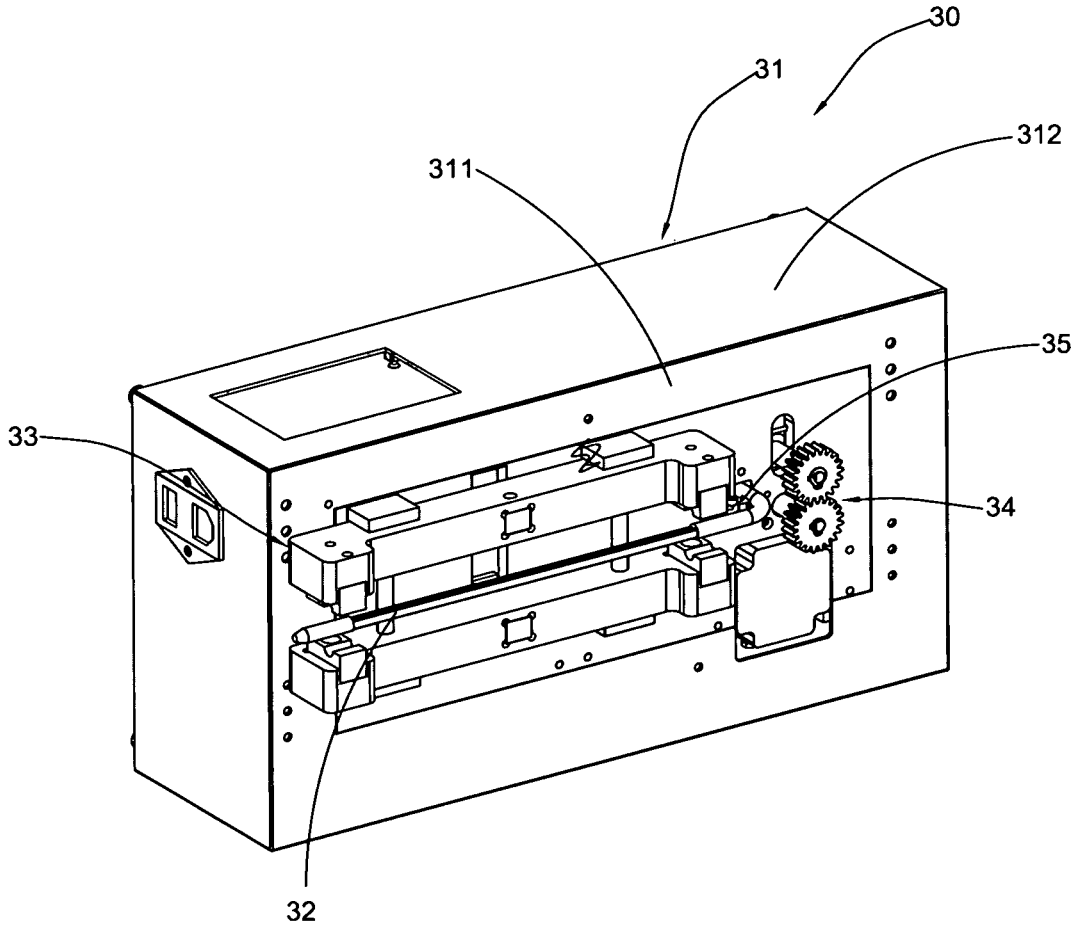
FIG. 3 is a 3D perspective view of the inflation apparatus for the air cushion body according to a preferred embodiment of the present invention.
Figure 4:
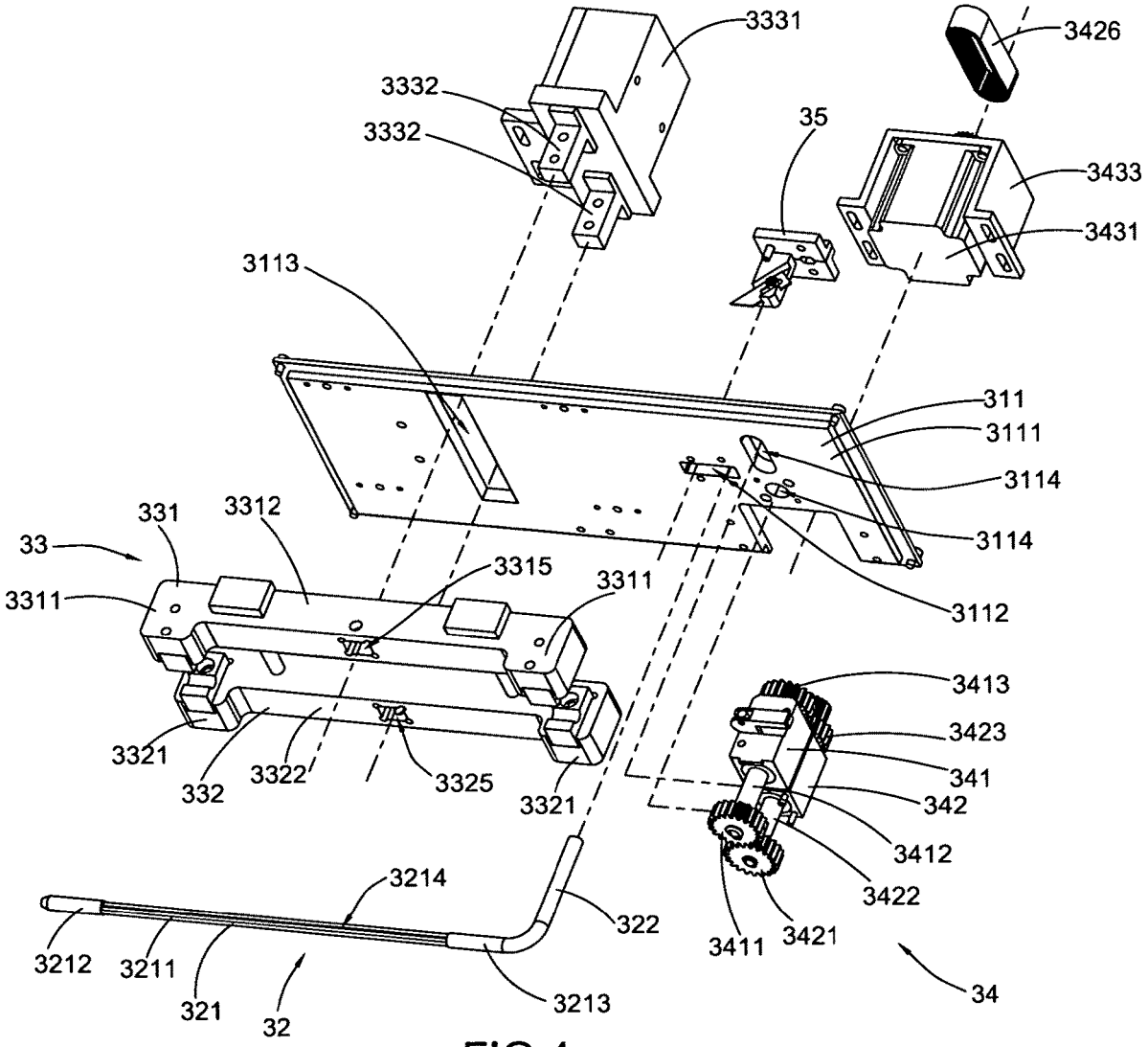
FIG. 4 is an exploded view of the inflation apparatus for the air cushion body assembled on the mounting plate of the bracket according to the above preferred embodiment of the present invention.
Figure 5:
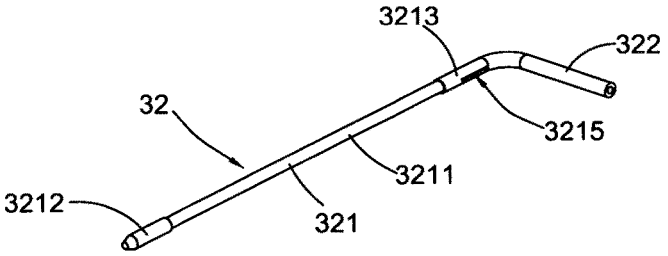
FIG. 5 is a perspective view of the inner side of the inflation pipe of the inflation apparatus for the air cushion body according to the above preferred embodiment of the present invention.

More specifically, referring to FIGS. 3 and 4, the bracket 31 comprises a mounting plate 311, which, as embodied in the figures, can be a piece of mounting plate 311 arranged along the perpendicular direction for other parts to be mounted thereon. The bracket 31 further comprises other shell plates 312 as the drawing illustrated. The mounting plate 311 and the shell plates 312 can be assembled into a box-like structure, so as to protect internal structures. The apparatus in use can be placed on a surface of the environment, such as tabletop, ground, etc., or further be affixed on a tabletop, so as to prevent the bracket 31 from shaking during the inflation process.

In the embodiment illustrated in the drawings, the inflation pipe 32 is an elongated shaped tubular component, which can be arranged along a horizontal direction and allow gas to be conveyed internally. Referring to FIG. 4, the inflation pipe 32 is extended along the length direction of the mounting plate 311 and comprises an inflating portion 321 and a mounting portion 322 both either integrally extended therefrom or assembled thereon. The mounting portion 322 is bent and extended from the inflating portion 321 for connecting with the air supply device 40 and receiving air supply. As the embodiment illustrated in FIG. 4, the mounting portion 322 is substantially perpendicularly extended from the inflating portion 321, which forms a substantial right angle at the junction. In other words, referring to the drawings, the inflation pipe 32 is substantially L-shaped. Person skilled in the art should be able to understand that the inflating portion 321 and the mounting portion 322 can also be bent in a sharp angle or obtuse angle. In this way, the inflating portion 321 and the mounting plate 311 are spaced and substantially arranged in a parallel manner.

According to this preferred embodiment of the present invention, the inflation pipe 32 is a rigid structure, which, for example, can be made of metal material. The inflation pipe 32 can further be communicatively connected with the air supply device 40 through other rigid or soft tube, such that the inflating portion 321 of the inflation pipe 32 can conduct inflation process to the air cushion body 10.

Further, the mounting portion 322 is mounted in position through the mounting plate 311. Referring to FIG. 4, the mounting plate 311 comprises a mounting plate body 3111 and an inflation pipe mounting hole 3112 formed internally. The mounting portion 322 of the inflation pipe 32 passes through the inflation pipe mounting hole 3112 to enter the box-like structure formed by the bracket 31.

The inflating portion 321 comprises a main portion 3211 as well as a distal end portion 3212 and a proximal end portion 3213 respectively on the two sides of the main portion 3211. The distal end portion 3212 is sealed off. The proximal end portion 3213 is connected on the mounting portion 322. An elongated shaped vent hole 3214 is formed on the main portion 3211 along the length direction thereof, such that gas from the air supply device 40 can only enter the air cushion bodies 10 from the vent hole 3214.

Person skilled in the art should be able to understand that though the elongated-shaped vent hole 3214 is in a linear narrow gap shape in the embodiment illustrated in the drawing, it may also be embodied as other shapes. According to other feasible embodiment, the main portion 3211 may have a plurality of spaced vent holes along the length direction thereof.

According to this preferred embodiment of the present invention, the elongated shaped vent hole 3214 can be arranged on the top of the main portion 3211 of the inflating portion 321 of the inflation pipe 32, such that air can be upwards emitted from the vent hole 3214 in the inflation process. In real cases of practice, it may also be arranged on the bottom thereof so that air is discharged downward from the vent hole 3214 or arranged on the front side or back side thereof so as to discharge air forward or backward from the vent hole 3214.

In other words, according to this embodiment of the present invention, the vent hole 3214 can be formed on a side, rather than an end, of the inflating portion 321. According to the prior art illustrated FIG. 2, the air outlet of the inflation nozzle is at the end and the inflation nozzle is arranged in the inflation inlet of the air packaging material that air can only enter the air packaging material through the inflation inlet of the end.

In an inflation process, the main portion 3211 of the inflating portion 321 of the inflation pipe 32 is placed between the inflation end portions 151 and 152 of the inflation unit 15 of the air cushion body 10, such that air released from the vent hole 3214 will enter the inflation channel 153 of the inflation unit 15 and then enter each of the air storing units 13. Because the elongated shaped vent hole 3214 is extended on the entire inflation channel 153, air output from the vent hole 3214 can therefore enter each of the air storing units 13 substantially at the same time.

Figure 1:
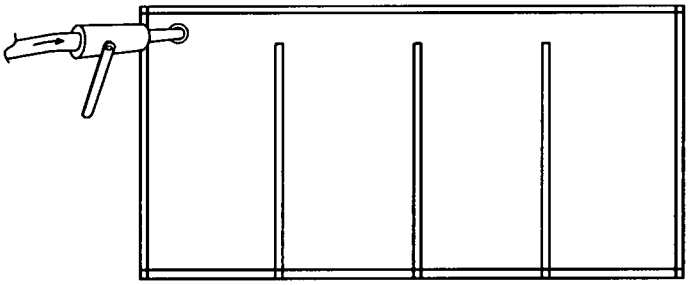
FIG.1 Prior Art
FIG. 1 illustrates a prior art regarding an inflation way for air filling substance.
Figure 2:
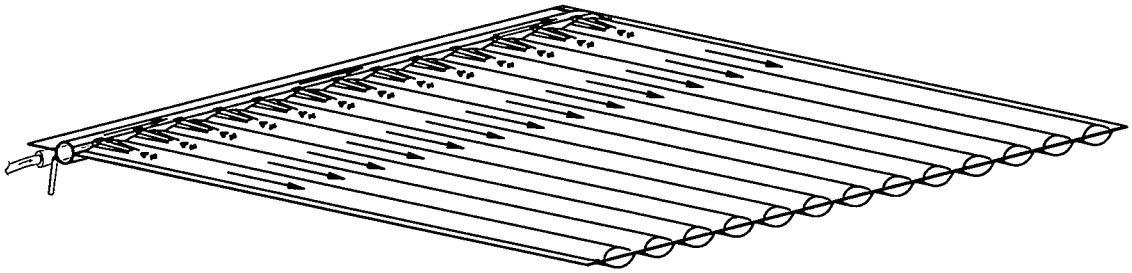
FIG.2 Prior Art
FIG. 2 illustrates a prior art regarding an inflation way for an air bag with one-way valve.

In other words, the output gas volume per unit time can be significantly increased through arranging elongated shaped inflating portion 321 of the inflation pipe 32 and vent hole 3214 thereof. Moreover, the elongated shape of the vent hole 3214 allows each air inlet channel 23 correspondingly in each air storing unit 13 to output gas, such that when air is output from the vent hole 3214, it can enter each of the air storing units 13 simultaneously so as to enhance the charge efficiency. According to the prior art, as FIG. 2 illustrates, for example, an inflation nozzle is put into an inflation inlet, while air reach different inflation chambers by various rates during the inflation process. As a result, there can be squeezing and bending occur between adjacent inflation chambers and further influence the synchronization of the inflation among these inflation chambers, which makes the inflation efficiency worse and cause some inflation chamber fail to attain the required air pressure.

The clamping device 33 is mounted on the bracket 31 for clamping the two sides of the inflation unit 15 of the air cushion body 10 to be inflated in the inflation process, so as to create an airtight inflatable cavity 155 through sealing the two sides of the inflation channel 153, such that air output from the vent hole 3214 will not leak from the air cushion body 10, but enter the air inlet channel 23 formed by the valve films 21 and 22 of the inflation valve 20. Then the inflation process can be conducted for each of the air storing units 13.

More specifically, the clamping device 33 comprises two movable clamping units 331 and 332 and a clamping power source 333. According to the embodiment illustrated in FIG. 4, the two clamping units 331 and 332 can be arranged in an upright or vertical manner. In this embodiment, the first clamping unit 331 is the upper clamping unit, while the second clamping unit 332 is the lower clamping unit. The two clamping units 331 and 332 are spacedly arranged. The inflation pipe 32 is arranged between the two clamping units 331 and 332.

The two clamping units 331 and 332 may have identical structures and be symmetrically arranged toward the inflation pipe 32. Besides, the clamping units can be driven by the clamping power source 333 to move towards move towards each other when the inflation process is demanded. In the end of a cycle of inflation process, the clamping units can be driven by the clamping power source 333 to move from each other and return to the original positions thereof.

Correspondingly, the first clamping unit 331 comprises two first clamping portions 3311 and two first connecting portion 3312 extended between the two first clamping portions 3311. According to this preferred embodiment of the present invention, the two first clamping portions 3311 have the same structure and are respectively protrudingly extended toward the outer side of the first connecting portion 3312. A first clamping surface 3313 and a first clamping groove 3314 are respectively formed on the bottom side of each first clamping portion 3311.

Correspondingly, the second clamping unit 332 comprises two second clamping portions 3321 and two second connecting portions 3322 extended between the two second clamping portions 3321. According to this preferred embodiment of the present invention, the two second clamping portion 3321 have the same structure and are respectively protrudingly extended toward the outer side of the second connecting portion 3322. A second clamping surface 3323 and a second clamping groove 3324 are respectively formed on the top side of each second clamping portion 3321.

According to the embodiment illustrated in the drawings, the first clamping portion 3311 on the left side of the first clamping unit 331 and the second clamping portion 3321 on the left side of the second clamping unit 332 are coupled with each other so as to serve to seal the opening 154 on the left side of the inflation channel 153 of the air cushion body 10. Correspondingly, the first clamping portion 3311 on the right side of the first clamping unit 331 and the second clamping portion 3321 on the right side of the second clamping unit 332 are coupled with each other so as to serve to seal the opening 154 on the right side of the inflation channel 153 of the air cushion body 10.

The first connecting portion 3312 and the second connecting portion 3322 respectively have a contact hole 3315 and 3325 in the middle portion thereof. The clamping power source 333 comprises two clamping air cylinders 3331 and two driving portions 3332 respectively connected with the clamping air cylinders 3331. The driving portions 3332 move up and down in the perpendicularly arranged chutes 3333 under the drive of the clamping air cylinders 3331. Also, an end of each of the driving portions 3332 is connected with the clamping air cylinders 3331 respectively, while the other end thereof is mounted in the contact holes 3315 and 3325 respectively. Hence, when the clamping air cylinders 3331 are in operation, they will drive the driving portions 3332 to move, so as to further drive the first connecting portion 3312 and the second connecting portion 3322 to move, which will drive the first clamping portion 3311 and the second clamping portion 3321 to move, such that a clamping operation can be conducted.

More specifically, according to this preferred embodiment of the present invention, the two clamping air cylinders 3331 output the power through the clamping air cylinders respectively. Also, the clamping air cylinder 3331 is connected with the air supply device 40 to obtain air pressure supply, such that the clamping air cylinder can be pushed to function, which detail will be further specified as follows. Person skilled in the art should be able to understand that the above mentioned way of providing power source can also be substituted by other ways.

Therefore, in a cycle of inflation, when the first clamping air cylinder 3331 on the upper side operates, it will drive the first driving portion 3332 to shift downward in the chute 3333 from the upper side and thus drive the first connecting portion 3312 to shift downward, such that the two first clamping portions 3311 will move downward respectively. Meanwhile, when the second clamping air cylinder 3331 on the lower side operates, it will drive the second driving portion 3332 to shift upward in the chute 3333 from the lower side and thus drive the second connecting portion 3322 to shift upward, such that the two second clamping portions 3321 will move upward respectively, so as to press against the two first clamping portions 3311 respectively. That is to say, the first clamping surface 3313 and the second clamping surface 3323 will press against each other, such that the two sides of the inflation channel 153 of the inflation unit 15 of the air cushion body 10 to be inflated will be clamped to seal between the first clamping surface 3313 and the second clamping surface 3323. Besides, the first clamping groove 3314 and the second clamping groove 3324 form an entire clamping groove, so as to accommodate the distal end portion 3212 of the inflating portion 321 of the inflation pipe 32.

Figure 6:
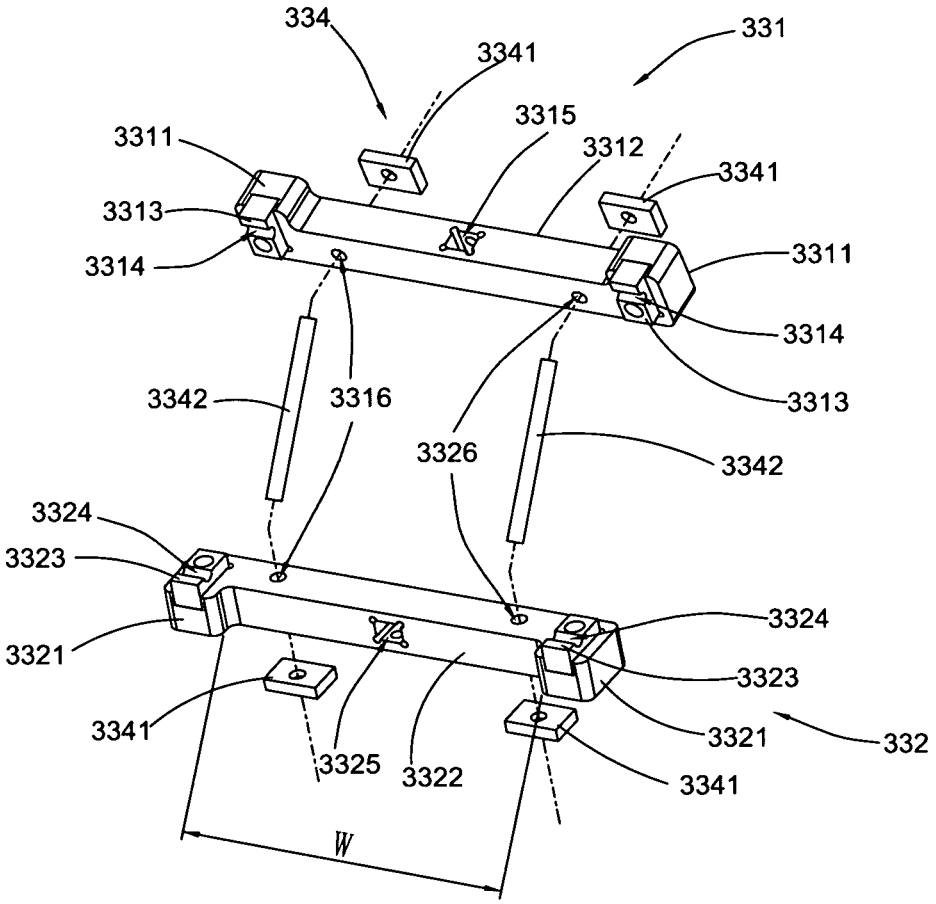
FIG. 6 is an exploded view of the clamping device of the inflation apparatus for the air cushion body according to the above preferred embodiment of the present invention.

Referring to FIG. 6, the section of the distal end portion 3212 of the inflation pipe 32 is substantially circular, while the sections of the first clamping groove 3314 and the second clamping groove 3324 are substantially semicircular. Therefore, when the two clamping units 331 and 332 move close to each other from the upper and lower side respectively and eventually stop, the section of the whole clamping groove formed by the first clamping groove 3314 and the second clamping groove 3324 is substantially circular. In addition, the distal end portion 3212 of the inflation pipe 32 passes through the whole clamping groove, which is to be assembled with the first clamping groove 3314 and the second clamping groove 3324. The shape and size of the whole clamping groove matches the shape and size of the distal end portion 3212 of the inflation pipe 32.

In other words, the first clamping unit 331 and the second clamping unit 332 symmetrically arranged up and down. The positions of the first clamping portion 3311 and the second clamping portion 3321 are corresponding to each other. As a result, the first clamping surface 3313 of the first clamping unit 331 and the second clamping surface 3323 of the second clamping unit 332 are respectively tight pressed on the inflation end portions 151 and 152 of the two sides of the length direction of the inflation unit 15 of the air cushion body 10. Besides, the bottom wall formed by the first clamping portion 3311 and the second clamping portion 3321 renders the inflation end portions 151 and 152 to tightly attach on the distal end portion 3212 of the inflation pipe 32. In this manner, as the main portion 3211 of the inflating portion 321 of the inflation pipe 32 is placed into the inflation channel 153 of the inflation unit 15, the inflation inlet 154 of the two sides of the inflation channel 153 will be sealed off and under the clamping operation of the first clamping unit 331 and the second clamping unit 332 the inflation unit 15 forms the sealed inflatable cavity 155 therein. The main portion 3211 of the inflating portion 321 is in the inflatable cavity 155. Air output from the vent hole 3214 will enter the inflatable cavity 155 and further enter each of the air storage units 13.

When the air storing unit 13 of the air cushion body 10 required to be inflated is inflated to a predetermined air pressure, the two clamping air cylinders 3331 will respectively drive the corresponding driving portions 3332 to move from each other, so as to drive the first clamping portion 3311 and the second clamping portion 3321 of the two clamping units 331 and 332 to move away from each other to the original positions thereof respectively. Therefore, the two sides of the inflated air cushion body 10 are released and an inflation cycle is completed. Then, the clamping units 331 and 332 are ready for the inflation for the next air cushion body 10 of the continuous type air cushion body 100.

In other words, the clamping device 33 has a clamped state and an idle state. In the idle state the clamping device 33 is at the original condition, where the first clamping unit 331 and the second clamping unit 332 of the clamping device 33 are spacedly at resting positions. When a control command of starting an inflation process is received, the first clamping portion 3311 and the second clamping portion 3321 of the first clamping unit 331 and the second clamping unit 332 of the clamping device 33 will move towards move towards each other under the effect of the clamping power source 333, so as to shift from the idle state to the clamped state and to seal the two sides of the air cushion body 10 to be inflated. After the inflation process is finished, the first clamping portion 3311 and the second clamping portion 3321 will move from each other so as to shift from the clamped state to the idle state.

It is worth mentioning that the distance W between the two first clamping portions 3311, which equals to the distance between the two second clamping portions 3321, decides the allowable width for the continuous type air cushion body 100 to be inflated, or the width of the air cushion body 10. The air cushion body 10 may have only one air storing unit 13. That is to say, the width of the air storing unit 13 can be substantially smaller than the distance W between the two first clamping portions 3311, such that it is possible to inflate only one air storing unit 13 in an inflation process. Certainly, the air cushion body 10 may also have a plurality of the air storing units 13, such as 2-20 air storing units 13 for example, or more preferably, 5-15 air storing units 13. Besides, the width of each of the air storing units 13 can be arranged according to the needs.

The mounting plate body 3111 of the mounting plate 311 has a clamping device retaining slot 3113 formed thereon, which is extended along the vertical direction as the figure illustrated. The two driving portions 3332 respectively pass through the clamping device retaining slot 3113 and enter the contact holes 3315 and 3325 of the first connecting portion 3312 and the second connecting portion 3322. In this way, the two driving portions 3332 are movable in the clamping device retaining slot 3113. In other words, the two driving portions 3332 can reach the outer side of the mounting plate 311 from the inner side of the mounting plate 311 by passing through the clamping device retaining slot 3113. Therefore, the two clamping units 331 and 332 and the clamping air cylinders 3331 of the clamping power source 333 can be respectively arranged on the opposite sides of the mounting plate 311, wherein the clamping air cylinders 3331 can be installed in the box-like structure form by the bracket 31.

The clamping device 33 further comprises at least a holding unit 334 comprising two holding units 334. Each holding unit 334 comprises two holding blocks 3341' and two guide rods 3342 mounted between the two holding block 3341. The first clamping unit 331 and the second clamping unit 332 further respectively form the top-to-bottom through guide rod hole 3316 and 3326 on the first connecting portion 3312 and the second connecting portion 3322 for the guide rods 3342 to pass through respectively, such that the first clamping unit 331 and the second clamping unit 332 are positioned between the two holding blocks 3341, while the holding blocks 3341 are both affixed on the mounting plate 311 through connection mode like paired bolts and nuts, etc.

When the clamping device 33 is shifting between the clamped state and the idle state, the first connecting portion 3312 and the second connecting portion 3322 of the first clamping unit 331 and the second clamping unit 332 are respectively moving vertically along the two guide rods 3342, such that the two holding units 334 can further have a function of limiting and spacing to the first clamping unit 331 and the second clamping unit 332.

Referring to FIG. 4, the inflation apparatus 30 further comprises a splitting device 35. The splitting device 35 comprises a splitting tool 351 and a holding device 352. The holding device 352 is for mounting the splitting tool 351. According to this preferred embodiment, the splitting tool 351 is connected with the proximal end 3213 of the inflating portion 321 of the inflation pipe 32. Preferably, the splitting tool 351 is inclinedly connected with the proximal end 3213 of the inflating portion 321 of the inflation pipe 32 to form a sharp angle therebetween. Hence, when the inflated air cushion body 10 of the continuous type air cushion body 100 is transferred forward, the splitting tool 351 will split the inflation unit 15, such that the air cushion body 10 will not be obstructed by the mounting portion 322 of the inflation pipe 32, but keep moving forward.

The splitting tool 351 is arranged between the mounting portion 322 of the inflation pipe 32 and the clamping portions 3311 and 3321 at the right side of the clamping device 33, which means the clamping and inflation processes will be done first and then the inflation unit 15 of the air cushion body 10 will be split by the splitting tool 351 in the inflation technology. Thus, the splitting tool 351 will not affect the preceding inflation process. Preferably, the splitting tool 351 can split the inflation unit 15 along the fringe heat sealing seam 102 or the folding line 106A of the inflation unit 15 of the air cushion body 10 so as to make the separated inflation end portions 151 and 152, which means two free extremities that are not connected. The free inflation end portions 151 and 152 can then smoothly be moved forward along the inflation pipe 32 under the act of the conveyor 34 and eventually be detached from the inflation pipe 32.

The proximal end 3213 of the inflating portion 321 of the inflation pipe 32 has a tool mounting groove 3215 on the inner side thereof. A sharp edge 3511 of the splitting tool 351 is mounted in the tool mounting groove 3215 so as to ensure that it can split the inflation unit 15. The tool mounting groove 3215 is a locating groove, which will not cause leakage on the inflation pipe 32. Certainly, an end of the splitting tool 351 can also closely touch against the inner side of the proximal end 3213 of the inflating portion 321 according to other alternative mode. The splitting tool 351 may also be extended perpendicularly to the proximal end 3213 of the inflating portion 321. However, it is, preferably, extended in a tilting manner. That is, it is extended between the mounting portion 322 and the proximal end 3213 of the inflating portion 321, so as to split better.

Figure 7:
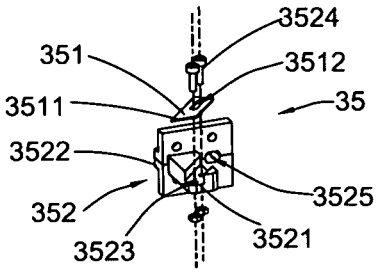
FIG. 7 is an exploded view of the splitting device of the inflation apparatus for the air cushion body according to the above preferred embodiment of the present invention.
Figure 8:
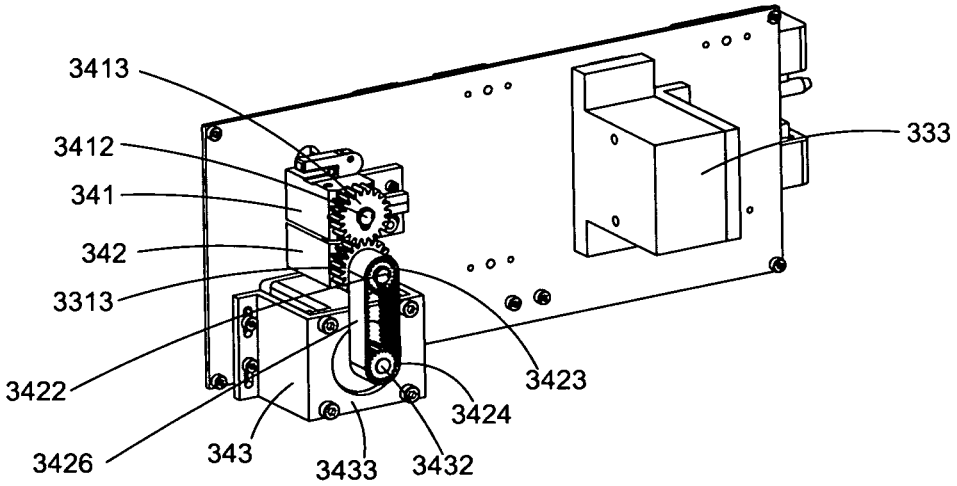
FIG. 8 is a perspective view of the back side of the conveyor of the inflation apparatus for the air cushion body according to the above preferred embodiment of the present invention.
Figure 9:
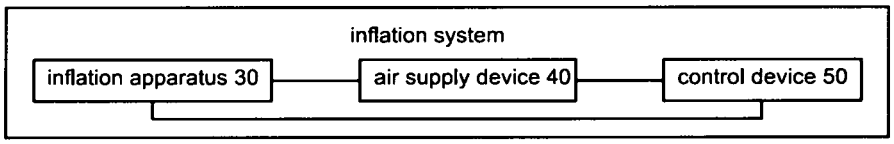
FIG. 9 is a perspective view of the inflation system for the air cushion body according to the above preferred embodiment of the present invention.
Figure 10:
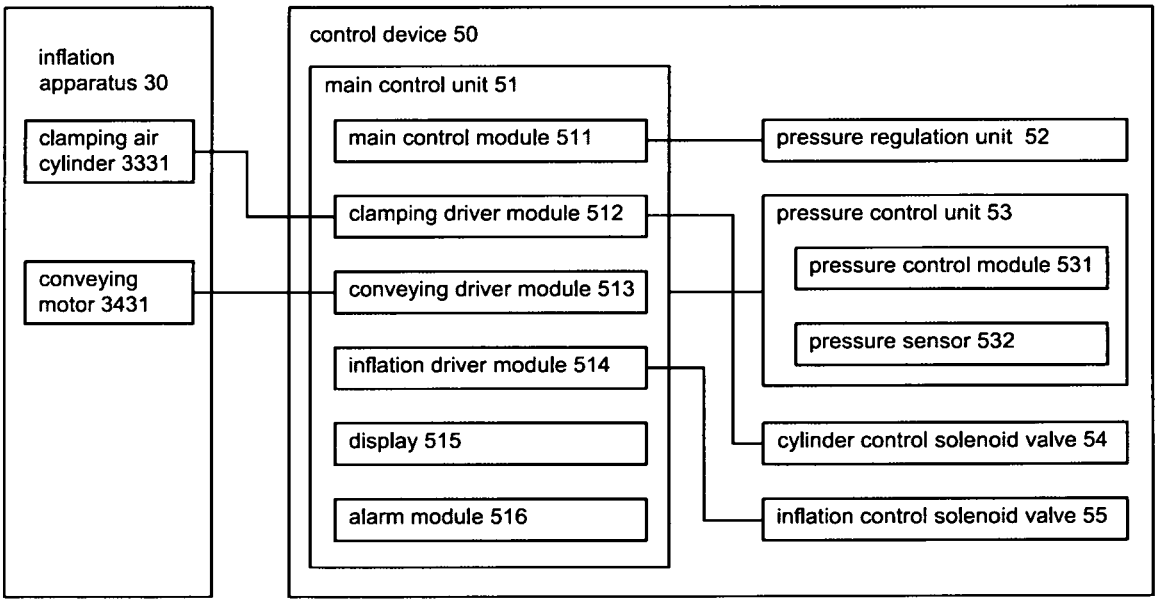
FIG. 10 is a perspective view of the control device the inflation system for the air cushion body according to the above preferred embodiment of the present invention.

Another end of the splitting tool 351 can be mounted on the mounting plate 311 of the bracket 31. According to this preferred embodiment, the holding device 352 is for mounting the splitting tool 351 so as to further stably affix the splitting tool 351. More specifically, the holding device 352 comprises a tool carrier 3521 and a holding body 3522. The tool carrier 3521 is for carrying the splitting tool 351. Referring to FIG. 7, the tool carrier 3521 has a tool carrying groove 3523 formed thereat. The splitting tool 351 is aligned on the tool carrying groove 3523. The splitting tool 351 further has a positional perforation 3512 formed thereon. The splitting tool 351 is secured on the tool carrier 3521 by a holding element 3524, such as a matched bolt and a nut or a rivet, etc., passing through the positional perforation 3512.

The tool carrier 3521 further passes through the inflation pipe mounting hole 3112. The holding body 3522 is connected with the tool carrier 3521 and arranged on the other side of the mounting plate 311. That is to say, the splitting tool 351 and the holding body 3522 are respectively on the opposite sides of the mounting plate 311, such that the holding body 3522 can serve the purpose of stabilizing the splitting tool 351. The middle portion of the holding body 3522 further has a mounting hole 3525 formed thereon. An end of the mounting portion 322 of the inflation pipe 32 can penetrate into the mounting hole 3525.

Referring to FIG. 4, the inflation apparatus 30 further comprises the conveyor 34 mounted on the mounting plate 311 and provided on the right side of the clamping units 331 and 332 for conveying the continuous type air cushion body forward. More specifically, the conveyor 34 comprises two conveying unit 341 and 342 and a conveying power source 343. After the continuous type air cushion body 100 is inflated, the inflation end portions 151 and 152 of the split inflation unit 15 are affected by the two conveying units 341 and 342. Therefore, the previous inflated air cushion body 10 can move forward due to the action of the conveying units 341 and 342 and further bring another subsequent air cushion body 10 to the inflation position, which is the position between the two clamping portions of the clamping unit, so as to be ready for the next inflation session. By so, the inflation apparatus 30 of the present invention can continuously and automatically inflate the continuous type air cushion bodies 100.

More specifically, the first conveying unit 341 comprises a first conveying gear 3411, a first connecting shaft 3412, and a first driving gear 3413, wherein the first conveying gear 3411 and the first driving gear 3413 are respectively at the two ends of the first connecting shaft 3412, such that the first connecting shaft 3412 is extended between the first conveying gear 3411 and the first driving gear 3413. The second conveying unit 342 comprises a second conveying gear 3421, a second connecting shaft 3422, and a second driving gear 3423, wherein the second conveying gear 3421 and the second driving gear 3423 are respectively provided at the two ends of the second connecting shaft 3422, such that the second connecting shaft 3422 is extended between the second conveying gear 3421 and the second driving gear 3423.

The first conveying gear 3411 and the second conveying gear 3421 are engaged with each other. The first driving gear 3413 and the second driving gear 3423 are engaged with each other. Thus, when the first driving gear 3413 and the second driving gear 3423 are engaged and rotate with each other, the first driving gear 3413 transmits driving force through the first connecting shaft 3412 to drive the first conveying gear 3411 to rotate and the second driving gear 3423 transmits driving force through the second connecting shaft 3422 to drive the second conveying gear 3421 to rotate, such that the engagement between the first conveying gear 3411 and the second conveying gear 3421 moves the inflation unit 15 of the continuous type air cushion body 100 forward.

More specifically, for example, the first conveying gear 3411 rotates counterclockwise and the second conveying gear 3421 rotates clockwise, so as to generate forward driving force to drive the inflation unit 15 of the continuous type air cushion body 100 to move forward.

According to this embodiment of the present invention, the conveying power source 343 can comprise a conveying motor 3431, an output shaft 3432, and mounting bracket 3433. The conveying motor 3431 is mounted on the mounting bracket 3433. The mounting bracket 3433 is mounted on the mounting plate 311. The motor 3431 provides a rotary driving force, which will be transmitted to the first conveying unit 341 and the second conveying unit 342 so as to drive the continuous type air cushion body 100 to move forward. More specifically, the second conveying unit 342 further comprises a first roller 3424, a second roller 3425, and a transmission belt 3426. The first roller 3424 is mounted on the output shaft 2432 of the conveying power source 343. The second roller 3425 is mounted on the second connecting shaft 3422. The transmission belt 3426 rolls around the first roller 3424 and the second roller 3425. Therefore, when the conveying motor 3431 operates to drive and rotate the output shaft 2432, the first roller 3424 will be driven to rotate by the output shaft 2432, so as to further drive the second roller 3425 to rotate through the transmission belt 3426 and drive the second connecting shaft 3422 to rotate, such that the second driving gear 3423 can be driven to rotate so as to bring the first driving gear 3413 engaged with the second driving gear 3423 to rotate, which eventually brings the first conveying gear 3411 and the second conveying gear 3421 to rotate in opposite directions.

Person skilled in the art should be able to understand that the structure of the conveyor 34 is just an example rather than limit to the present invention. That is, person skilled in the art may come up with other structures that are able to drive the continuous type air cushion body 100 to move forward according to his needs.

It is worth mentioning that by the time the next air cushion body 10 has finished its inflation, the inflation unit 15 of the previous air cushion body 10 is at the middle of the two conveying gears 3411 and 3421, so when the inflation unit 15 of the next air cushion body 10 is not clamped well by the clamping device 33, it will shrink. However, because of the limiting and spacing caused by the two conveying gears 3411 and 3421 to the inflation unit 15 of the previous air cushion body 10, the overall shrinkage of the continuous type air cushion body 100 can be reduced.

In addition, referring to FIG. 4, the mounting plate 311 further forms two connecting shaft spacing holes 3114. The first connecting shaft 3412 and the second connecting shaft 3422 respectively penetrate into the two connecting shaft spacing hole 3114, such that the first and second conveying gear 3411 and 3421 and the first and second driving gears 3413 and 3423 are respectively arranged on the opposite side of the mounting plate, wherein the conveying power source 343 is also arranged on the inner side of the mounting plate.

It follows that in an inflation cycle, the continuous type air cushion body 100 is sleeved and arranged on the inflating portion 321 of the inflation pipe 32, so as to let the inflating portion 321 be placed in the inflation channel 153 of the inflation unit 15. The conveyor 34 is for driving the air cushion body 10 of the continuous type air cushion body 100 that is to be inflated to move to the inflation position, which is the position between the two clamping portions of the clamping device 33. Then the clamping device 33 may shift from the idle state to the clamped state to seal the two sides of the inflation channel 153 of the inflation unit 15 of the air cushion body 100. Besides, the air supply device 40 and the inflation pipe 32 are connected and communicated, such that the inflation pipe 32 can inflate the air cushion body 10. After the inflation is finished, the clamping device 33 will shift from the clamped state to the idle state. The conveyor 34 will drive the continuous type air cushion body 100 to move forward, so as to have the inflated air cushion body 10 leave the inflation position until the next air cushion body 10 moves into the inflation position.

Person skilled in the art should be able to understand that the inflation apparatus 30 according to the present invention may also inflate independent and separate air cushion bodies 10 one by one. Specifically, the inflation unit 15 of an independent air cushion body 10 can be sleeved and arranged on the inflating portion 321 of the inflation pipe 32. Then the subsequent clamping and inflation processes will be conducted. After the inflation, the inflated air cushion body 10 can be taken off from the opposite direction of how it has been arranged along the inflating portion 321 of the inflation pipe 32. In this embodiment, the air cushion body 10 may also have an opening 154 on a side thereof, while have the other side sealed. That is, when the apparatus inflates independent air cushion bodies 10 one by one, it will not have to split the inflation unit 15 of the air cushion body 10, but to have it taken off from the opposite direction after inflation.

The following will further describe the inflation system according to this preferred embodiment of the present invention, wherein the control device 50 is the core of the system for controlling the steps of clamping, blowing, loosening, conveying, and etc. of the inflation apparatus 30. More specifically, the control device 50 comprises a main control unit 51, a pressure regulation unit 52, a pressure control unit 53, an air cylinder controlling switches that can be embodied as a cylinder control solenoid valve 54, and an inflation controlling switch that can be embodied as an inflation control solenoid valve 55.

The main control unit 51 is the control center of the control device 50. The pressure regulation unit 52 is to control the air pressure provided by the air supply device 40 so as to maintain the air pressure within a predetermined range, which, if applicable, is around 0.2 MPa. The pressure control unit 53 is for detecting if the air pressure that the inflation apparatus 30 provided to each air storing unit 13 of the air cushion body 10 has attained the predetermined desired value. For example, according to this embodiment, the pressure control unit 53 can comprise a pressure control module 531 and a pressure sensor 532. When the pressure sensor 532 detected that air pressure in the pipeline connected with the inflation pipe 32 has reached around 0.1 Mpa, the pressure control module 531 will determine that the inflation is completed and send a message of inflation completion to the main control unit 51. It is understandable that the pressure control module 531 may also be integrated in the main control unit 51. The cylinder control solenoid valve 54 is for controlling whether there is air supply to the clamping air cylinder 3331. The inflation control solenoid valve 55 is to open or close the pipeline of the air supply device 40 connected into the inflation pipe 32 of the inflation apparatus 30 so as to start or stop the inflation process. It is worth mentioning that the specific values, such as 0.2 Mpa and 0.1 Mpa, are just examples, rather than limits to the scope of the present invention.

Figure 11:
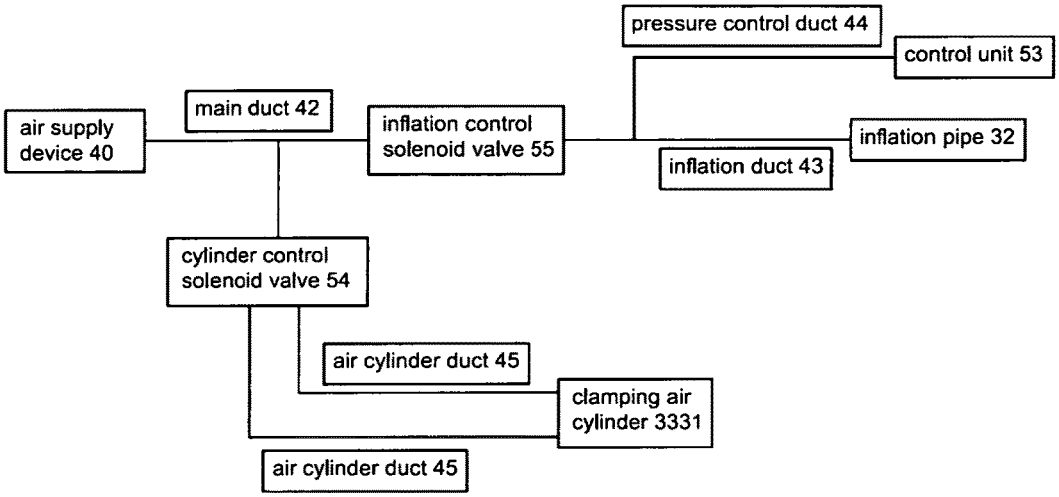
FIG. 11 is a perspective view illustrating air pipeline arrangement of the inflation system for the air cushion body according to the above preferred embodiment of the present invention.
Figure 12:
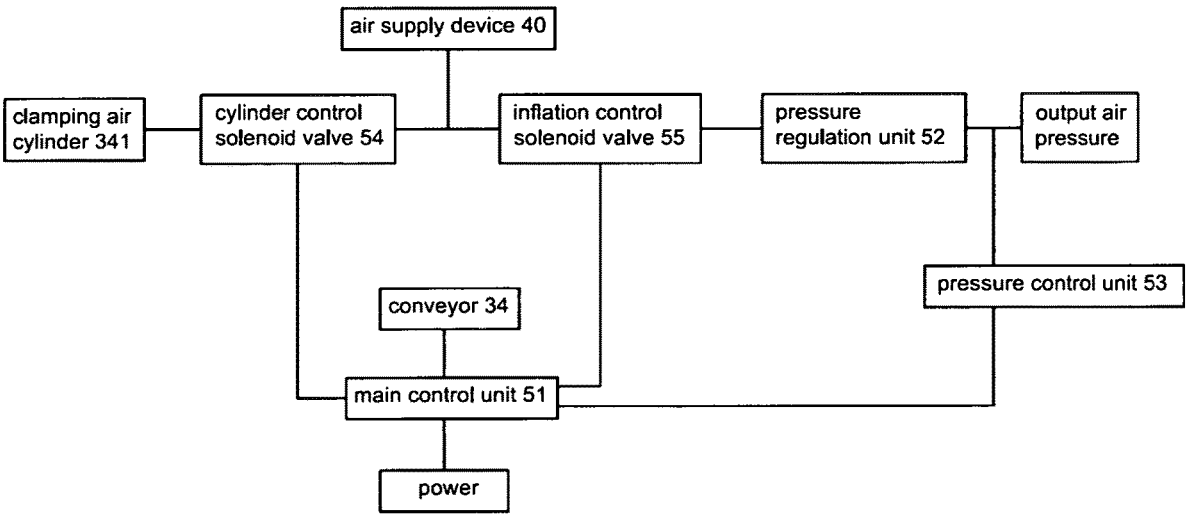
FIG. 12 is a perspective view illustrating circuit arrangement of the inflation system for the air cushion body according to the above preferred embodiment of the present invention.
Figure 13:
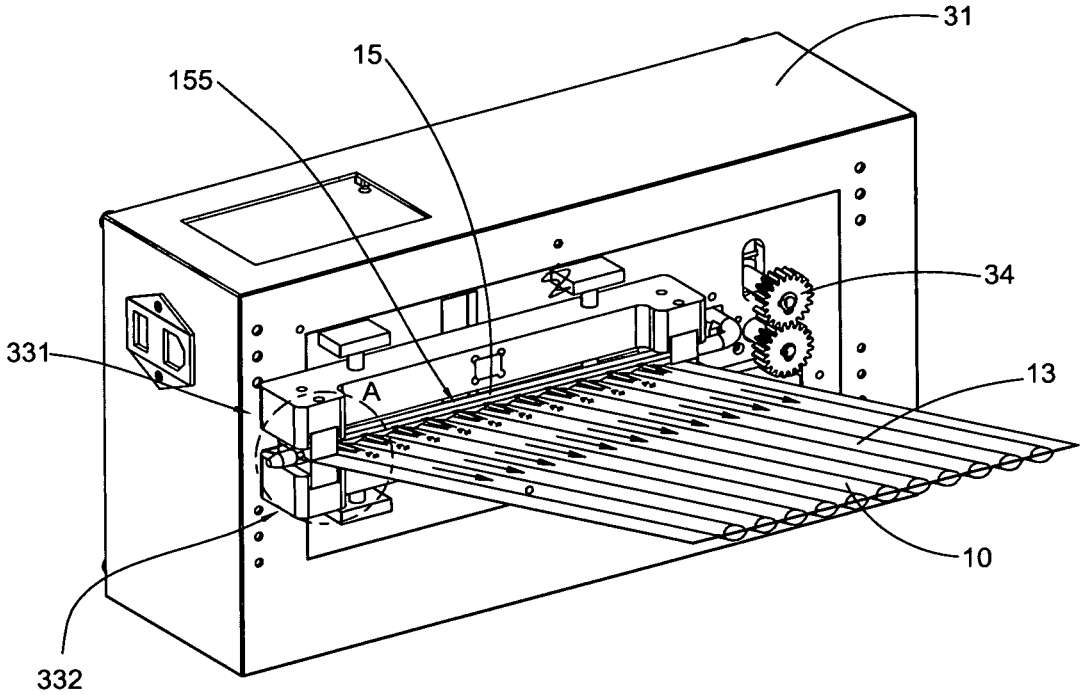
FIG. 13 is a perspective view illustrating the air cushion body being inflated on the inflation apparatus according to the above preferred embodiment previous the present invention.
Figure 14:
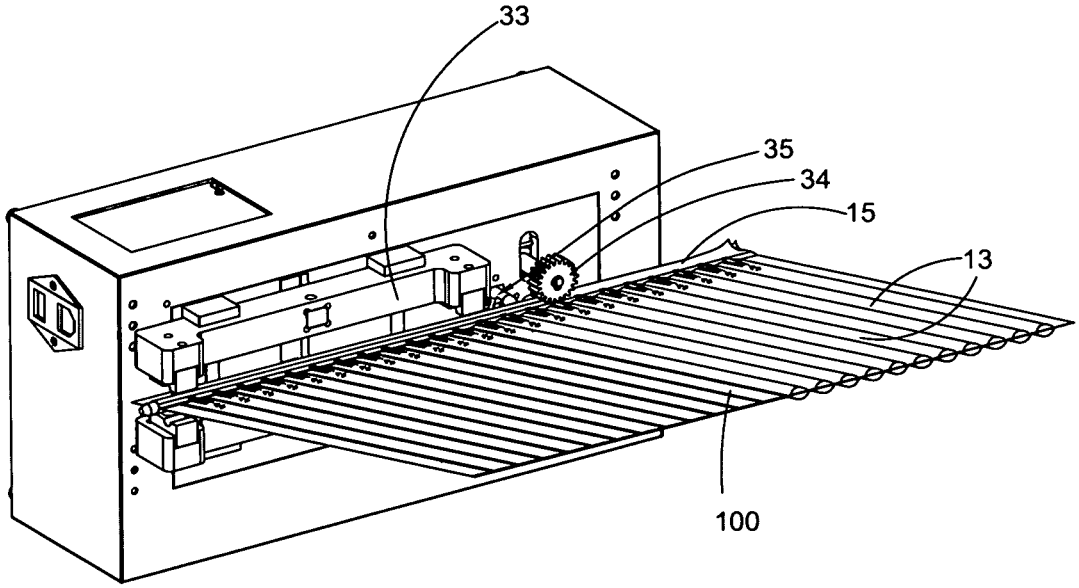
FIG. 14 is a perspective view illustrating the air cushion body being moved forward on the inflation apparatus according to the above preferred embodiment previous the present invention.
Figure 15:
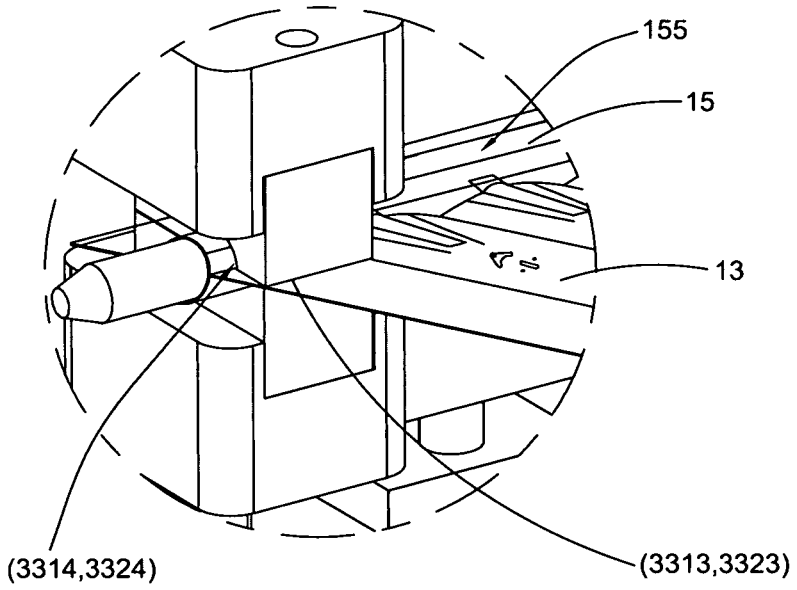
FIG. 15 is a partially enlarged view illustrating the inflation end portions of the air cushion body being clamped on the inflation apparatus according to the above preferred embodiment previous the present invention.

FIG. 11 illustrates the air pipeline arrangement of the inflation system according to the present invention. Specifically, the air supply device 40 is for providing high pressure gas, which may comprise an electric air pump 41 and gas pipelines comprising a main passage 42, an inflation duct 43, a pressure control duct 44, and two air cylinder ducts 45. When the electric air pump 41 is power on, it can operate to generate high pressure gas. As the high pressure gas enters the main passage 42, it can further be utilized for inflation or driving the clamping air cylinder of the clamping device 33. Person skilled in the art should be able to understand that according to other feasible alternative mode, the air supply device 40 can also be embodied as a high pressure gas storage device storing compressed gas for subsequent inflation process.

More specifically, the inflation pipe 32 of the inflation apparatus 30 is connected with the main passage 42 through the inflation duct 43. Gas provided by the air supply device 40 is further regulated through the pressure regulation unit 52 in, for example, about 0.2 Mpa and sent to the inflation pipe 32 of the inflation apparatus 30 via the inflation duct 43, which forms an inflation pipeline structure. The inflation control solenoid valve 55 on the pipeline structure can be opened or closed to start or stop the inflation process.

A branch, which is the pressure control duct 44, is further diverged from the inflation duct 43 to be connected with the pressure control unit 53 so as to connect the air pressure of the pipeline of the inflation pipe 32 to the pressure control duct 44. If the air pressure attains 0.1 Mpa, it means that the air pressure in each of the air storage units 13 of the air cushion body 10 attains 0.1 Mpa. Therefore, it can send the detected air pressure value or a command of stopping inflation to the main control unit 51.

The two air cylinder ducts 45 are further connected with the main passage 42 so as to provide air supply to the two clamping air cylinders 3331. Besides, the opening and closing of the cylinder control solenoid valve 54 controls the operations of the two clamping air cylinders 3331, which can drive the first and second clamping portion 3311 and 3321 of the first and second clamping unit 331 and 332 of the clamping device 33 to switch between the clamped state and the idle state.

The main control unit 51 comprises a main control module 511 and a clamping driver module 512, a conveying driver module 513, an inflation driver module 514, and a display 515 that are operatively connected with the main control module 511. The main control module 511 is embodied as a processor for receiving and processing information as well as sending out control commands. The clamping driver module 512 is operatively connected with the cylinder control solenoid valve 54, such that when the clamping driver module 512 receives a control command of starting or stopping the clamping device 33 from the main control module 511, the clamping driver module 512 can send a control command to the cylinder control solenoid valve 54 to open or close the cylinder control solenoid valve 54 so as to correspondingly actuate a clamping or loosening operation. The conveying driver module 513 is operatively connected with the conveying motor 3431 of the conveyor 34, such that when the conveying driver module 513 receives a control command of starting or stopping the conveyor 34 from the main control module 511, the conveying driver module 513 can send a control command to the conveying motor 3431 to switch on or off the conveying motor 3431 so as to correspondingly actuate or terminate the forward drive of the conveyor 34 to the continuous type air cushion body 100. The inflation driver module 514 correspondingly controls the opening and closing of the inflation control solenoid valve 55.

The display 515 is for displaying corresponding information, which includes the output air pressure value of the air supply device 40, the air pressure numeric value obtained by the pressure control unit 53 from the inflation pipeline structure, the conveying speed of the moving conveyor 34 driven by the conveying motor 3431, and etc. The display 515 may also provide a control interface, which comprises control buttons arranged thereon for the user to set up relevant parameters and control the operation of the entire inflation process.

Optionally, the main control unit 51 further comprises an alarm module 516. The alarm module 516 will send warning message to the main control module 511 to have the main control module 511 shut-down and stop the entire system, if certain incidents occur, including, for example, if the clamping device fails to clamp well or completely fails clamp on the inflation unit 15 of the air cushion body 10, rendering abnormal the air pressure value being obtained by the pressure control unit 53 from the inflation pipeline structure; if relevant solenoid valves 54 and 55 fail; if leakage occurs on pipelines of the air supply device 40 rendering the pressure regulation unit 52 fail to stabilize the air pressure; if the conveying motor 3431 of the conveyor 34 breaks down; and etc.

Figure 16:
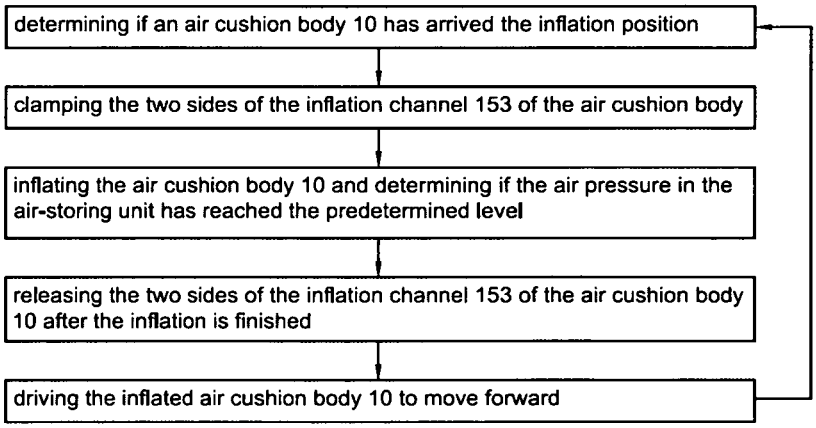
FIG. 16 is a flow diagram of the inflation method for the air cushion body according to the above preferred embodiment of the present invention.

In other words, FIG. 16 illustrates a typical inflation process according to the present invention. When it starts, it will first determine if the air cushion body 10 has reached the inflation position. If so, it will execute clamping and start the inflation process. After the inflation process has finished, it will determine if the inflated air pressure attained the requirement. If so, it will stop the inflation process and execute the loosening procedure and conveying procedure, including implementing the splitting operation of the inflation unit 15 and having the next air cushion body 10 to refill into the inflation position, so as to repeat the above procedures to continuously and automatically conduct the inflation process for a plurality of the air cushion body 10 of the continuous type air cushion body 100.

In other words, more specifically, according to the arrangement of the inflation system of the present invention, the entire control process of the inflation system can be like follows. When the entire system has been connected to an external power source, such as the public alternating current power supply network, the main control module 511 can send a command of starting clamping operation to the clamping driver module 512, such that the clamping driver module 512 will open the cylinder control solenoid valve 54 to have the pipelines between the main passage 42 of the air supply device 40 and the two air cylinder ducts 45 be communicatively connected. As a result, air provided by the air supply device 40 will respectively drive the two clamping air cylinders 3331 to function through the two air cylinder ducts 45, which drives the clamping portions 3311 and 3321 of the two clamping unit 331 and 332 to move to the predetermined positions of the clamped state by the drive of the driving portions 3332. Eventually the clamping portions 3311 and 3321 will press against each other to seal the two sides of the inflation channel 153 of the inflation unit 15 of the air cushion body 10 to be inflated, so as to create the sealed inflatable cavity 155. Then, the clamping driver module 512 will generate predetermined schedule according to its judgement on the two clamping air cylinder 3331. When the clamping portions 3311 and 3321 reach the clamped state, the clamping driver module 512 will close the cylinder control solenoid valve 54.

Afterward, the main control module 511 may send a control command of starting inflation to the inflation driver module 514 to open the inflation control solenoid valve 55, such that gas of the air supply device 40 will be allowed to enter the inflation pipe 32 through the main passage 42 and the inflation duct 43 and further be released from the vent hole 3214 of the inflating portion 321 of the inflation pipe 32 to enter the inflatable cavity 155 of the inflation unit 15. Then the gas will pass through each air inlet channel 23 formed by the valve films 21 and 22 to enter the corresponding air storage units 13.

Meanwhile, the pressure sensor 532 of the pressure control unit 53 will detect air pressure in the pipeline between the pressure control duct 44 and the inflation pipe 32. In this embodiment, if the detected air pressure value is, for example, around 0.1 Mpa, the main control module 511 will send a command of stopping inflation to the inflation driver module 514 so as to close the inflation control solenoid valve 55, such that gas of the air supply device 40 will stop entering the inflation pipe 32 through the inflation duct 43 of the main passage 42, which terminates the inflation process.

When it determines the completion of the inflation process, the main control module 511 will send out a control command for loosening the clamping device 33, such that the clamping driver module 512 will drive the two clamping air cylinders 3331 to move back to their original positions. Then, the two clamping portions 3311 and 3321 will move from each other and shift from the clamped state to the idle state.

Then after the clamping device 33 is returned into the idle state, the main control module 511 will send a control command of starting the conveyor 34, such that the conveying driver module 513 drives the conveying motor 3431 to function to drive the first conveying gear 3411 and the second conveying gear 3421 to rotate, so as to drive the split inflation unit 15 of the continuous type air cushion body 100 to move forward and lead the next air cushion body 10 to be inflated to the inflation position.

According to the description of the inflation system of the above preferred embodiment of the present invention, the present invention further provides an assembling method for the inflation system, wherein the inflation system is for continuously and automatically inflating a plurality of connected air cushion bodies 10 of the continuous type air cushion body 100. The method comprises the following steps.

The assembly steps of the inflation apparatus 30 include the following steps: assembling the inflation pipe 32 on the mounting plate 311' along the length direction of the mounting plate 311'; mounting the holding block 3341 of the top or bottom side of the clamping device 33 on the mounting plate 311'; mounting the guide rod 3342 on the holding block 3341 and respectively mounting the first clamping unit 331 and the second clamping unit 332 on the guide rod 3342; mounting the holding block 3341 of the bottom or top side on the guide rod 3342 and further affixing it on the mounting plate 311'; mounting the clamping power source 333 on the mounting plate 311 and allowing the two driving portions 3332 to pass through the clamping device retaining slot 3113 of the mounting plate 311 so as to be assembled at the contact holes 3315 and 3325 of the first clamping unit 331 and the second clamping unit 332; mounting the splitting tool 351 of the splitting device 35 on the tool carrier 3521 of the holding device 352 and affixing the holding body 3522 of the holding device 352 on the mounting plate 311; aslope connecting the splitting tool 351 to the proximal end 3213 of the inflating portion 321 of the inflation pipe 32; mounting the mounting bracket 3433 that has the conveying motor 3431 mounted thereon on the mounting bracket 3433; mounting the first roller 3424 on the output shaft 3432 connected with the conveying motor 3421; connecting the first and second connecting shaft 3412 and 3422 of the first and second conveying unit 341 and 342 with the first and second driving gear 3413 and 3423 and allowing the first and second connecting shaft 3412 and 3422 pass through the connecting shaft spacing hole 3114 of the mounting plate 311 to reach to the outer side of the mounting plate 311; mounting the first and second conveying gear 3411 and 3421 on the first and second connecting shaft 3412 and 3422 respectively; further mounting the second roller 3425 on the second connecting shaft 3422; connecting the first and second roller 3424 and 3426 with the transmission belt 3426.

The steps of assembling the control device 50 and wiring including: electrically connecting the pressure regulation unit 52, the pressure control unit 53, the cylinder control solenoid valve 54, and the inflation control solenoid valve 55 with the main control unit 51 through wires respectively and allowing the entire circuit to be connected with an external power source.

The process for assembling the air supply device 40 and arranging the pipelines includes a step of mounting the main passage 42 on the electric air pump 41 and branching a pipeline from the main passage 42 for inflating. Specifically, the pressure regulation unit 52 is installed at the main passage 42. Besides, the main passage 42 further connects the inflation control solenoid valve 55 and the inflation duct 43 and connects the inflation duct 43 with the inflation pipe 32 assembled on the mounting plate 311. The process further comprises steps of branching another branch from the inflation duct 43 to the pressure control unit 53 by the pressure control pipeline 44 and branching another branch from the inflation duct 43 for driving the clamping air cylinder 3331. Specifically, the cylinder control solenoid valve 34 is installed at this branch and the two air cylinder ducts 35 are respectively connected with two clamping air cylinders 3331 for driving two clamping units 331 and 332 respectively, so as to conduct the clamping and loosening operations.

Person skilled in the art should be able to understand that the specific assembly technology of the above assembly steps is just an example rather than limit to the present invention. In addition, some of the orders of the steps may be changed.

Figure 17:
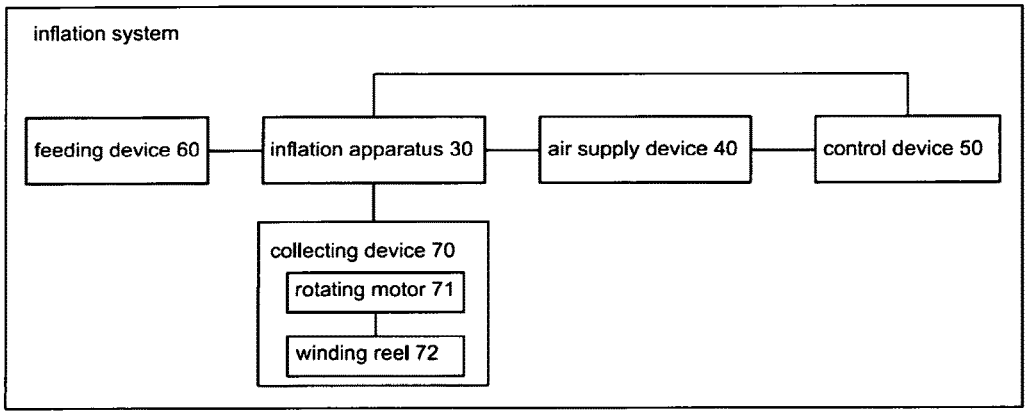
FIG. 17 is a perspective view of the inflation system for the air cushion body according to an alternative mode of the above preferred embodiment of the present invention.
Figure 18:
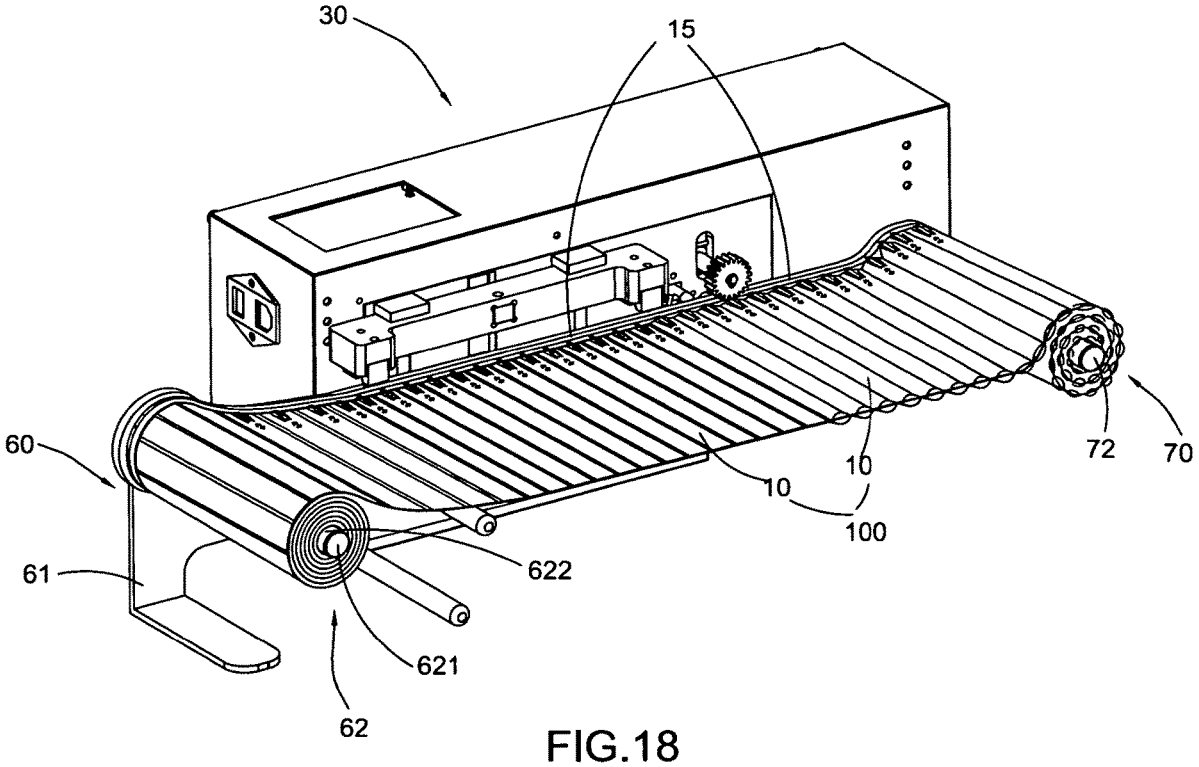
FIG. 18 is a 3D perspective view of the inflation system for the air cushion body according to an alternative mode of the above preferred embodiment of the present invention.

Referring to FIGS. 17-18, according to another enhanced alternative mode, the inflation system further comprises a feeding device 60 and a collecting device 70. These devices can respectively be independent parts or be integrally formed with the inflation apparatus. The feeding device 60 is for mounting the continuous type air cushion body 100 so as for continuously providing air cushion bodies 10 to be inflated to the inflation apparatus 30. On the other hand, the collecting device 70 is for collecting and organizing the inflated air cushion bodies 10.

More specifically, according to the above embodiment, the feeding device 60 may comprise a feeding bracket 61 and a feeding unit 62 assembled on the feeding bracket 61. The feeding unit 62 comprises a stationary axle 621 and a reel 622 adapted for rotatably mounted on the stationary axle 621. The reel 622 is adapted for mounting an end of the continuous type air cushion body 100 and the continuous type air cushion body 100 is adapted for being rolled on the reel 622. Besides, the other end of the continuous type air cushion body 100 is guided to move forward to execute the continuous and automatic inflation process. The feeding bracket 61 can further integrally mounted on the bracket 31 of the inflation apparatus 30, so as to form an integral structure.

Person skilled in the art should be able to understand that the structure of the feeding device 60 is just an example rather than limit to the present invention. That is, the feeding device 60 may also be made into other structures, such as a structure like a storage box, wherein the continuous type air cushion body 100 may be stored in the storage box in a folded state and have an end pulled out from an opening of the storage box for being guided to moved forward and inflated in a continuous and automatic manner.

The collecting device 70, according to this preferred embodiment, can be embodied as a rolling up device, which may comprise a winding reel 72 driven by a rotating motor 71, which rolls the inflated air cushion bodies 10 for later use via rotation of the winding reel 72. Person skilled in the art should be able to understand that the structure of the collecting device 70 is just an example rather than limit to the present invention. That is, the collecting device 70 may also be made into other structures, such as a structure like a collecting box.

It is worth mentioning that according to another alternative mode, after the air cushion body 10 is inflated, the inflation system may further comprise a cutting device to cut down the inflated air cushion body 10 from the continuous type air cushion body 100, so as to be collected by the user. The cutting device may be a knife tool or means that utilizes other cutting ways, such as an energy flow cutter. It is understandable that in order for accurate cutting, it may further provide a visual scanning device for determining the quantity of the air cushion body 10 of the air storing unit 13 being cut at a time.

Figure 19:
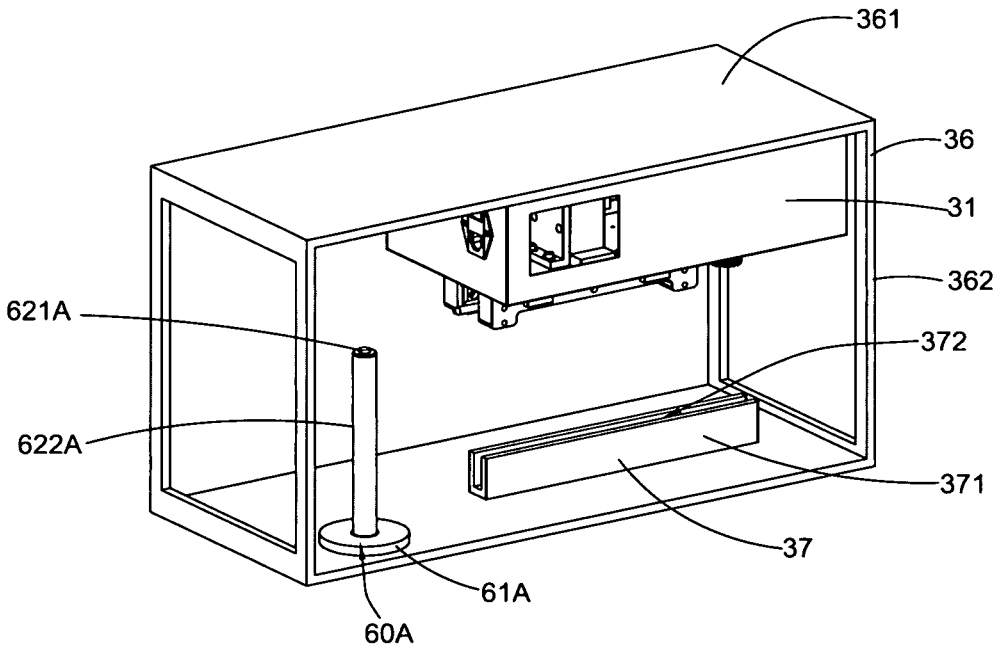
FIG. 19 is a perspective view of the inflation system for the air cushion body according to another alternative mode of the above preferred embodiment of the present invention.

Referring to FIG. 19, according to another alternative mode, the inflation apparatus 30 further comprises a hanging support 36, which comprises a support body 361 and a plurality of support legs 362. The support legs are utilized for standing on a surface of the environment, such as a ground and a tabletop. The support body 361 is to hangingly mount the bracket 31 so as to be suitable for keeping the continuous type air cushion body 100 be upright and be moved forward. In other words, it can further save the required space of the inflation system if driving the continuous type air cushion bodies 100 upright for the inflation process.

Referring to the drawings, the feeding bracket 61A of the feeding device 60A can be embodied as a support disk. The stationary axle 621A and the reel 622A of the feeding unit 62A are both vertically arranged. Correspondingly, the continuous type air cushion bodies 100 can substantially be reeled and rolled in an upright or vertical manner in the subsequent wrapping step.

In addition, the inflation apparatus 30 further comprises a guiding device 37 which comprises a guiding body 371 and a guiding groove 372 formed thereat. The continuous type air cushion body 100 has the air cushion body 10 to be inflated in the guiding groove 372 for being driven forward, such that the inner surface of the guiding body 371 limits and retains the air cushion body 10 during the inflation process, so as to prevent the air cushion body 10' from fleeing and tilting during the inflation, which further ensure the success and smooth of the inflation process.

Correspondingly, according to the above description, the inflation technology of the present invention includes a basis of inventive concept as follows. Namely, the present invention provides an inflation method for conducting an inflation process for an air cushion body 10. The air cushion body 10 comprises one or more air storing units 13 formed by two air cell films 11 and 12, an inflation valve 20 formed by at least two valve films 21 and 22, and an inflation unit 15 integrally connected with the one or more air storing units 13 and comprising two inflation end portions 151 and 152 overlapping with each other, wherein an inflation channel 153 is formed between the two inflation end portions 151 and 152. The method includes the following steps.

(a) configuring a vent hole 3214 of the inflation pipe 32 which is connected with the air supply device 40 in the inflation channel 153;

(b) closing the openings 154 at the two ends of the inflation channel 153 of the inflation unit 15 so as to form a sealed inflatable cavity 155;

(c) inflating the inflatable cavity 155 through the vent hole 3214, such that air enters each air storing unit 13 through each air inlet channel 23 formed between the valve films 21 and 22, so as to complete the inflation process; and (d) releasing the openings 154 of the two ends of the inflation channel 153 of the inflation unit 15, such that the air cushion body 10 is ready to be taken off from the inflation pipe 32, so as to obtain the air cushion body 10 that is inflated.

More specifically, in the step (a), the sealed distal end portion 3211 of the inflating portion 321 of the inflation pipe 32 enters the opening 154 of a side of the inflation channel 153 and leaves away from the opening 154 of another side thereof, such that the main portion 3211 of the inflating portion 321 will be remained in the inflation channel 153, which means the main portion 3211 of the inflating portion 321 is extended in the entire inflation channel 153 between the two inflation end portions 151 and 152 of the inflation unit 15.

In the step (a) and the step (d), the openings of the two ends of the inflation channel 153 are closed and released through the complementary clamping portions 3311 and 3321 of a clamping device 30.

The step (c) comprises the action of starting air supply of the air supply device 40 to the inflation pipe 32 through switching on the inflation control solenoid valve 55 in the pipeline between the air supply device 40 and the inflation pipe 32.

The step (c) further comprises the following step: detecting air pressure in the pressure control pipeline 44 connected with the inflation pipe 32 and switching off the inflation control solenoid valve 55 arranged in the pipeline between the air supply device 40 and the inflation pipe 32 to thereby stop the inflation process if the air pressure reached the predetermined air pressure, such as around 0.1 Mpa.

Preferably, the above method further comprises the following step:

(e) splitting the inflated inflation unit 15 of the air cushion body 10 and detaching the inflated air cushion body 10 from the inflation pipe 32 along the length direction of the inflating portion 321 of the inflation pipe 32;

A plurality of the air cushion bodies 10 is connected to form a continuous type air cushion body 100, where the continuous type of inflation units 15 of the continuous type air cushion body 100 comprise an inflation channel 153 formed to continuously communicate per two adjacent air cushion bodies 10. Then, the method further comprises the following step after the step (e).

(f) Drive the inflated air cushion body 10 of the continuous type air cushion body 100 to move forward, so as to allow another adjacent air cushion body 10 enter the inflation position and to continuously automatically inflate a plurality of air cushion bodies 10 of the continuous type air cushion body 100.

Further, in the step (f), the driving force can be provided by two conveying gears 3411 and 3421 which are driven by a motor and are applied on the splitted inflation end portions 151 and 152 of the inflation unit 15. Besides it also comprises the following step: the transfer rate and the transfer time of the two conveying gear 3411 and 3421 are obtained and utilized for determining if the next air cushion body 10 has entered the inflation position.

Subsequently, the above method may further comprise the following step: splitting the inflated air cushion body 10 from the continuous type air cushion body 100 or continuously wrapping the inflated air cushion bodies 10 together.

FIGS. 33-56 illustrates the inflation system for the air cushion body 10 according to a second preferred embodiment of the present invention. The inflation system of the present invention can continuously and automatically inflate the continuous type air cushion bodies 100. The inflation system comprises an inflation apparatus 30', an air supply device 40', and a control device 50'. The air cushion body 10' here is the same with the air cushion body 10 and its alternative modes according to the above embodiment, which will not be retold. The inflation apparatus 30' is for conducting the inflation process to the air cushion body 10'. The air supply device 40' is for providing filling gas to the inflation apparatus 30'. The control device 50' is for controlling the operation of the entire system. Specifically, the inflation apparatus 30' comprises a bracket 31', an inflation pipe 32' arranged on the bracket 31', a clamping device 33', a conveyor 34', and a splitting device 35'.

Figure 33:
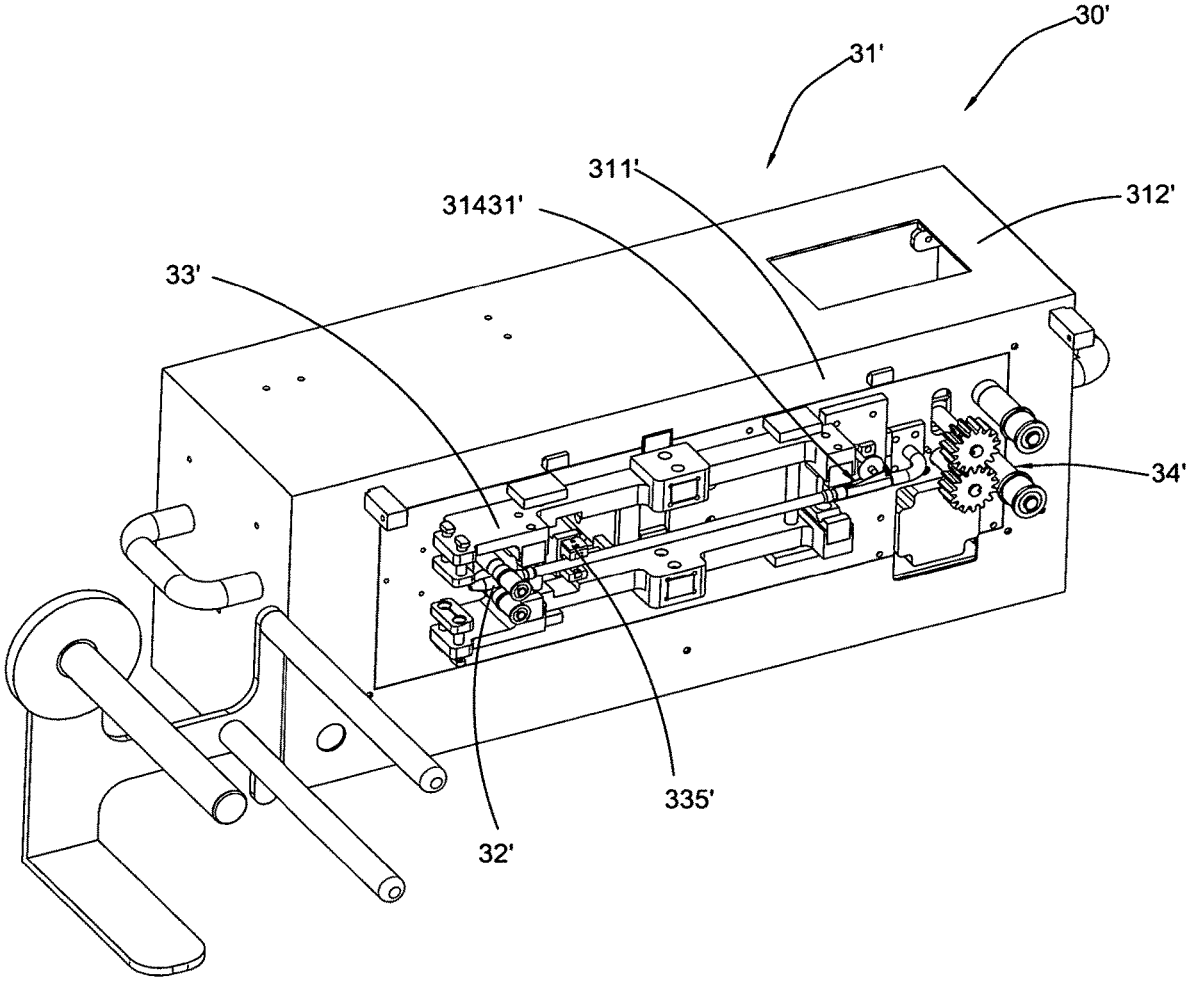
FIG. 33 is a 3D perspective view of the inflation apparatus for the air cushion body according to a second preferred embodiment of the present invention.
Figure 34:
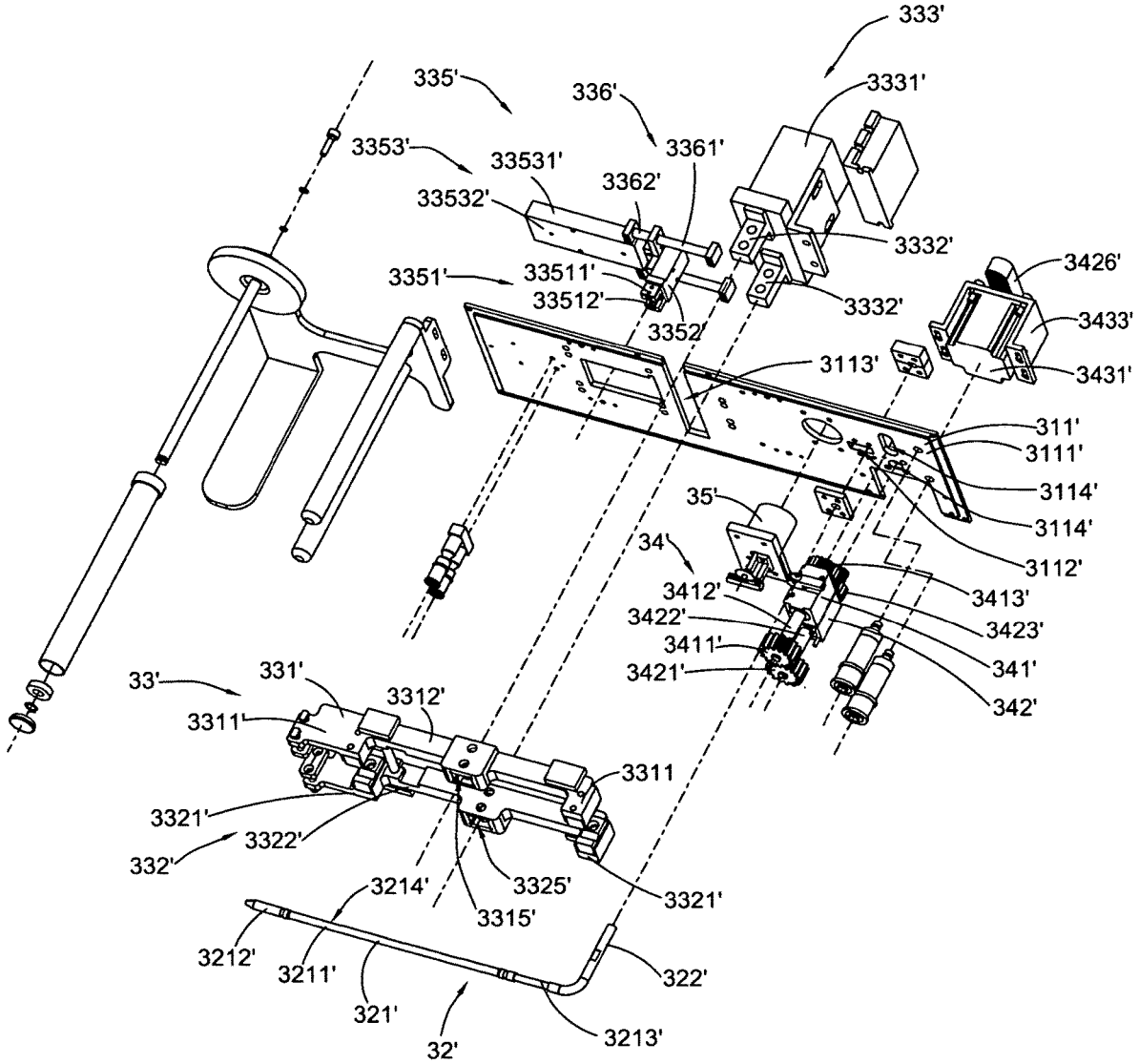
FIG. 34 is an exploded view of the inflation apparatus for the air cushion body assembled on the mounting plate of the bracket according to the above second preferred embodiment of the present invention.

More specifically, referring to FIGS. 33 and 34, the bracket 31' comprises a mounting plate 311', which, as embodied in the figures, can be a piece of mounting plate 311' arranged along the perpendicular direction for other parts to be mounted thereon. The bracket 31' further comprises other shell plates 312' as the drawing illustrated. The mounting plate 311' and the shell plates 312' can be assembled into a box-like structure, so as to protect internal structures. The apparatus in use can be placed on a surface of the environment, such as tabletop, ground, etc., or further be affixed on a tabletop, so as to prevent the bracket 31' from shaking during the inflation process.

Figure 35:
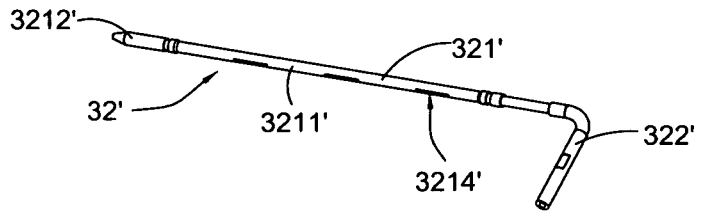
FIG. 35 is a perspective view of the inner side of the inflation pipe of the inflation apparatus for the air cushion body according to the above second preferred embodiment of the present invention.
Figure 36:
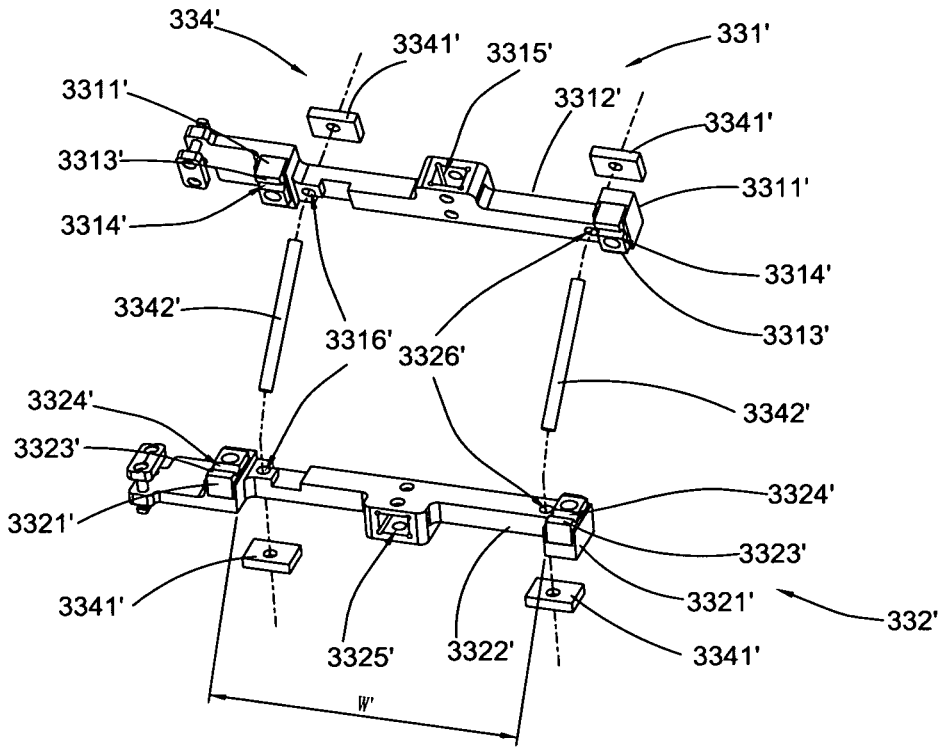
FIG. 36 is an exploded view of the clamping device of the inflation apparatus for the air cushion body according to the above second preferred embodiment of the present invention.

In the embodiment illustrated in FIG. 35, the inflation pipe 32' is an elongated shaped tubular component, which can be arranged along a horizontal direction and allow gas to be conveyed internally. Referring to FIG. 34, the inflation pipe 32' is extended along the length direction of the mounting plate 311' and comprises an inflating portion 321' and a mounting portion 322' both either integrally extended therefrom or assembled thereon. The mounting portion 322' is bent and extended from the inflating portion 321' for connecting with the air supply device 40' and receiving air supply. As the embodiment illustrated in FIG. 34, the mounting portion 322' is substantially perpendicularly extended from the inflating portion 321', which forms a substantial right angle at the junction. In other words, referring to FIG. 35, the inflation pipe 32' is substantially L-shaped. Person skilled in the art should be able to understand that the inflating portion 321' and the mounting portion 322' can also be bent in a sharp angle or obtuse angle. In this way, the inflating portion 321' and the mounting plate 311' are spaced and substantially arranged in a parallel manner.

According to this preferred embodiment of the present invention, the inflation pipe 32 is a rigid structure, which, for example, can be made of metal material. The inflation pipe 32' can further be communicatively connected with the air supply device 40' through other rigid or soft tube, such that the inflating portion 321' of the inflation pipe 32' can conduct inflation process to the air cushion body 10'.

Further, the mounting portion 322' is mounted in position through the mounting plate 311'. Referring to FIG. 34, the mounting plate 311' comprises a mounting plate body 3111' and an inflation pipe mounting hole 3112' formed internally. The mounting portion 322' of the inflation pipe 32' passes through the inflation pipe mounting hole 3112' to enter the box-like structure formed by the bracket 31'.

The inflating portion 321' comprises a main portion 3211' as well as a distal end portion 3212' and a proximal end portion 3213' on the two sides of the main portion 3211' respectively. The distal end portion 3212' is sealed off. The proximal end portion 3213' is connected on the mounting portion 322'. An elongated shaped vent hole 3214' is formed in the main portion 3211' along the length direction thereof, such that gas from the air supply device 40' can only enter the air cushion bodies 10' from the vent hole 3214'.

Person skilled in the art should be able to understand that though the elongated-shaped vent hole 3214' is in a linear narrow gap shape in the embodiment illustrated in the drawings, it may also be embodied as other shapes. According to other feasible embodiment, the main portion 3211' may have a plurality of spaced vent holes along the length direction thereof.

According to this preferred embodiment of the present invention, the elongated shaped vent hole 3214' can be arranged on the top of the main portion 3211' of the inflating portion 321' of the inflation pipe 32', such that air can be upwardly emitted from the vent hole 3214' in the inflation process. In real cases of practice, it may also be arranged on the bottom thereof so that air can be released downwardly from the vent hole 3214' or arranged on the front side or back side thereof so that air can be released forwardly or backwardly from the vent hole 3214'.

In other words, according to this embodiment of the present invention, the vent hole 3214' can be formed on a side, rather than an end, of the inflating portion 321'. According to the prior art illustrated FIG. 2, the air outlet of the inflation nozzle is at the end and the inflation nozzle is arranged in the inflation inlet of the air packaging material that air can only enter the air packaging material through the inflation inlet of the end.

In an inflation process, the main portion 3211' of the inflating portion 321' of the inflation pipe 32' is extended between the inflation end portions 151' and 152' of the inflation unit 15' of the air cushion body 10', such that air released from the vent hole 3214' will enter the inflation channel 153' of the inflation unit 15' and then enter each of the air storing units 13'. Because the elongated shaped vent hole 3214' can be extended along the entire inflation channel 153', air output from the vent hole 3214' can therefore enter each of the air storing units 13' substantially at the same time.

In other words, the output gas volume per unit time can be significantly increased through arranging elongated shaped inflating portion 321' of the inflation pipe 32' and vent hole 3214' thereof. Moreover, the elongated shape of the vent hole 3214' allows each air inlet channel 23' correspondingly in each air storing unit 13' to output gas, such that when air is output from the vent hole 3214', it can enter each of the air storing units 13' simultaneously so as to enhance the charge efficiency. According to the prior art, as FIG. 2 illustrated for example, an inflation nozzle is put into an inflation inlet, while air reach different inflation chambers by various rates during the inflation process. As a result, there can be squeezing and bending occur between adjacent inflation chambers and further influence the synchronization of the inflation among these inflation chambers, which makes the inflation efficiency worse and cause some inflation chamber fail to attain the required air pressure.

The clamping device 33' is mounted on the bracket 31' for clamping the two sides of the inflation unit 15' of the air cushion body 10' to be inflated in the inflation process, so as to create an airtight inflatable cavity 155' through sealing the two sides of the inflation channel 153', such that air output from the vent hole 3214' will not leak from the air cushion body 10', but enter the air inlet channel 23' formed by the valve films 21' and 22' of the inflation valve 20'. Then the inflation process can be conducted for each of the air storing units 13'.

More specifically, the clamping device 33' comprises two movable clamping units 331' and 332' and a clamping power source 333'. According to the embodiment illustrated in FIG. 34, the two clamping units 331' and 332' can be arranged in an upright or vertical manner. In this embodiment, the first clamping unit 331' is the upper clamping unit, while the second clamping unit 332' is the lower clamping unit. The two clamping units 331' and 332' are spacedly arranged. The inflation pipe 32' is arranged between the two clamping units 331' and 332'.

The two clamping units 331' and 332' may have identical structures and be symmetrically arranged toward the inflation pipe 32'. Besides, the clamping units can be driven by the clamping power source 333' to move towards move towards each other when the inflation process is demanded. In the end of a cycle of inflation process, the clamping units can be driven by the clamping power source 333' to move from each other and return to the original positions thereof.

Correspondingly, the first clamping unit 331' comprises two first clamping portions 3311' and two first connecting portion 3312' extended between the two first clamping portion 3311'. According to this preferred embodiment of the present invention, the two first clamping portions 3311' have the same structure and are respectively protrudingly extended toward the outer side of the first connecting portion 3312'. A first clamping surface 3313' and a first clamping groove 3314' are respectively formed on the bottom side of each first clamping portion 3311'.

Correspondingly, the second clamping unit 332' comprises two second clamping portions 3321' and two second connecting portions 3322' extended between the two second clamping portions 3321'. According to this preferred embodiment of the present invention, the two second clamping portion 3321' have the same structure and are respectively protrudingly extended toward the outer side of the second connecting portion 3322'. A second clamping surface 3323' and a second clamping groove 3324' are respectively formed on the top side of each second clamping portion 3321'.

According to the embodiment illustrated in the figure, the first clamping portion 3311' on the left side of the first clamping unit 331' and the second clamping portion 3321' on the left side of the second clamping unit 332' are coupled with each other so as to serve to seal the opening 154' on the left side of the inflation channel 153' of the air cushion body 10'. Correspondingly, the first clamping portion 3311' on the right side of the first clamping unit 331' and the second clamping portion 3321' on the right side of the second clamping unit 332' are coupled with each other so as to serve to seal the opening 154' on the right side of the inflation channel 153' of the air cushion body 10'.

The first connecting portion 3312' and the second connecting portion 3322' respectively have a contact hole 3315' and 3325' in the middle portion thereof. The clamping power source 333' comprises two clamping air cylinders 3331' and two driving portions 3332' respectively connected with the clamping air cylinders 3331'. The driving portions 3332' move up and down in the perpendicularly arranged chutes 3333' under the drive of the clamping air cylinders 3331'. Also, an end of each of the driving portions 3332' is connected with the clamping air cylinders 3331' respectively, while the other end thereof is mounted in the contact holes 3315' and 3325' respectively. Hence, when the clamping air cylinders 3331' is operating, they will drive the driving portions 3332' to move, so as to further drive the first connecting portion 3312' and the second connecting portion 3322' to move, which will drive the first clamping portion 3311' and the second clamping portion 3321' to move, such that a clamping operation can be conducted.

More specifically, according to this preferred embodiment of the present invention, the two clamping air cylinders 3331' output the power through the clamping air cylinders respectively. Also, the clamping air cylinder 3331' is connected with the air supply device 40' to obtain air pressure supply, such that the clamping air cylinder can be pushed to function, which detail will be further specified as follows. Person skilled in the art should be able to understand that the above mentioned way of providing power source can also be substituted by other ways.

Therefore, in a cycle of inflation, when the first clamping air cylinder 3331' on the upper side operates, it will drive the first driving portion 3332' to shift downward in the chute 3333' from the upper side and thus drive the first connecting portion 3312' to shift downward, such that the two first clamping portions 3311' will move downward respectively. Meanwhile, when the second clamping air cylinder 3331' on the lower side operates, it will drive the second driving portion 3332' to shift upward in the chute 3333' from the lower side and thus drive the second connecting portion 3322' to shift upward, such that the two second clamping portions 3321' will move upward respectively, so as to respectively press against the two first clamping portions 3311'. That is to say, the first clamping surface 3313' and the second clamping surface 3323' will press against each other, such that the two sides of the inflation channel 153' of the inflation unit 15' of the air cushion body 10' to be inflated will be clamped to seal between the first clamping surface 3313' and the second clamping surface 3323'. Besides, the first clamping groove 3314' and the second clamping groove 3324' form an entire clamping groove, so as to accommodate the distal end portion 3212' of the inflating portion 321' of the inflation pipe 32'.

Referring to FIG. 35, the section of the distal end portion 3212' of the inflation pipe 32' is substantially circular, while the sections of the first clamping groove 3314' and the second clamping groove 3324' are substantially semicircular. Therefore, when the two clamping units 331' and 332' move to each other from the upper and lower side respectively and eventually stop, the section of the whole clamping groove formed by the first clamping groove 3314' and the second clamping groove 3324' is substantially circular. In addition, the distal end portion 3212' of the inflation pipe 32' passes through the whole clamping groove, which is to be assembled with the first clamping groove 3314' and the second clamping groove 3324'. The shape and size of the whole clamping groove matches the shape and size of the distal end portion 3212' of the inflation pipe 32'.

In other words, the first clamping unit 331' and the second clamping unit 332' symmetrically arranged up and down. The positions of the first clamping portion 3311' and the second clamping portion 3321' are corresponding to each other. As a result, the first clamping surface 3313' of the first clamping unit 331' and the second clamping surface 3323' of the second clamping unit 332' are respectively tight pressed on the inflation end portions 151' and 152' of the two sides of the length direction of the inflation unit 15' of the air cushion body 10'. Besides, the bottom wall formed by the first clamping portion 3311' and the second clamping portion 3321' renders the inflation end portions 151' and 152' attach on the distal end portion 3212' of the inflation pipe 32' tight. In this manner, as the main portion 3211' of the inflating portion 321' of the inflation pipe 32' is extended into the inflation channel 153' of the inflation unit 15', the inflation inlet 154' of the two sides of the inflation channel 153' will be sealed off and under the clamping operation of the first clamping unit 331' and the second clamping unit 332' the inflation unit 15' forms the sealed inflatable cavity 155' therein. The main portion 3211' of the inflating portion 321' is in the inflatable cavity 155'. Air output from the vent hole 3214' will enter the inflatable cavity 155' and further enter each of the air storage units 13'.

When the air storing unit 13' of the air cushion body 10' required to be inflated is inflated to a predetermined air pressure, the two clamping air cylinders 3331' will respectively drive the corresponding driving portions 3332' to move from each other, so as to drive the first clamping portion 3311' and the second clamping portion 3321' of the two clamping units 331' and 332' to move away from each other to the original positions thereof respectively. Therefore, the two sides of the inflated air cushion body 10' are released and an inflation cycle is completed. Then, the clamping units 331' and 332' are ready for the inflation for the next air cushion body 10' of the continuous type air cushion body 100'.

In other words, the clamping device 33' has a clamped state and an idle state. In the idle state the clamping device 33' is at the original condition, where the first clamping unit 331' and the second clamping unit 332' of the clamping device 33' are spacedly at resting positions. When a control command of starting an inflation process in received, the first clamping portion 3311' and the second clamping portion 3321' of the first clamping unit 331' and the second clamping unit 332' of the clamping device 33' will move towards move towards each other under the effect of the clamping power source 333', so as to shift from the idle state to the clamped state and to seal the two sides of the air cushion body 10' to be inflated. After the inflation process is finished, the first clamping portion 3311' and the second clamping portion 3321' will move from each other so as to shift from the clamped state to the idle state.

It is worth mentioning that the distance W between the two first clamping portions 3311', which equals to the distance between the two second clamping portions 3321', decides the allowable width for the continuous type air cushion body 100' to be inflated, or the width of the air cushion body 10'. The air cushion body 10' may have only one air storing unit 13'. That is to say, the width of the air storing unit 13' can be substantially smaller than the distance W between the two first clamping portions 3311', such that it is possible to inflate only one air storing unit 13' in an inflation process. Certainly, the air cushion body 10' may also have a plurality of the air storing units 13', such as 2-20 air storing units 13' for example, or more preferably, 5-15 air storing units 13'. Besides, the width of each of the air storing units 13' can be arranged according to the needs.

The mounting plate body 3111' of the mounting plate 311' has a clamping device retaining slot 3113' formed thereon, which is extended along the vertical direction as the figure illustrated. The two driving portions 3332' respectively pass through the clamping device retaining slot 3113' and enter the contact holes 3315' and 3325' of the first connecting portion 3312' and the second connecting portion 3322'. In this way, the two driving portions 3332' are movable in the clamping device retaining slot 3113'. In other words, the two driving portions 3332' can reach the outer side of the mounting plate 311' from the inner side of the mounting plate 311' by passing through the clamping device retaining slot 3113'. Therefore, the two clamping units 331' and 332' can be respectively on the opposite side of the mounting plate 311' to the clamping air cylinders 3331' of the clamping power source 333', wherein the clamping air cylinders 3331' can be installed in the box-like structure form by the bracket 31'.

The clamping device 33' further comprises at least a holding unit 334' comprising two holding units 334'. Each holding unit 334' comprises two holding blocks 3341' and two guide rods 3342' mounted between the two holding block 3341'. The first clamping unit 331' and the second clamping unit 332' further form top-to-bottom through guide rod hole 3316' and 3326' on the first connecting portion 3312' and the second connecting portion 3322' respectively for the guide rods 3342' to pass through, such that the first clamping unit 331' and the second clamping unit 332' are positioned between the two holding blocks 3341', while the holding blocks 3341' are both affixed on the mounting plate 311' through connection mode like paired bolts and nuts, etc.

When the clamping device 33' is shifting between the clamped state and the idle state, the first connecting portion 3312' and the second connecting portion 3322' of the first clamping unit 331' and the second clamping unit 332' are respectively moving vertically along the two guide rods 3342', such that the two holding units 334' can further have a function of limiting and retaining the first clamping unit 331' and the second clamping unit 332'.

Figure 37:
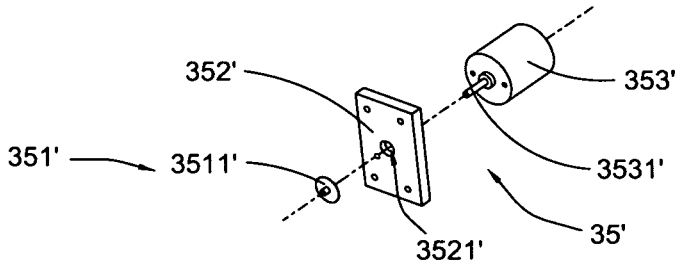
FIG. 37 is an exploded view of the splitting device of the inflation apparatus for the air cushion body according to the above second preferred embodiment of the present invention.

Referring to FIGS. 34 and 37, the inflation apparatus 30' further comprises a splitting device 35'. The splitting device 35' comprises a splitting tool 351' and a holding device 352'. The splitting tool 351' is attached on a rotation axle 3531' of a motor 353', such that the splitting tool 351' can be driven by the circularly rotation of the motor 353' to circularly rotate. The motor 353' is affixed on the mounting plate 311' of the bracket 31' through the holding device 352'. That is to say, the splitting tool 351' of the splitting device 35' can rotate relatively to the holding device 352' by means of the motor 353'. According to this preferred embodiment of the present invention, the splitting tool 351' can be embodied as a rotary cutting tool 3511'. The edge of the rotary cutting tool 3511' can be a continuous plane blade. The holding device 352' comprises a mounting hole 3521'. The rotation axle 3531' of the motor 353' passes through the mounting hole 3521' of the holding device 352' to be attached on the rotary cutting tool 3511'. In other words, the splitting tool 351' of the splitting device 35' can rotate relatively to the holding device 352', such that when the inflated inflation unit 15' of the air cushion body 10' moves forward, the cutting edge of the rotary cutting tool 3511' of the splitting tool 351' can rollingly and automatically cut off the inflation unit 15' of the air cushion body 10' along the fringe heat sealing seam 102' or the folding line 106A thereof through the driving of the inflation unit 15' so as to split the inflation unit 15' and make the separated inflation end portions 151' and 152', which means two free extremities that are not connected. The free inflation end portions 151' 152' can smoothly be moved forward along the inflation pipe 32' under the action of the conveyor 34' and eventually be detached from the inflation pipe 32'.

It is worth noticing that according to the above preferred embodiment the splitting tool 351' of the splitting device 35' is provided in an anchoring groove 31431'. The anchoring groove 31431' is extended from the retaining groove 3143' and is located at the top of the inflating portion 321' of the inflation pipe 32', such that when the inflated inflation unit 15' of the air cushion body 10' moves forward, the cutting edge of the rotary cutting tool 3511' of the splitting tool 351' can rollingly and automatically cut off the inflation unit 15' of the air cushion body 10' along the fringe heat sealing seam 102' or the folding line 106A thereof through the driving of the inflation unit 15', so as to split the inflation unit 15' and make the separated inflation end portions 151' and 152', which means two free extremities are not connected. The free inflation end portions 151' 152' can smoothly be moved forward along the inflation pipe 32' under the action of the conveyor 34' and eventually be detached from the inflation pipe 32'.

In the entire splitting process, based on the arrangement of the anchoring groove 31431' and the support of the inflating portion 321' of the inflation pipe 32', the cutting edge of the splitting tool 351' in a rotary cutting tool shape may easily and straightly split the inflation unit 15' along the fringe heat sealing seam 102' of the inflation unit 15' of the air cushion body 10' and make the separated inflation end portions 151' and 152', which means two free extremities that are not connected. The free inflation end portions 151' and 152' can smoothly be moved forward along the inflation pipe 32' under the act of the conveyor 34' and eventually be detached from the inflation pipe 32'. It is worth noticing that the anchoring groove and the inflating portion 321' of the inflation pipe 32' are not communicated, such that the gas tightness of the inflating portion of the inflation pipe 32' during the work process will not be affected.

Person skilled in the art may modify the structure of the preferred embodiment of the present invention based on actual contexts. For example, the splitting tool 351' can be embodied as a rotary cutting tool having a continuous serrated blade on the edge thereof, such that when the inflated inflation unit 15' of the air cushion body 10' move forward, the continuous serrated blade of the splitting tool 351' can rollingly and automatically cut off the inflation unit 15' of the air cushion body 10' along the fringe heat sealing seam 102' or the folding line 106A' thereof through the driving of the inflation unit 15' so as to split the inflation unit 15' and make the separated inflation end portions 151' and 152', which means two free extremities are not connected. The free inflation end portions 151' and 152' can smoothly be moved forward along the inflation pipe 32' under the act of the conveyor 34' and eventually be detached from the inflation pipe 32'.

Besides, person skilled in the art may determine to embody the splitting tool 351' into any other structure based on actual needs, as long as the splitting tool 351' can rotate relatively to the mounting plate 311' of the bracket 31' so as to be driven by the inflation unit 15' to rollingly and automatically cut off and split the inflation unit 15' along the fringe heat sealing seam 102' or folding line 106A of the inflation unit 15' of the air cushion body 10' and make separated inflation end portions 151' and 152'. In other words, those utilize identical or similar technical solutions with the present invention, solve identical or similar technical issues with the present invention, and achieve identical or similar technical results with the present invention are all within the scope of protection of the present invention, while specific implementations of the present invention shall not be limited thereto.

Referring to FIG. 34, the inflation apparatus 30' further comprises the conveyor 34' mounted on the mounting plate 311' and provided on the right side of the clamping units 331' and 332' for conveying the continuous type air cushion body forward. More specifically, the conveyor 34' comprises two conveying unit 341' and 342' and a conveying power source 343'. After the continuous type air cushion body 100' is inflated, the inflation end portions 151' and 152' of the split inflation unit 15' are affected by the two conveying units 341' and 342'. Therefore, the previous inflated air cushion body 10' can move forward due to the action of the conveying units 341' and 342' and further bring another subsequent air cushion body 10' to the inflation position, which is the position between the two clamping portions of the clamping unit, so as to be ready for the next inflation session. By so, the inflation apparatus 30' of the present invention can continuously and automatically inflate the continuous type air cushion bodies 100'.

More specifically, the first conveying unit 341' comprises a first conveying gear 3411', a first connecting shaft 3412', and a first driving gear 3413', wherein the first conveying gear 3411' and the first driving gear 3413' are respectively at the two ends of the first connecting shaft 3412', such that the first connecting shaft 3412' is extended between the first conveying gear 3411' and the first driving gear 3413'. The second conveying unit 342' comprises a second conveying gear 3421', a second connecting shaft 3422', and a second driving gear 3423', wherein the second conveying gear 3421' and the second driving gear 3423' are respectively at the two ends of the second connecting shaft 3422', such that the second connecting shaft 3422' is extended between the second conveying gear 3421' and the second driving gear 3423'.

The first conveying gear 3411' and the second conveying gear 3421' are engaged with each other. The first driving gear 3413' and the second driving gear 3423' are engaged with each other. Thus, when the first driving gear 3413' and the second driving gear 3423' are engaged and rotate with each other, the first driving gear 3413' transmits driving force through the first connecting shaft 3412' to drive the first conveying gear 3411' to rotate and the second driving gear 3423' transmits driving force through the second connecting shaft 3422' to drive the second conveying gear 3421' to rotate, such that the engagement between the first conveying gear 3411' and the second conveying gear 3421' moves the inflation unit 15' of the continuous type air cushion body 100' forward.

More specifically, for example, the first conveying gear 3411' rotates counterclockwise and the second conveying gear 3421' rotates clockwise, so as to generate forward driving force to drive the inflation unit 15' of the continuous type air cushion body 100' to move forward.

According to this embodiment of the present invention, the conveying power source 343' can comprise a conveying motor 3431', an output shaft 3432', and mounting bracket 3433'. The conveying motor 3431' is mounted on the mounting bracket 3433'. The mounting bracket 3433' is mounted on the mounting plate 311'. The motor 3431' provides rotary driving force, which will be transmitted to the first conveying unit 341' and the second conveying unit 342' so as to drive the continuous type air cushion body 100' to move forward. More specifically, the second conveying unit 342' further comprises a first roller 3424', a second roller 3425', and a transmission belt 3426'. The first roller 3424' is mounted on the output shaft 2432' of the conveying power source 343'. The second roller 3425' is mounted on the second connecting shaft 3422'. The transmission belt 3426' surrounds around the first roller 3424' and the second roller 3425'. Therefore, when the conveying motor 3431' operates to drive and rotate the output shaft 2432', the first roller 3424' will be driven to rotate by the output shaft 2432', so as to further drive the second roller 3425' to rotate through the transmission belt 3426' and drive the second connecting shaft 3422' to rotate, such that the second driving gear 3423' can be driven to rotate so as to bring the first driving gear 3413' engaged with the second driving gear 3423' to rotate, which eventually brings the first conveying gear 3411' and the second conveying gear 3421' to rotate in opposite directions.

Person skilled in the art should be able to understand that the structure of the conveyor 34' is just an example rather than limit to the present invention. That is, person skilled in the art may come up with other structures that are able to drive the continuous type air cushion body 100' to move forward according to his needs.

It is worth mentioning that by the time the next air cushion body 10' has finished its inflation, the inflation unit 15' of the previous air cushion body 10' is at the middle of the two conveying gears 3411' and 3421', so when the inflation unit 15' of the next air cushion body 10' is not clamped well by the clamping device 33', it will shrink. However, because of the limiting and spacing caused by the two conveying gears 3411' and 3421' to the inflation unit 15' of the previous air cushion body 10', the overall shrinkage of the continuous type air cushion body 100' can be reduced.

Besides, referring to FIGS. 34-45, according to this preferred embodiment of the present invention, the inflation apparatus 30' further comprises a shifting device 335'. The shifting device 335' is attached on the clamping power source 333' through a guide rail 336' and is able to bring the inflation unit 15' of the air cushion body 10' to move towards move towards the moving direction of the inflation process along the guide rail 336'. Preferably, the shifting device 335' comprises an actuating mechanism 3353', a clamping mechanism 3351', sum a shifting mechanism 3352'. The clamping mechanism 3351' is affixed on the shifting mechanism 3352'. The actuating mechanism 3353' is for providing driving force for the motion of the clamping mechanism 3351' and the shifting mechanism 3352'.

Figure 38A:
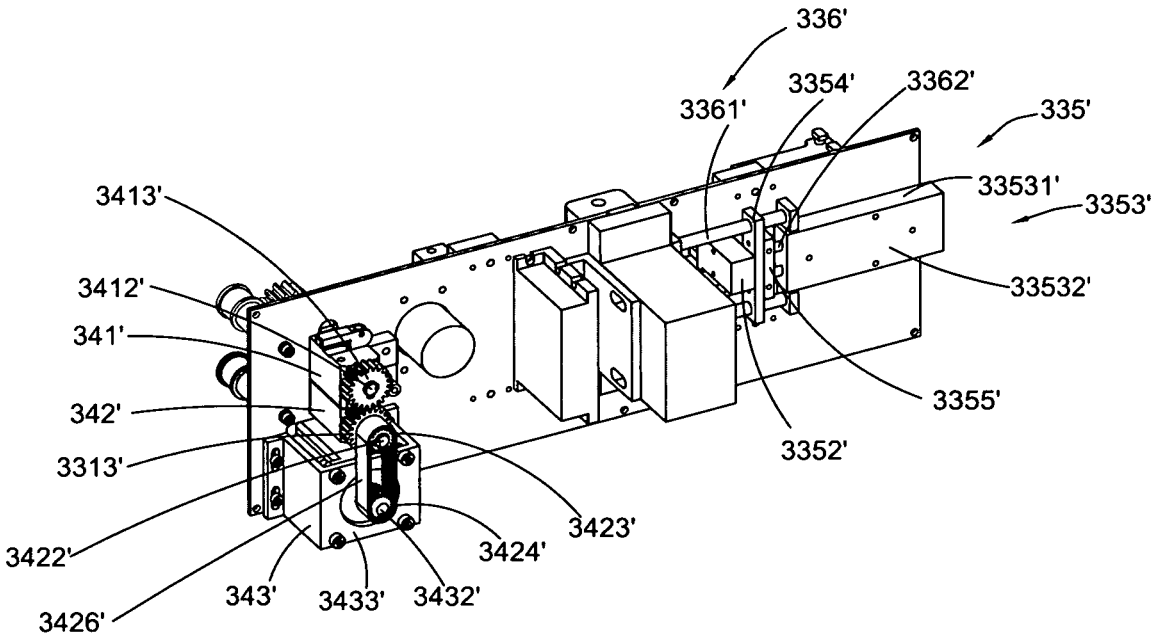
FIG. 38A is a perspective view of the back side of the conveyor of the inflation apparatus for the air cushion body according to the above second preferred embodiment of the present invention.
Figure 38B:
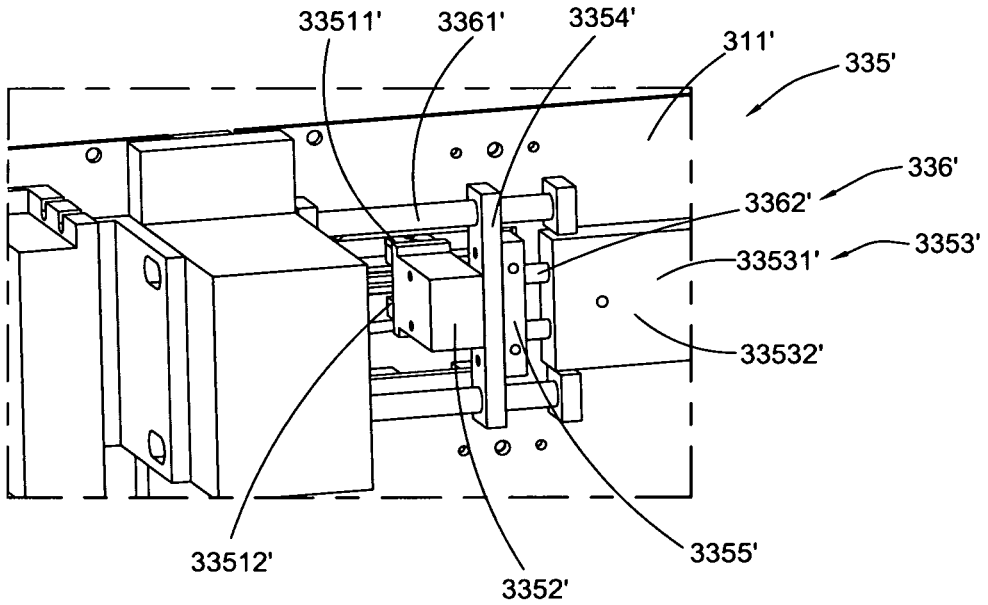
FIG. 38B is a partially enlarged view of the shifting device of FIG. 38A.
Figure 39:
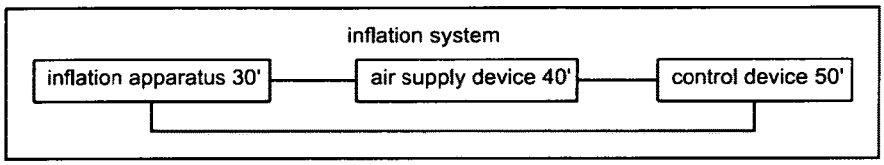
FIG. 39 is a perspective view of the inflation system for the air cushion body according to the above second preferred embodiment of the present invention.
Figure 40:
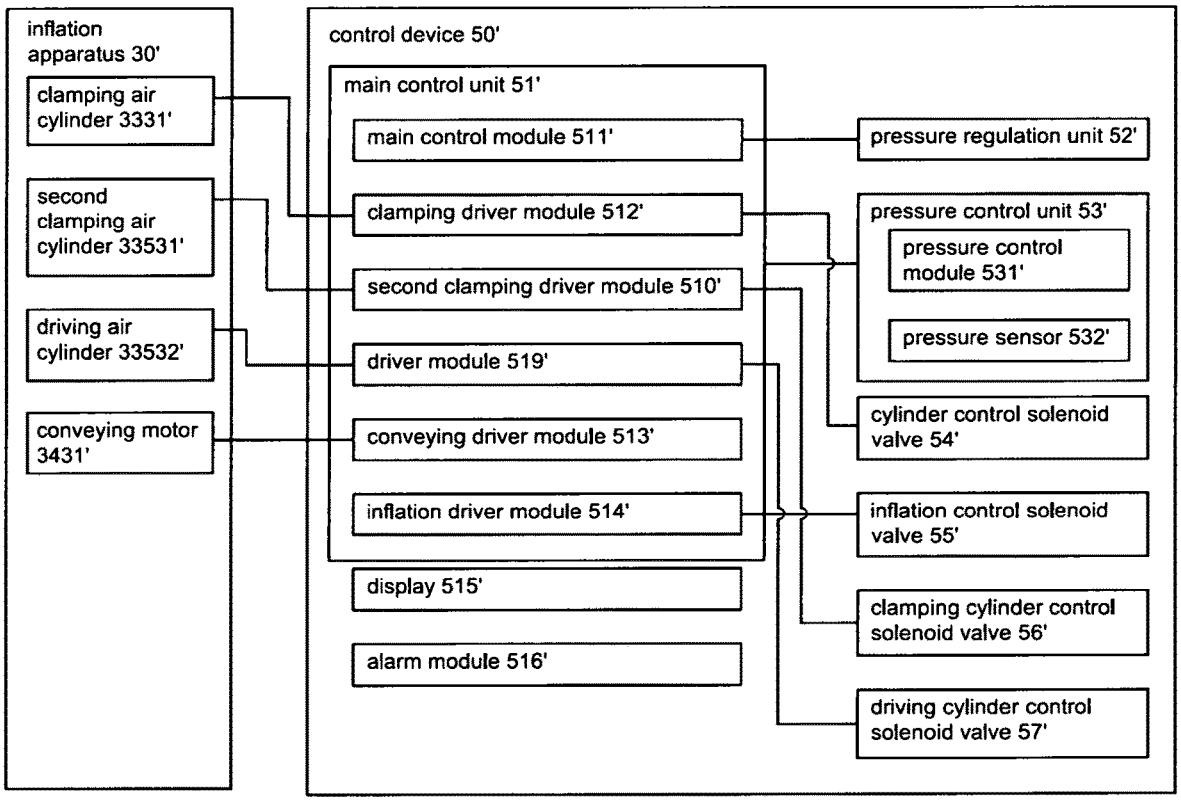
FIG. 40 is a perspective view of the control device the inflation system for the air cushion body according to the above second preferred embodiment of the present invention.

Specifically speaking, referring the FIGS. 34 and 38B, the actuating mechanism 3353' further comprises two second clamping air cylinders 33531' and two driving air cylinders 33532'. The clamping mechanism 3351' comprises a first clamping block 33511' and a second clamping block 33512', which are respectively connected with the two second clamping air cylinders 33531', so as to be controlled to move for clamping or loosening the clamping mechanism 3351'. The two driving air cylinders 33532' are connected with the shifting mechanism 3352' so as to control the movement of the shifting mechanism 3352' and make the shifting mechanism 3352' move left and right along the guide rail 336'.

More specifically, the actuating mechanism 3353' is affixedly arranged on the back side of the mounting plate 311'. The guide rail 336' comprises two first guide rails 3361' and two second guide rails 3362'. The shifting device 335' further comprises a first shifting block 3354' and a second shifting block 3355'. The first shifting block 3354' is affixedly connected with the shifting mechanism 3352' on a side thereof. The first shifting block 3354' is affixedly connected with the second shifting block 3355' on another side thereof. That is to say, the clamping mechanism 3351', the shifting mechanism 3352', the first shifting block 3354', and the second shifting block are affixedly connected to move together.

Further, the two ends of the first shifting block 3354' are respectively slidably connected with the first guide rail 3361' so as to slide along the first guide rail 3361'. The two ends of the second shifting block 3355' are respectively slidably connected with the second guide rail 3362', so as to slide along the second guide rail 3362'. The clamping mechanism 3351' and the shifting mechanism 3352' are affixed between the clamping power source 333' and the actuating mechanism 3353' through the first guide rails 3361' and the second guide rails 3362' to clamp or move the inflation unit 15' of the air cushion body 10' under the influence of the two second clamping air cylinder 33531' and the two driving air cylinder 33532'.

Referring to FIGS. 43A-44F, when one or part of one air cushion body 10' is inflated through the inflation unit 15', the control device 50' will control the second clamping air cylinder 33531' to drive the first clamping block 33511' and the second clamping block 33512' to move towards move towards each other, so as to clamp the inflation unit 15' of the air cushion body 10'. Meanwhile, the control device 50' will control the driving air cylinder 33532' to drive the shifting mechanism 3352' to bring the clamping mechanism 3351' to move towards move towards the moving direction of the air cushion body 10' so as to bring the air cushion body 10' to move for a certain distance along its moving direction. Then, the control device 50' will control the second clamping air cylinder 33531' to drive the first clamping block 33511' and the second clamping block 33512' to move away from each other, so as to loosen the inflation unit 15' of the air cushion body 10'. Meanwhile, the control device 50' will control the driving air cylinder 33532' to drive the shifting mechanism 3352' to bring the clamping mechanism 3351' to move towards move towards the opposite of the moving direction of the air cushion body 10' so as to bring the clamping mechanism 3351' back to its initial position.

When the air cushion body 10' is inflated through the inflation unit 15, it will be transformed from a plane state to a three-dimensional state. As a result, shrinkage will occur and causes a certain distortion or deviation after the air cushion body 10' is inflated and released. Fortunately, according to this preferred embodiment, because the air cushion body 10' has been brought by the clamping mechanism 3351' and the shifting mechanism 3352' of the shifting device 335' toward the moving direction of the air cushion body 10' for a certain distance before being inflated, distortion or deviation caused by shrinkage or influence on the inflation of the inflation unit 15' to the air cushion body 10' can all be prevented during the inflation process of the air cushion body 10'.

In addition, referring to FIG. 34, the mounting plate 311' further forms two connecting shaft spacing holes 3114'. The first connecting shaft 3412' and the second connecting shaft 3422' respectively penetrate into the two connecting shaft spacing hole 3114', such that the first conveying gear 3411' and the second conveying gear 3421' and the first driving gear 3413' and the second driving gear 3423' are respectively arranged on the opposite side of the mounting plate, wherein the conveying power source 343' is also arranged on the inner side of the mounting plate.

It follows that in an inflation cycle, the continuous type air cushion body 100' is sleeved and arranged on the inflating portion 321' of the inflation pipe 32', so as to have the inflating portion 321' be extended in the inflation channel 153' of the inflation unit 15'. The conveyor 34' is for driving the air cushion body 10' of the continuous type air cushion body 100' that is to be inflated to move to the inflation position, which is the position between the two clamping portions of the clamping device 33'. Then the clamping device 33' may shift from the idle state to the clamped state to seal the two sides of the inflation channel 153' of the inflation unit 15' of the air cushion body 100'. Besides, the air supply device 40' and the inflation pipe 32' are connected and communicated, such that the inflation pipe 32' can inflate the air cushion body 10'. After the inflation is finished, the clamping device 33' will shift from the clamped state to the idle state. The conveyor 34' will drive the continuous type air cushion body 100' to move forward, so as to have the inflated air cushion body 10' leave the inflation position until the next air cushion body 10' move into the inflation position.

Person skilled in the art should be able to understand that the inflation apparatus 30' according to the present invention may also inflate independent and separate air cushion bodies 10' one by one. Specifically, the inflation unit 15' of an independent air cushion body 10' can be sleeved and arranged on the inflating portion 321' of the inflation pipe 32'. Then the subsequent clamping and inflation processes will be conducted. After the inflation, the inflated air cushion body 10' can be taken off from the opposite direction of how it has been arranged along the inflating portion 321' of the inflation pipe 32'. In this embodiment, the air cushion body 10' may also have an opening 154' on a side thereof, while have the other side sealed. That is, when the apparatus inflates independent air cushion bodies 10' one by one, it will not have to split the inflation unit 15' of the air cushion body 10', but to have it taken off from the opposite direction after inflation.

The following description will further describes the inflation system according to this preferred embodiment of the present invention, wherein the control device 50' is the core of the system for controlling the steps of clamping, blowing, loosening, conveying, and etc. of the inflation apparatus 30'. More specifically, the control device 50' comprises a main control unit 51', a pressure regulation unit 52', a pressure control unit 53', three air cylinder controlling switches that can be respectively embodied as a cylinder control solenoid valve 54', a clamping cylinder control solenoid valve 56', and a driving cylinder control solenoid valve 57', and an inflation controlling switch that can be embodied as an inflation control solenoid valve 55'.

The main control unit 51' is the control center of the control device 50'. The pressure regulation unit 52' is to control the air pressure provided by the air supply device 40' so as to maintain the air pressure within a predetermined range, which, if applicable, is around 0.2 MPa. The pressure control unit 53' is for detecting if the air pressure that the inflation apparatus 30' provided to each air storing unit 13' of the air cushion body 10' has attained the predetermined value. For example, according to this embodiment, the pressure control unit 53' can comprise a pressure control module 531' and a pressure sensor 532'. When the pressure sensor 532' detected that air pressure in the pipeline connected with the inflation pipe 32' has reached around 0.1

Mpa, the pressure control module 531' will determine that the inflation is completed and send a message of inflation completion to the main control unit 51'. It is understandable that the pressure control module 531' may also be integrated in the main control unit 51'. The cylinder control solenoid valve 54' is for controlling if there is air supply to the clamping air cylinder 3331'. The clamping cylinder control solenoid valve 56' is for controlling if there is air supply to the second clamping air cylinder 33531'. The driving cylinder control solenoid valve 57' is for controlling if there is air supply to the driving air cylinder 33532'. The inflation control solenoid valve 55' is to open or close the pipeline of the air supply device 40' connected into the inflation pipe 32' of the inflation apparatus 30' so as to start or stop the inflation process. It is worth mentioning that the specific values, such as 0.2 Mpa and 0.1 Mpa, are just examples, rather than limits to the scope of the present invention.

Figure 41:
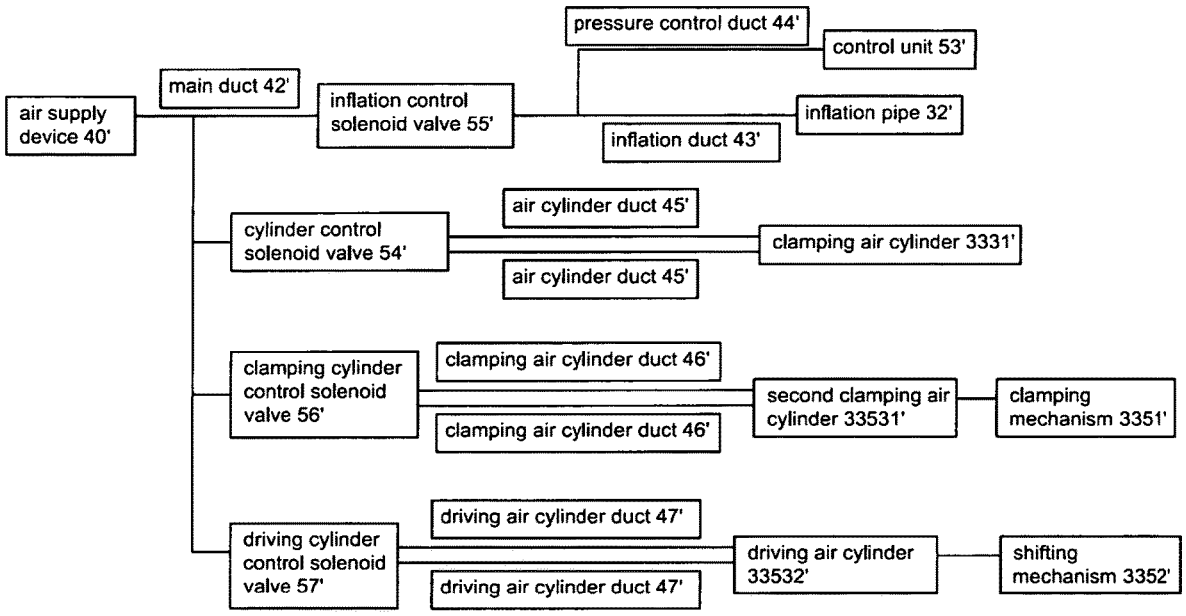
FIG. 41 is a perspective view illustrating air pipeline arrangement of the inflation system for the air cushion body according to the above preferred embodiment of the present invention.
Figure 42:
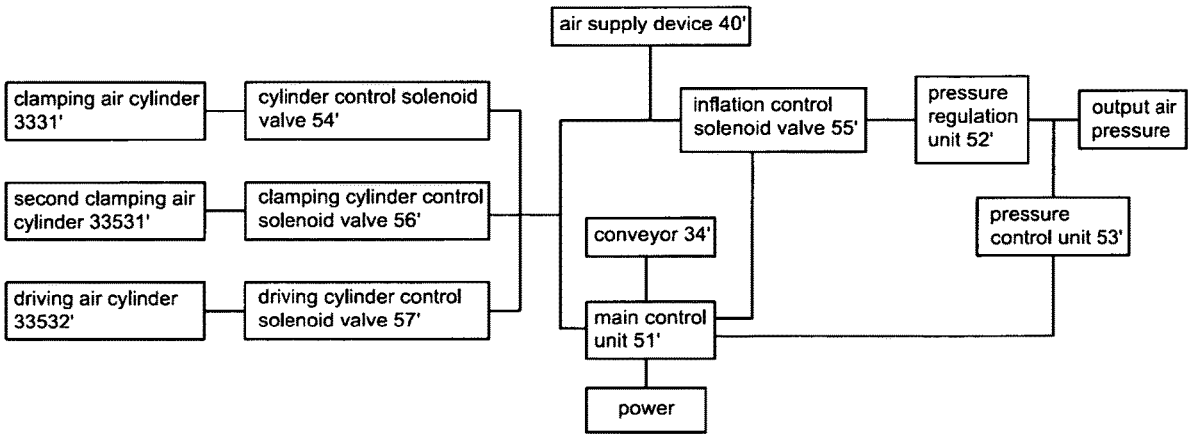
FIG. 42 is a perspective view illustrating circuit arrangement of the inflation system for the air cushion body according to the above second preferred embodiment of the present invention.
Figure 43A:
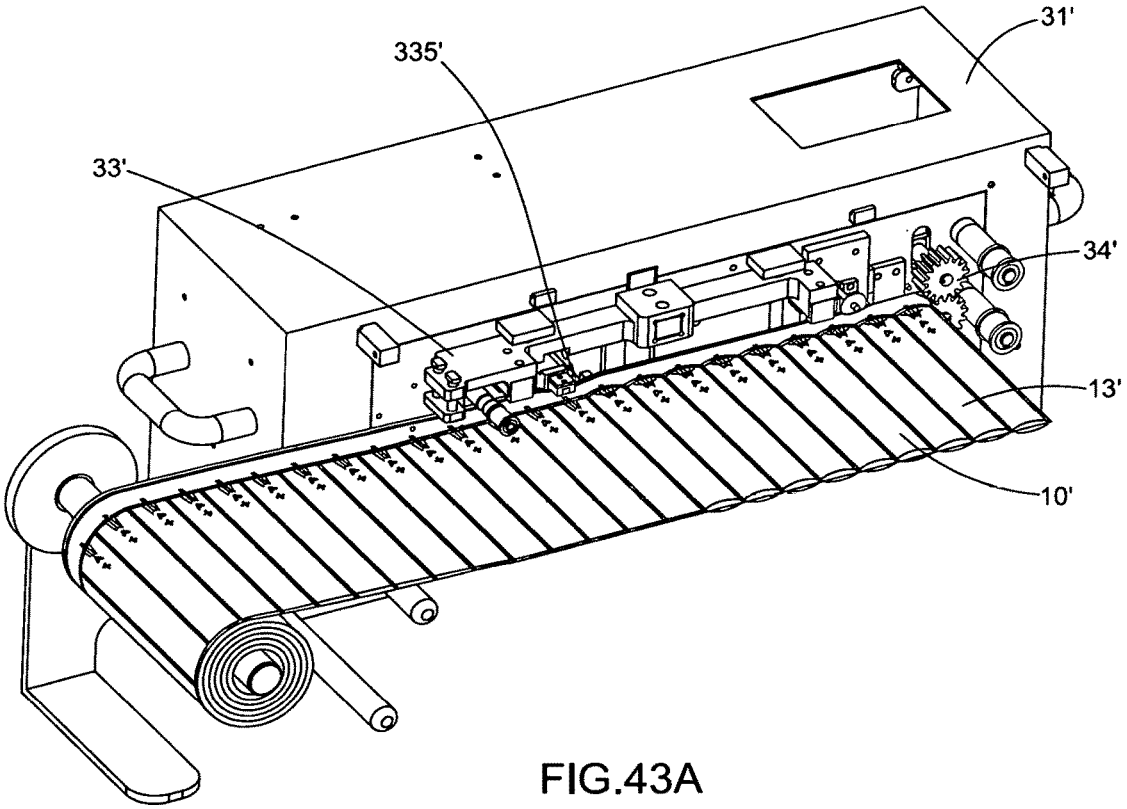
FIG. 43A is a perspective view illustrating the air cushion body being inflated on the inflation apparatus according to the above second preferred embodiment previous the present invention.
Figure 43B:
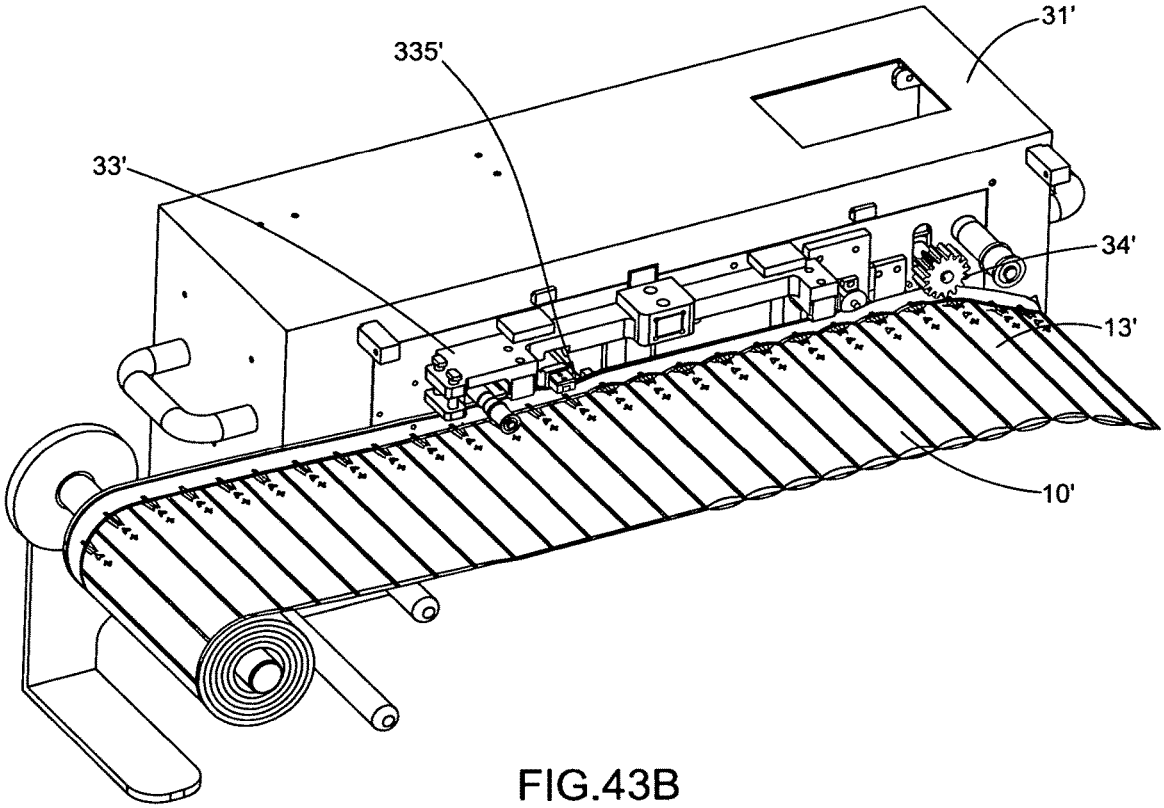
FIG. 43B is a perspective view illustrating the air cushion body being moved forward on the inflation apparatus according to the above second preferred embodiment previous the present invention.
Figure 44A:
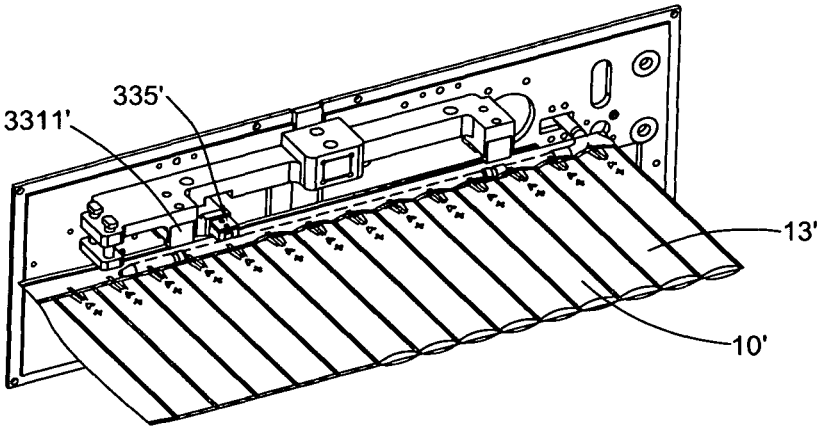
FIGS. 44A-44F are perspective views illustrating the inflation apparatus for the air cushion body during the inflation process according to the above second preferred embodiment previous the present invention.
Figure 44B:
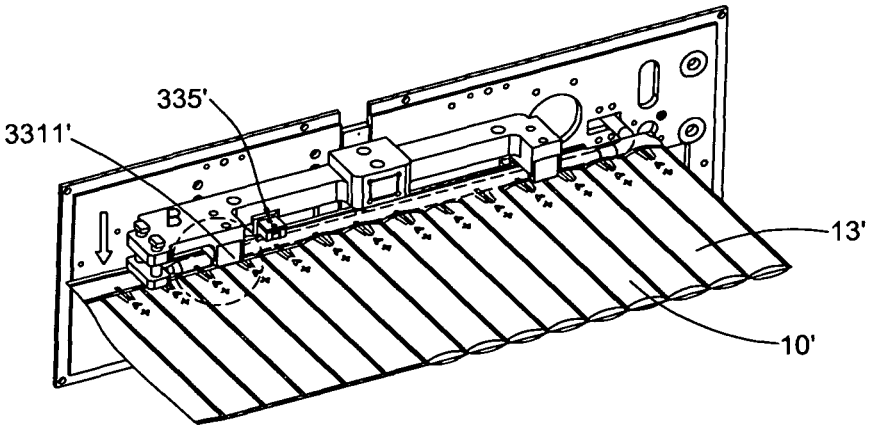
Figure 44C:
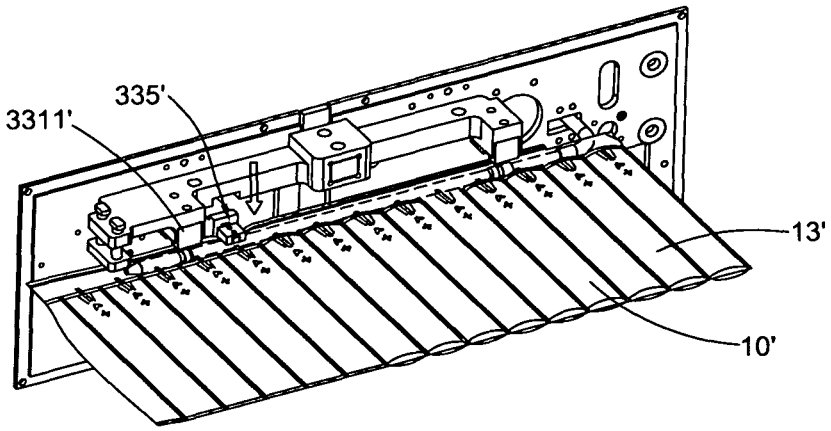
Figure 44D:
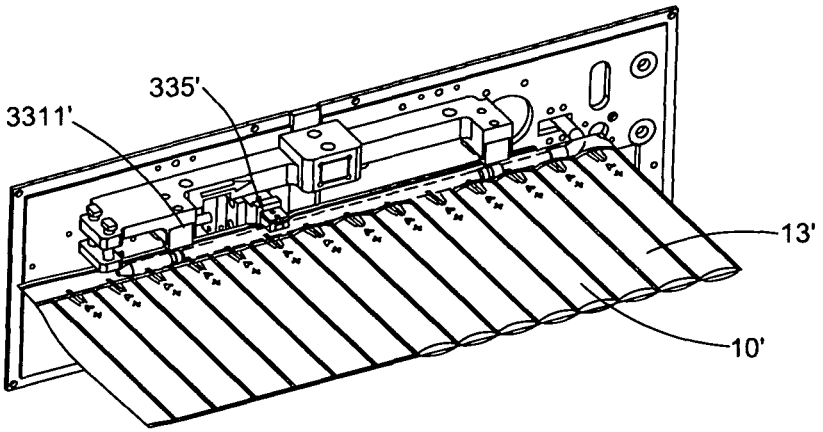
Figure 44E:
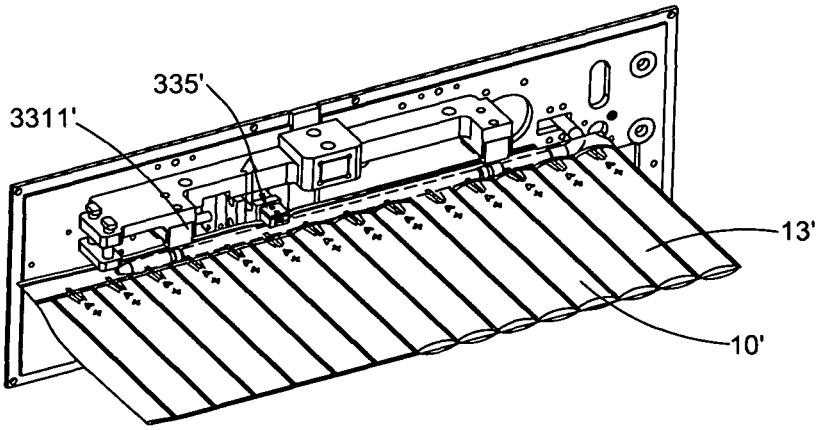
Figure 44F:
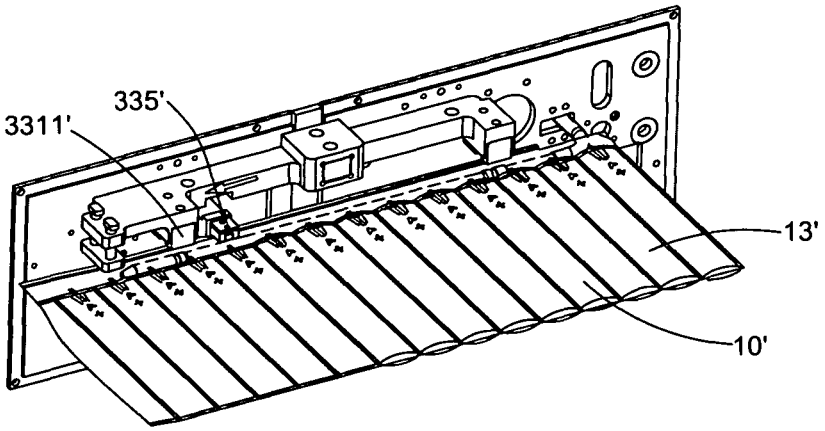
Figure 45:
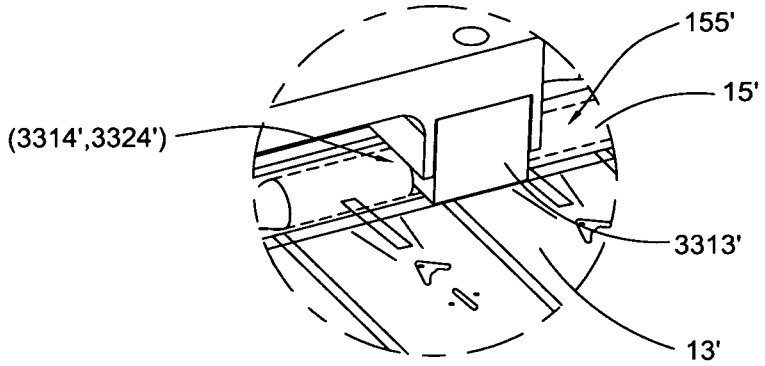
FIG. 45 is a partially enlarged view illustrating the inflation end portions of the air cushion body being clamped on the inflation apparatus according to the above second preferred embodiment previous the present invention.

FIG. 41 illustrates the air pipeline arrangement of the inflation system according to the present invention. Specifically, the air supply device 40' is for providing high pressure gas, which may comprise an electric air pump 41' and gas pipelines comprising a main passage 42', an inflation duct 43', a pressure control duct 44', two air cylinder ducts 45', two clamping air cylinder ducts 46', and two driving air cylinder ducts 47'. When the electric air pump 41' is power on, it can operate to generate high pressure gas. As the high pressure gas enters the main passage 42', it can further pass through the two air cylinder ducts 45', the two clamping air cylinder ducts 46', and the two driving air cylinder ducts 47' for respectively being utilized for inflation or driving the clamping air cylinder 3331', the second clamping air cylinder 33531', and the driving air cylinder 33532'. Person skilled in the art should be able to understand that according to other feasible alternative mode, the air supply device 40' can also be embodied as a high pressure gas storage device storing compressed gas for subsequent inflation process.

More specifically, the inflation pipe 32' of the inflation apparatus 30' is connected with the main passage 42' through the inflation duct 43'. Gas provided by the air supply device 40' is further regulated through the pressure regulation unit 52' in, for example, about 0.2 Mpa and sent to the inflation pipe 32' of the inflation apparatus 30' through the inflation duct 43', which forms an inflation pipeline structure. The inflation control solenoid valve 55' on the pipeline structure can be opened or closed to start or stop the inflation process.

A branch, which is the pressure control duct 44', is further diverged from the inflation duct 43' to be connected with the pressure control unit 53' so as to connect the air pressure of the pipeline of the inflation pipe 32' to the pressure control duct 44'. If the air pressure attains 0.1 Mpa, it means that the air pressure in each of the air storage units 13' of the air cushion body 10' attains 0.1 Mpa. Therefore, it can send the detected air pressure value or a command of stopping inflation to the main control unit 51'.

The two air cylinder ducts 45', the two clamping air cylinder ducts 46', and the two driving air cylinder ducts 47' are respectively further connected with the main passage 42' so as to respectively provide air supply to the two clamping air cylinders 3331', the second clamping air cylinder 33531', and the driving air cylinder 33532'. Besides, the opening and closing of the cylinder control solenoid valve 54', the clamping cylinder control solenoid valve 56', and the driving cylinder control solenoid valve 57' respectively control the operations of the two clamping air cylinders 3331', the second clamping air cylinder 33531', and the driving air cylinder 33532', which can drive the first and second clamping portion 3311' and 3321' of the first and second clamping unit 331' and 332' of the clamping device 33', the first clamping block 33511' and the second clamping block 33512', and the shifting mechanism 3352' to switch among the clamped state, shifting state, and idle state.

The main control unit 51' comprises a main control module 511' and a clamping driver module 512', a second clamping driver module 510', a driver module 519', a conveying driver module 513', an inflation driver module 514', and a display 515' that are operatively connected with the main control module 511'. The main control module 511' is embodied as a processor for receiving and processing information as well as sending out control commands. The clamping driver module 512' is operatively connected with the cylinder control solenoid valve 54', such that when the clamping driver module 512' receives a control command of starting or stopping the clamping device 33' from the main control module 511', the clamping driver module 512' can send a control command to the cylinder control solenoid valve 54' to open or close the cylinder control solenoid valve 54' so as to correspondingly actuate a clamping or loosening operation. The second clamping driver module 510' is operatively connected with the second clamping cylinder control solenoid valve 56', such that when the second clamping module 510' receives a control command of starting or stopping the clamping mechanism 3351' from the main control module 511', the second clamping driver module 510' can send a control command to the clamping cylinder control solenoid valve 56' to open or close the clamping cylinder control solenoid valve 56' so as to correspondingly actuate a clamping or loosening operation. The driver module 519' is operatively connected with the driving cylinder control solenoid valve 57', such that when the driver module 519' receives a control command of starting or stopping the shifting mechanism 3352' from the main control module 511', the driver module 519' can send a control command to the driving cylinder control solenoid valve 57' to open or close the driving cylinder control solenoid valve 57' so as to correspondingly actuate shifting operation for different directions. The conveying driver module 513' is operatively connected with the conveying motor 3431' of the conveyor 34', such that when the conveying driver module 513' received a control command of starting or stopping the conveyor 34' from the main control module 511', the conveying driver module 513' can send a control command to the conveying motor 3431' to switch on or off the conveying motor 3431' so as to correspondingly actuate or terminate the forward drive of the conveyor 34' to the continuous type air cushion body 100'. The inflation driver module 514' correspondingly controls the opening and closing of the inflation control solenoid valve 55'.

The display 515' is for displaying corresponding information, which includes the output air pressure value of the air supply device 40', the air pressure numeric value obtained by the pressure control unit 53' from the inflation pipeline structure, the conveying speed of the moving conveyor 34' driven by the conveying motor 3431', and etc. The display 515' may also provide a control interface, which comprises control buttons arranged thereon for the user to set up relevant parameters and control the operation of the entire inflation process.

Optionally, the main control unit 51' further comprises an alarm module 516'. The alarm module 516' will send warning message to the main control module 511' to have the main control module 511' shut-down and stop the entire system, if certain incidents occur, including, for example, if the clamping device fails to clamp well or completely fails clamp on the inflation unit 15' of the air cushion body 10', rendering abnormal the air pressure value being obtained by the pressure control unit 53' from the inflation pipeline structure; if relevant solenoid valves 54' and 55' fail; if leakage occurs on pipelines of the air supply device 40' rendering the pressure regulation unit 52' fail to stabilize the air pressure; if the conveying motor 3431' of the conveyor 34' breaks down; and etc.

Figure 46:
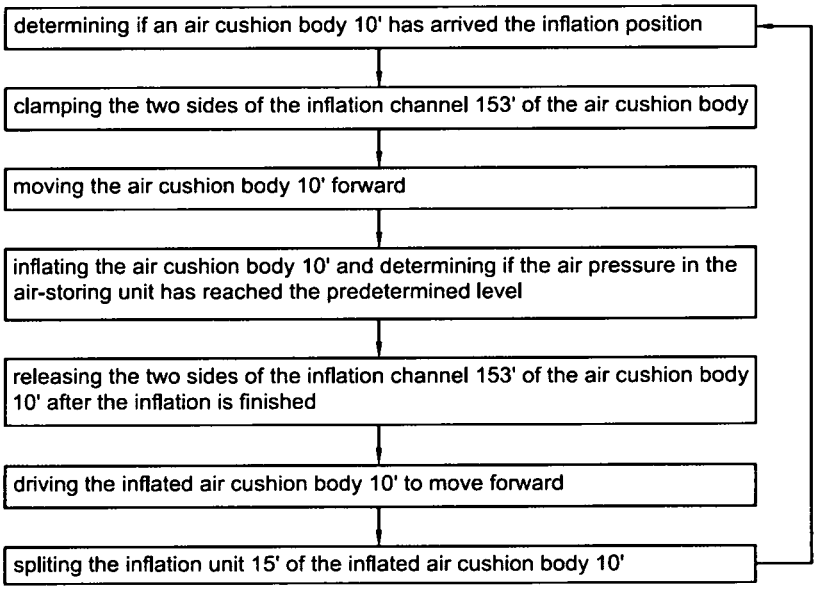
FIG. 46 is a flow diagram of the inflation method for the air cushion body according to the above second preferred embodiment of the present invention.
Figure 47:
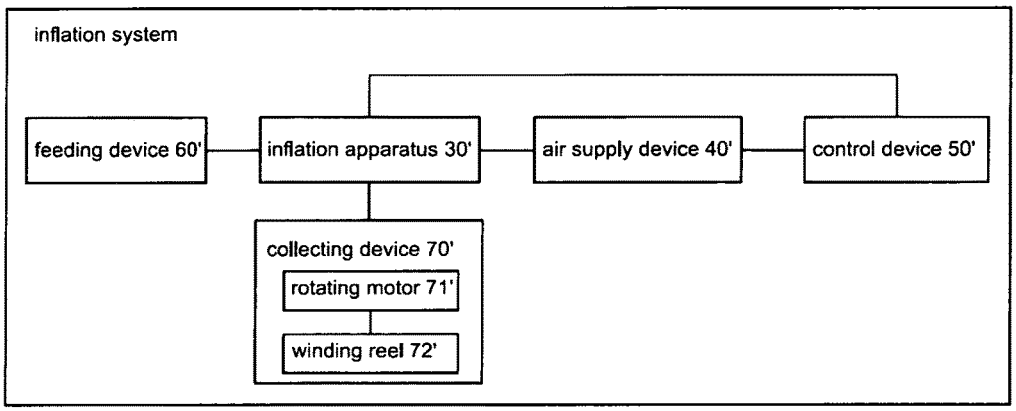
FIG. 47 is a perspective view of the inflation system for the air cushion body according to an alternative mode of the above second preferred embodiment of the present invention.

In other words, FIG. 46 illustrates a typical inflation process according to the present invention. When it starts, it will first determine if the air cushion body 10' has reached the inflation position. If so, it will execute clamping, move the air cushion body 10' forward for a certain distance, and start the inflation process. After the inflation process has finished, it will determine if the inflated air pressure attained the requirement. If so, it will stop the inflation process and execute the loosening procedure and conveying procedure, including implementing the splitting operation of the inflation unit 15' and having the next air cushion body 10' to refill into the inflation position, so as to repeat the above procedures to continuously and automatically conduct the inflation process for a plurality of the air cushion body 10' of the continuous type air cushion body 100'.

In other words, more specifically, according to the arrangement of the inflation system of the present invention, the entire control process of the inflation system can be like follows. When the entire system has been connected to an external power source, such as the public alternating current power supply network, the main control module 511' can send a command of starting clamping operation to the clamping driver module 512', such that the clamping driver module 512' will open the cylinder control solenoid valve 54' to allow the pipelines between the main passage 42' of the air supply device 40' and the two air cylinder ducts 45' be communicated and connected. As a result, air provided by the air supply device 40' will respectively drive the two clamping air cylinders 3331' to function through the two air cylinder ducts 45', which drives the clamping portions 3311' and 3321' of the two clamping unit 331' and 332' to move to the predetermined positions of the clamped state by the drive of the driving portions 3332'. Eventually the clamping portions 3311' and 3321' will press against each other to seal the two sides of the inflation channel 153' of the inflation unit 15' of the air cushion body 10' to be inflated, so as to create the sealed inflatable cavity 155'. Then, the clamping driver module 512' will generate a predetermined schedule according to its judgement on the two clamping air cylinder 3331'. When the clamping portions 3311' and 3321' reach the clamped state, the clamping driver module 512' will close the cylinder control solenoid valve 54'.

Afterward, the main control module 511' may send a control command of starting inflation to the inflation driver module 514' to open the inflation control solenoid valve 55', such that gas of the air supply device 40' will be allowed to enter the inflation pipe 32' through the main passage 42' and the inflation duct 43' and further be released from the vent hole 3214' of the inflating portion 321' of the inflation pipe 32' to enter the inflatable cavity 155' of the inflation unit 15'. Then the gas will pass through each air inlet channel 23' formed by the valve films 21' and 22' to enter the corresponding air storage units 13'.

Meanwhile, the pressure sensor 532' of the pressure control unit 53' will detect air pressure in the pipeline between the pressure control duct 44' and the inflation pipe 32'. In this embodiment, if the detected air pressure value is, for example, around 0.1 Mpa, the main control module 511' will send a command of stopping inflation to the inflation driver module 514' so as to close the inflation control solenoid valve 55', such that gas of the air supply device 40' will stop entering the inflation pipe 32' through the inflation duct 43' of the main passage 42', which terminates the inflation process.

When it determines the completion of the inflation process, the main control module 511' will send out a control command of loosening the clamping device 33', such that the clamping driver module 512' will drive the two clamping air cylinders 3331' to move back to their original positions. Then, the two clamping portions 3311' and 3321' will move from each other and shift from the clamped state to the idle state.

Then after the clamping device 33' goes back into the idle state, the main control module 511' will send a control command of starting the conveyor 34', such that the conveying driver module 513' drives the conveying motor 3431' to function to drive the first conveying gear 3411' and the second conveying gear 3421' to rotate, so as to drive the split inflation unit 15' of the continuous type air cushion body 100' to move forward and lead the next air cushion body 10' to be inflated to the inflation position.

According to the description of the inflation system of the above preferred embodiment of the present invention, the present invention further provides an assembling method for the inflation system, wherein the inflation system is for continuously and automatically inflating a plurality of connected air cushion bodies 10' of the continuous type air cushion body 100'. The method comprises the following steps.

The assembly steps of the inflation apparatus 30' include the following: assembling the inflation pipe 32' on the mounting plate 311' along the length direction of the mounting plate 311'; mounting the holding block 3341' of the top or bottom side of the clamping device 33' on the mounting plate 311'; mounting the guide rod 3342' on the holding block 3341' and respectively mounting the first clamping unit 331' and the second clamping unit 332' on the guide rod 3342'; mounting the holding block 3341' of the bottom or top side on the guide rod 3342' and further affixing it on the mounting plate 311'; mounting the clamping power source 333' on the mounting plate 311' and allowing the two driving portions 3332' to pass through the clamping device retaining slot 3113' of the mounting plate 311' so as to be assembled on the contact holes 3315' and 3325' of the first clamping unit 331' and the second clamping unit 332'; mounting the actuating mechanism 3353' of the shifting device 335' on the mounting plate 311'; anchoring the relative positions among the inflation pipe, the shifting mechanism 3352', and the clamping mechanism 3351' of the shifting device 335' through the guide rail 336'; mounting the splitting tool 351' of the splitting device 35' on the holding device 352' and affixing the holding device 352' on the mounting plate 311'; connecting the splitting tool 351' to the proximal end 3213' of the inflating portion 321' of the inflation pipe 32'; mounting the mounting bracket 3433' that has the conveying motor 3431' mounted thereon on the mounting bracket 3433'; mounting the first roller 3424' on the output shaft 3432' connected with the conveying motor 3421'; connecting the first and second connecting shaft 3412' and 3422' of the first and second conveying unit 341' and 342' with the first and second driving gear 3413' and 3423' and allowing the first and second connecting shaft 3412' and 3422' to pass through the connecting shaft spacing hole 3114' of the mounting plate 311' to reach the outer side of the mounting plate 311'; respectively mounting the first and second conveying gear 3411' and 3421' on the first and second connecting shaft 3412' and 3422'; further mounting the second roller 3425' on the second connecting shaft 3422'; and connecting the first and second roller 3424' and 3425' with the transmission belt 3426'.

The steps of assembling the control device 50' and wiring including: respectively electrically connecting the pressure regulation unit 52', the pressure control unit 53', the cylinder control solenoid valve 54', and the inflation control solenoid valve 55' with the main control unit 51' through wires and allowing the entire circuit to be connected with external power source.

The process for assembling the air supply device 40' and arranging the pipelines includes steps of mounting the main passage 42' on the electric air pump 41' and branching a pipeline from the main passage 42' for inflating. Specifically, the pressure regulation unit 52' is installed on the main passage 42'. Besides, the main passage 42' further connects the inflation control solenoid valve 55' and the inflation duct 43' and connects the inflation duct 43' with the inflation pipe 32' assembled on the mounting plate 311'. The process further comprises steps of branching another branch from the inflation duct 43' to the pressure control unit 53' by the pressure control pipeline 44' and branching another branch from the inflation duct 43' for driving the clamping air cylinder 3331'. Specifically, the cylinder control solenoid valve 34' is installed on this branch and the two air cylinder ducts 35' are respectively connected with two clamping air cylinders 3331' for respectively driving two clamping units 331' and 332' to conduct the clamping and loosening operations.

Person skilled in the art should be able to understand that the specific assembly technology of the above assembly steps is just an example rather than limit to the present invention. In addition, some of the orders of the steps may be changed.

Figure 48:
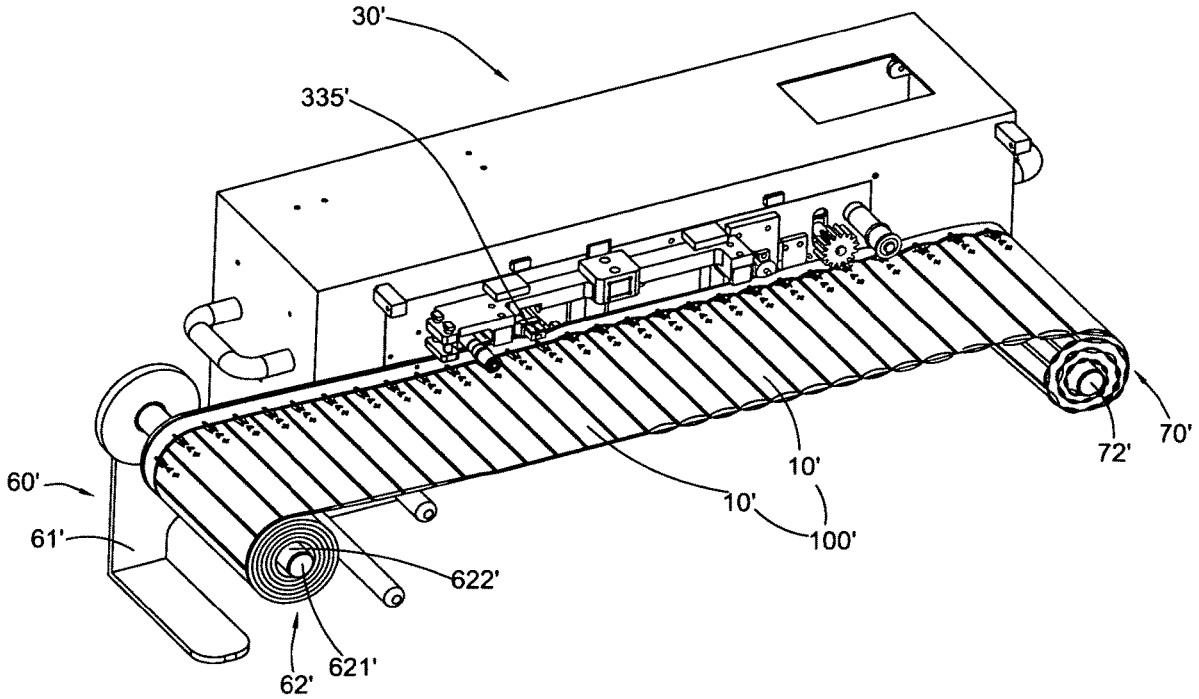
FIG. 48 is a 3D perspective view of the inflation system for the air cushion body according to an alternative mode of the above second preferred embodiment of the present invention.
Figure 51:
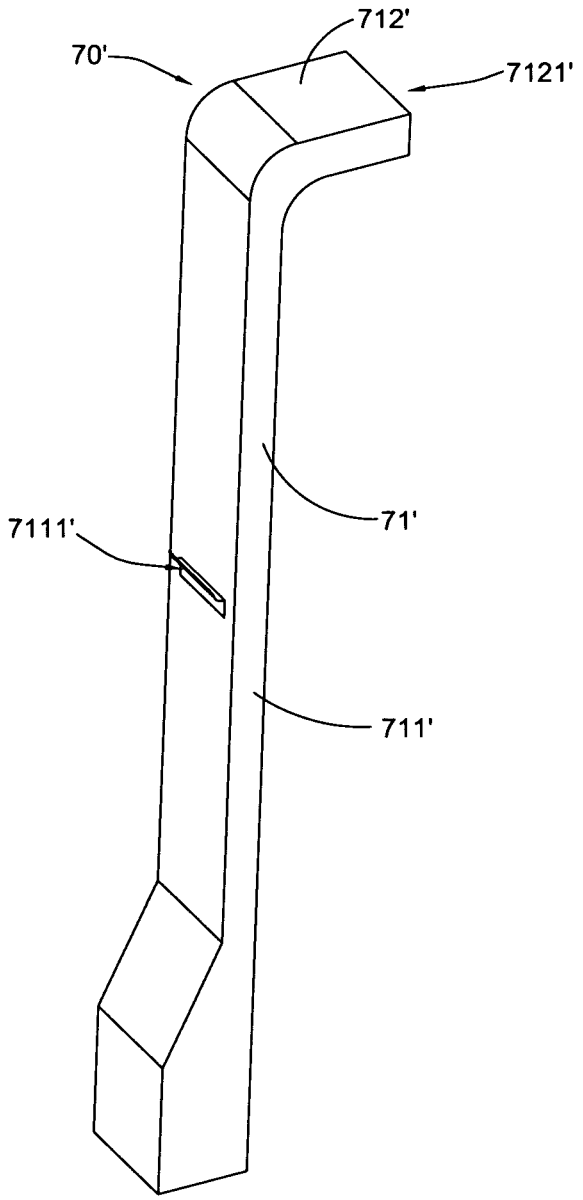
FIG. 51 is a 3D perspective view of the inflation apparatus for the air cushion body according to the above alternative mode of the present invention.
Figure 52:
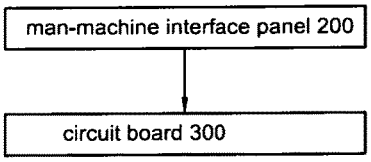
FIG. 52 is a block diagram illustrating the connection of the operating system of the inflation apparatus for the air cushion body according to a third preferred embodiment of the present invention.

Referring to FIGS. 48, 51, and 52, according to another enhanced alternative mode, the inflation system further comprises a feeding device 60' and a collecting device 70'. These devices can respectively be independent parts or be integrally formed with the inflation apparatus. The feeding device 60' is for mounting the continuous type air cushion body 100' so as for continuously providing air cushion bodies 10' to be inflated to the inflation apparatus 30'. On the other hand, the collecting device 70' is for collecting and organizing the inflated air cushion bodies 10'.

More specifically, according to the above embodiment, the feeding device 60' may comprise a feeding bracket 61' and a feeding unit 62' assembled on the feeding bracket 61'. The feeding unit 62' comprises a stationary axle 621' and a reel 622' adapted for rotatably mounted on the stationary axle 621'. The reel 622' is adapted for mounting an end of the continuous type air cushion body 100' and the continuous type air cushion body 100' is adapted for being wrapped on the reel 622'. Besides, the other end of the continuous type air cushion body 100' is guided to move forward to execute the continuous and automatic inflation process. The feeding bracket 61' can further integrally mounted on the bracket 31' of the inflation apparatus 30', so as to form an integral structure.

Person skilled in the art should be able to understand that the structure of the feeding device 60' is just an example rather than limit to the present invention. That is, the feeding device 60' may also be made into other structures, such as a structure like a storage box, wherein the continuous type air cushion body 100' may be stored in the storage box in a folded state and have an end pulled out from an opening of the storage box for being guided to moved forward and inflated in a continuous and automatic manner.

The collecting device 70' can be embodied as a rolling up device, which may comprise a winding reel 72' driven by a rotating motor 71, which rolls the inflated air cushion bodies 10' for later use through rotation. Person skilled in the art should be able to understand that the structure of the collecting device 70' is just an example rather than limit to the present invention. That is, the collecting device 70' may also be made into other structures, such as a structure like a collecting box.

Figure 50:
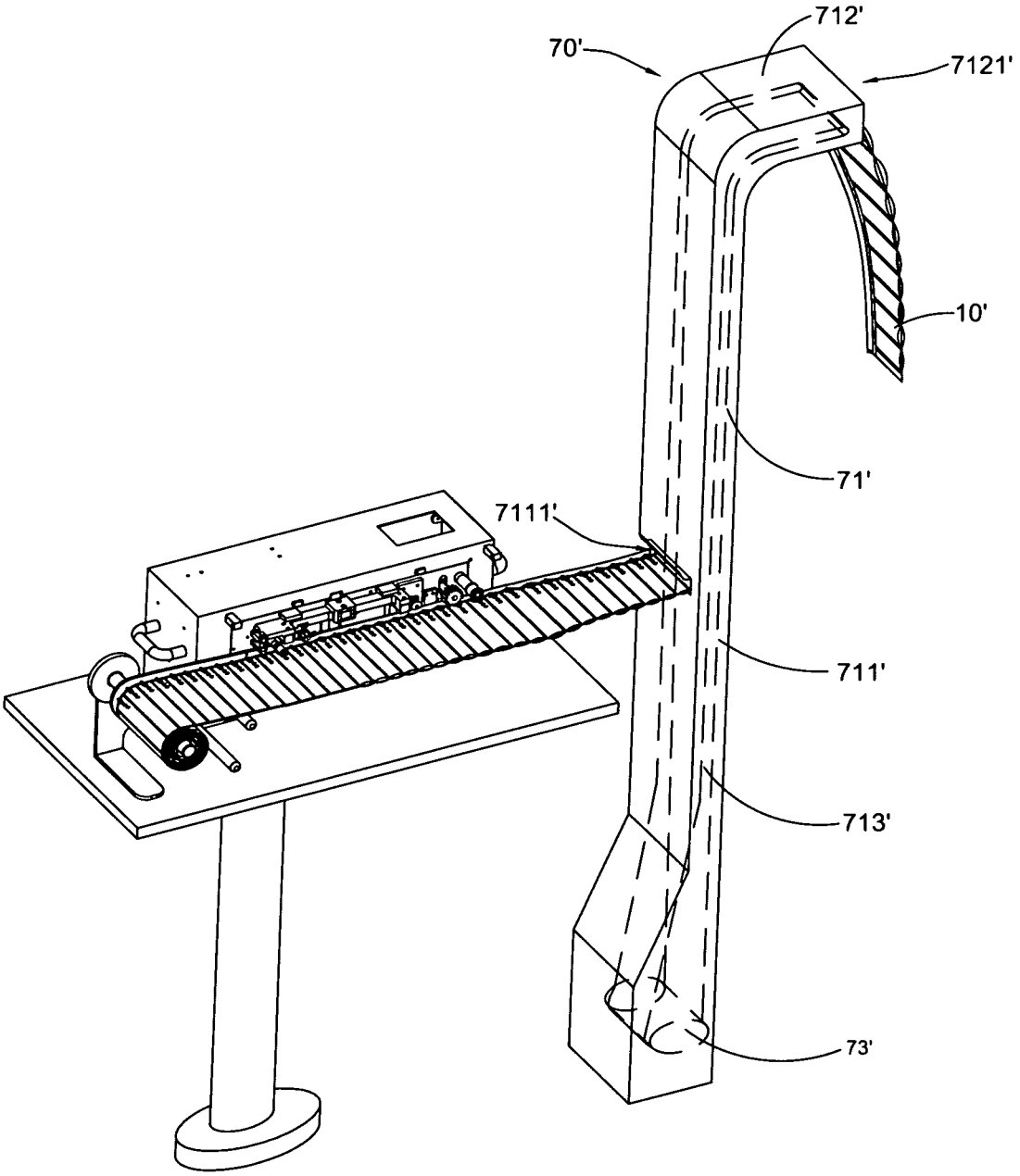
FIG. 50 is a perspective view of the inflation apparatus for the air cushion body according to an alternative mode of the above second preferred embodiment of the present invention.

Referring to FIGS. 50-51, the collecting device 70', according to the preferred embodiment of the present invention, is embodied to comprise a receiving rack 71' arranged on the extended moving direction of the inflated air cushion body 10'. The receiving rack 71' is a cane-shaped hollow structure comprising a vertical portion 711', a lateral portion 712', an inlet 7111', and an outlet 7121'. The vertical portion 711' is at the right side of the bracket 31' and close to the inflated air cushion body 10'. The inlet 7111' is arranged at a side of the vertical portion 711' facing the inflated air cushion body 10' and the height of the inlet is substantially the same with the height of the inflated air cushion body 10'. The overall height of the vertical portion 7111' is higher than the height of the bracket 31'. The lateral portion 712' is extended from the top of the vertical portion 711' toward a direction away from the bracket 31'. The outlet 7121' is arranged at the end of the lateral portion 712'.

The hollow structured receiving rack 71' comprises a receiving shaft 713' arranged internally and driven by a rotating motor 73'. When the air cushion body 10' is inflated, because the air cushion body 10' passes through the inlet 7111' of the receiving rack 71' to be connected on the receiving shaft 713', the rotating motor 73' drives the receiving shaft 713' to rotate, so as to drive the inflated air cushion body 10' to move upward along the internal space of the hollow structured receiving rack 71' and eventually to emerge from the outlet 7121' of the receiving rack 71'.

According to the preferred embodiment, the inflated air cushion body 10' is brought by the receiving shaft 713' in the receiving rack 71' to be emerged from the outlet 7121' of the receiving rack 71' and dropped on the ground or a receiving platform. The advantages of this structural arrangement include the following:

Firstly, the receiving area of the inflated air cushion body 10' is enlarged, so as to provide more storing space for the inflated air cushion body 10'.

Secondly, because the inflated air cushion body 10' has to pass through the receiving rack 71' before falling to the ground or platform, there is extra buffer time for operating personnel to switch from various operational procedures, which increases working efficiency of the operating personnel.

Thirdly, the increased storing space for the inflated air cushion body 10' allows the operating personnel to choose to pack the product after the inflation is totally finished based on the circumstances, rather than to conduct the inflation and packing operation at the same time. In other words, it can take only one operating personnel to finish the whole inflation and packing operation, which saves labor cost of the production process.

It is worth emphasizing that person skilled in the art may determine a specific position of the collecting device 70' and the relations, such as permanent connection, dismountable connection, separated structure, etc., between the collecting device 70' and the inflation apparatus based on actual needs. Besides, one may determine a specific structure for the collecting device 70' based on actual needs. For example, if one needs to keep the output direction of the inflated air cushion body 10', he can just add a part to guide the output direction of the inflated air cushion body 10' on the collecting device 70'. In other words, those utilize identical or similar technical solutions with the present invention, solve identical or similar technical issues with the present invention, and achieve identical or similar technical results with the present invention are all within the scope of protection of the present invention, while specific implementations of the present invention shall not be limited thereto.

Moreover, as an enhanced mode of the preferred embodiment of the present invention, the collecting device 70' of the inflation apparatus for the air cushion body can further comprise a winding rack (not shown in the drawings, hereinafter). The winding rack comprises a winding reel (not shown in the drawings, hereinafter). The winding reel can wrap the inflated air cushion body 10' emerged from the outlet of the receiving rack 71' through automatic rotation driven by external force. Person skilled in the art should be able to understand that the structure of the collecting device 70' is just an example rather than limit to the present invention. That is, the collecting device 70' may also be made into other structures, such as a structure like a collecting box.

It is worth emphasizing that, according to this preferred embodiment, the receiving shaft 713' and the winding reel are controlled by the same power switch button. That is, when the power switch is on to utilize the rotating motor 73' to drive the receiving shaft 713' to receive the products, the winding reel will be started at the same time, so as to wrap the air cushion body 10' emerged from the outlet 7121' of the receiving rack 71'. Person skilled in the art may also correspondingly modify the structure of the collecting device based on actual situation, such as to drive the receiving shaft 713' and the winding reel with the same motor 73', such that it can be ensured that the air cushion body 10' emerged from the outlet of the receiving rack 71' can be wrapped by the winding rack timely. Therefore, working efficiency of the inflation apparatus for the air cushion body according to the present invention can be further enhanced.

It is worth mentioning that according to another alternative mode, after the air cushion body 10' is inflated, the inflation system may further comprise a cutting device to cut down the inflated air cushion body 10' from the continuous type air cushion body 100' so as to be collected by the user. The dividing device may be a knife tool or means that utilizes other cutting ways, such as an energy flow cutter. It is understandable that in order for accurate cutting, it may further provide a visual scanning device for determining the quantity of the air cushion body 10 of the air storing unit 13 being cut at a time.

Figure 49:
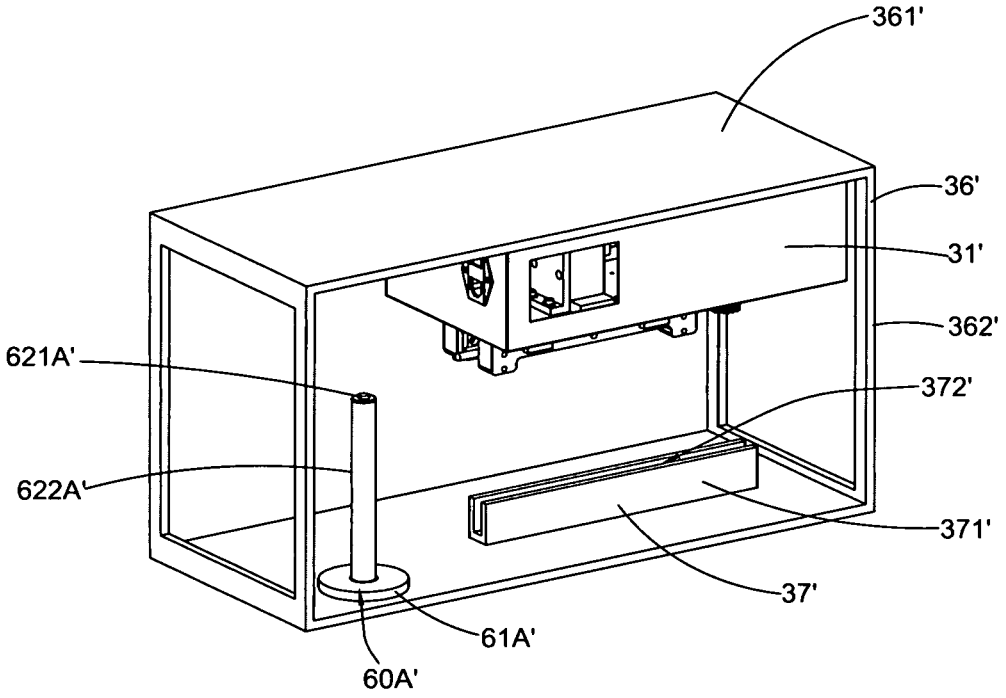
FIG. 49 is a perspective view of the inflation system for the air cushion body according to another alternative mode of the above second preferred embodiment of the present invention.

Referring to FIG. 49, according to another alternative mode, the inflation apparatus 30 further comprises a hanging support 36', which comprises a support body 361' and a plurality of support legs 362'. The support legs are utilized for standing on a surface of the environment, such as a ground and a tabletop. The support body 361' is to hangingly mount the bracket 31' so as to be suitable for keeping the continuous type air cushion body 100' upright and be moved forward. In other words, it can further save the required space of the inflation system if driving the continuous type air cushion bodies 100' upright for the inflation process.

Referring to the figure, the feeding bracket 61A' of the feeding device 60A' can be embodied as a support disk. The stationary axle 621A' and the reel 622A' of the feeding unit 62A' are both vertically arranged. Correspondingly, the continuous type air cushion bodies 100 can substantially be reeled and rolled in an upright or vertical manner in the subsequent wrapping step.

In addition, the inflation apparatus 30' further comprises a guiding device 37', which comprises a guiding body 371' and a guiding groove 372' formed thereat. The continuous type air cushion body 100' has the air cushion body 10' to be inflated in the guiding groove 372' for being driven forward, such that the inner surface of the guiding body 371' limits and retains the air cushion body 10' during the inflation process, so as to prevent the air cushion body 10' from fleeing and tilting during the inflation, which further ensure the success and smooth of the inflation process.

Correspondingly, according to the above description, the inflation technology of the present invention includes a basis of inventive concept as follows. Namely, the present invention provides an inflation method for conducting an inflation process for an air cushion body 10'. The air cushion body 10' comprises one or more air storing units 13' formed by two air cell films 11' and 12', an inflation valve 20' formed by at least two valve films 21' and 22', and an inflation unit 15' integrally connected with the one or more air storing units 13' and comprising two inflation end portions 151' and 152' overlapping with each other, wherein an inflation channel 153' is formed between the two inflation end portions 151' and 152'. The method includes the following steps.

(a) arranging a vent hole 3214' of the inflation pipe 32' which is connected with the air supply device 40' in the inflation channel 153';

(b) closing the openings 154' at the two ends of the inflation channel 153' of the inflation unit 15' so as to form a sealed inflatable cavity 155';

(c) driving the air cushion body 10' to move forward for a certain distance with the sealed inflation unit 15', so as to prevent position shift of the inflated air cushion body 10' due to shrinkage;

(d) inflating the inflatable cavity 155' through the vent hole 3214', such that air enters each air storing unit 13' via each air inlet channel 23' formed between the valve films 21' and 22', so as to complete the inflation process; and (e) releasing the openings 154' of the two ends of the inflation channel 153' of the inflation unit 15, such that the air cushion body 10' is ready to be taken off from the inflation pipe 32', so as to obtain the air cushion body 10' that is inflated.

More specifically, in the step (a), the sealed distal end portion 3211' of the inflating portion 321' of the inflation pipe 32' enters the opening 154' of a side of the inflation channel 153' and leaves away from the opening 154' of another side thereof, such that the main portion 3211' of the inflating portion 321' will be remained in the inflation channel 153', which means the main portion 3211' of the inflating portion 321' is extended in the entire inflation channel 153' between the two inflation end portions 151' and 152' of the inflation unit 15'.

In the step (a) and the step (e), the openings of the two ends of the inflation channel 153' are closed and released through the complementary clamping portions 3311' and 3321' of a clamping device 30'.

The step (d) comprises the action of starting air supply of the air supply device 40' to the inflation pipe 32' through switching on the inflation control solenoid valve 55' in the pipeline between the air supply device 40' and the inflation pipe 32'.

The step (d) further comprises the following steps: detecting air pressure in the pressure control pipeline 44' connected with the inflation pipe 32' and switching off the inflation control solenoid valve 55' arranged in the pipeline between the air supply device 40' and the inflation pipe 32' to thereby stop the inflation process if the air pressure reached the predetermined air pressure, such as around 0.1 Mpa.

Preferably, the above method further comprises the following step:

(f) splitting the inflated inflation unit 15' of the air cushion body 10' and detaching the inflated air cushion body 10' from the inflation pipe 32' along the length direction of the inflating portion 321' of the inflation pipe 32';

A plurality of the air cushion bodies 10' is connected to form a continuous type air cushion body 100', where the continuous type of inflation units 15' of the continuous type air cushion body 100' comprise an inflation channel 153' formed to continuously communicate per two adjacent air cushion bodies 10'. Then, the method further comprises the following step after the step (f):

(g) driving the inflated air cushion body 10' of the continuous type air cushion body 100' to move forward, so as to have another adjacent air cushion body 10' enter the inflation position and to continuously automatically inflate a plurality of air cushion bodies 10' of the continuous type air cushion body 100'.

Further, in the step (g), the driving force can be provided by two conveying gears 3411' and 3421' which are driven by a motor and are applied on the splitted inflation end portions 151' and 152' of the inflation unit 15'. Besides it also comprises the following step: the transfer rate and the transfer time of the two conveying gear 3411' and 3421' are obtained and utilized for determining if the next air cushion body 10' has entered the inflation position.

Subsequently, the above method may further comprises the following step: splitting the inflated air cushion body 10 from the continuous type air cushion body 100' or continuously rolling up the inflated air cushion bodies 10' together.

In addition, according to the preferred embodiment of the present invention, an operating system of the inflation apparatus 30' for the air cushion body is further provided. Referring to FIG. 52, the operating system comprises a man-machine interface panel 200 and a circuit board 300, the circuit board 300 is electrically connected with the man-machine interface panel 200 to receive the commands sent from the man-machine interface panel 200 and control the operation of corresponding components. Preferably, the man-machine interface panel 200 comprises a start-stop button 201 and a setting button arranged thereon. The start-stop button 201 and the setting button are both electrically connected with the circuit board 300. The start-stop button 201 is for controlling the start and stop of the inflation apparatus for the air cushion body. The setting button is for setting up specific operating parameters of the inflation apparatus for the air cushion body based on user's needs or actual situation.

Figure 53:
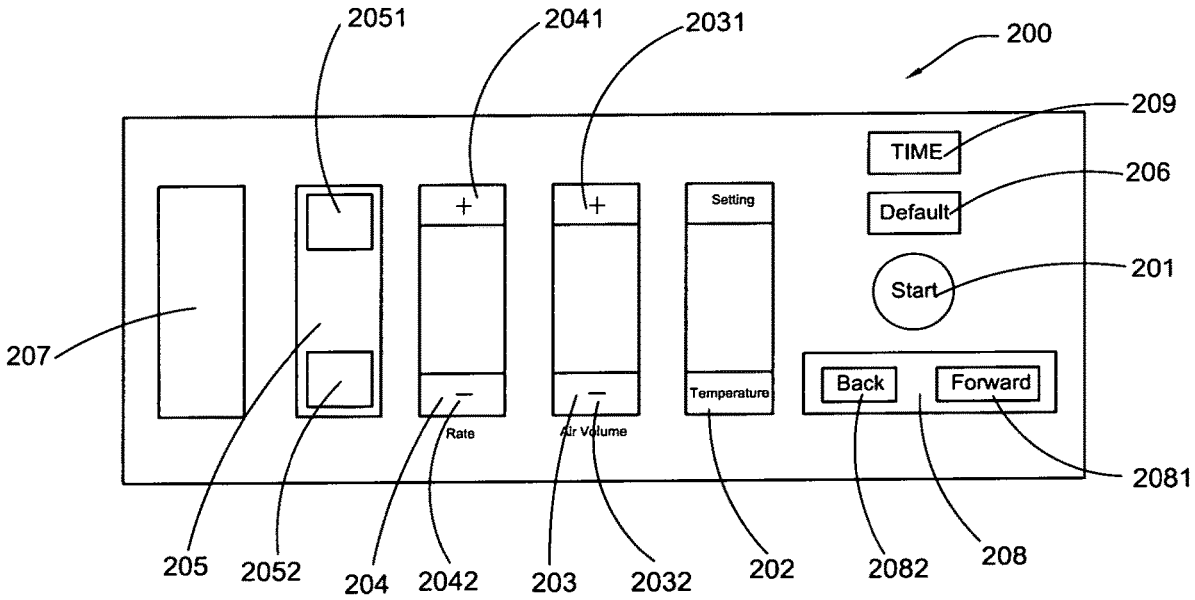
FIG. 53 is a perspective view of a display of the man-machine interface panel of the operating system of the inflation apparatus for the air cushion body according to the above third preferred embodiment of the present invention.

FIG. 53 illustrates the man-machine interface panel 200 of the operating system of the inflation apparatus for the air cushion body according to a preferred embodiment of the present invention. Referring to the figure, the man-machine interface panel 200 comprises a start-stop button 201, a temperature setting button 202, an air volume setting button 203, a rate setting button 204, and an operating mode setting button 205. The circuit board 300 comprises a start-stop module (not shown in the drawings, hereinafter), a temperature control module (not shown in the drawings, hereinafter), an air volume control module (not shown in the drawings, hereinafter), a rate setting module (not shown in the drawings, hereinafter), and an operating mode module (not shown in the drawings, hereinafter) all arranged thereon. The start-stop button 201 is electrically connected with the start-stop module so as to be able to send commands to the start-stop module to control the heat sealing device in the inflation apparatus for the air cushion body to heat up or cool down so as to reach a corresponding temperature to start or stop working. The temperature setting button 202 is electrically connected with the temperature control module so as to be able to send commands to the temperature control module to control the heat sealing device in the inflation apparatus for the air cushion body to adjust to attain a corresponding temperature. The air volume control button 203 is connected with the air volume control module and is able to send command to the air volume control module to control and adjust the air supply device of the inflation apparatus for the air cushion body for attaining corresponding air volume. The rate setting button 204 is connected with the rate control module and is able to send command to the rate control module to control and adjust the conveyor of the inflation apparatus for the air cushion body for attaining corresponding speed. The operating mode setting button 205 is electrically connected with the operating mode module, so as to send command to the operating mode module for controlling corresponding components of the inflation apparatus for the air cushion body to attain the predetermined purpose.

Figure 54:
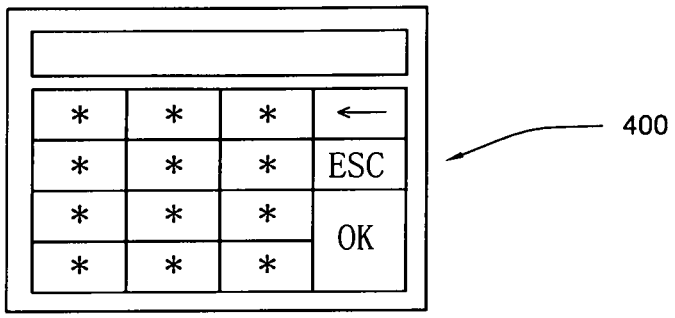
FIG. 54 is a perspective view of a display of the temperature setting interface of the man-machine interface panel according to the above third preferred embodiment of the present invention.
Figure 55:
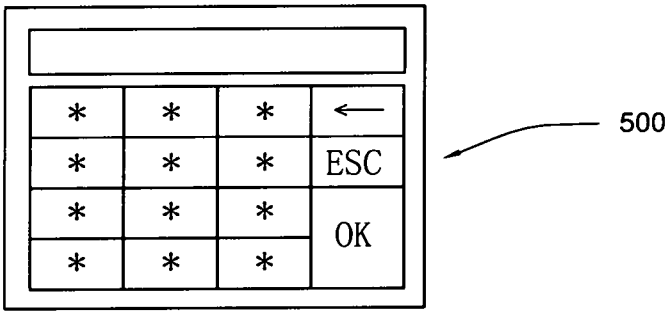
FIG. 55 is a perspective view of a display of the counting mode selection interface of the man-machine interface panel according to the above third preferred embodiment of the present invention.

Further, referring to FIG. 54, when the operating temperature of the heat sealing device has to be adjusted, one may press the temperature setting button 202 to enter the temperature setting interface 400, input the operating temperature value, and press the OK button to exit. In other words, the temperature setting interface 400 popped up after the temperature setting button is pressed includes the buttons of all the essential digits, "Return," "Back," "OK," etc.

According to the above preferred embodiment of the present invention, the air volume setting button 203 comprises a "+" button 2031 and a "−" button 2032. As the air volume of operation of the air supply device needs to be adjusted, one may utilize the "+" button 2031 or the "−" button 2032 on the air volume setting button 203 to adjust the inflation volume of the air supply device during the operation. The user may also adjust the inflation volume of the air supply device based on actual situation at any time during the operation of the inflation apparatus for the air cushion body without shutting down the inflation apparatus for the air cushion body.

Correspondingly, the rate setting button 204 comprises a "+" button 2041 and a "−" button 2042. As the transfer rate of the conveyor needs to be adjusted, one may utilize the "+" button 2041 or the "−" button 2042 on the rate setting button 204 to adjust the transfer rate of the conveyor during the operation. The user may also adjust the transfer rate of the conveyor at any time based on actual situation during the operation of the inflation apparatus for the air cushion body without shutting down the inflation apparatus for the air cushion body.

The operating mode setting button 205 comprises a "counting mode" button 2051 and a "continual mode" button 2052. Correspondingly, the circuit board 300 also comprises a counting module (not shown in the drawings, hereinafter) and a continual module (not shown in the drawings, hereinafter) arranged thereon. The counting mode 2051 is electrically connected with the counting module for commanding the counting module to count for the feeding device of the inflation apparatus for the air cushion body or to suspend the feeding device of the inflation apparatus for the air cushion body when it has fed a predetermined quantity of the air cushion bodies. The continual mode 2052 is electrically connected with the continual module for commanding the continual module to drive the feeding device of the inflation apparatus for the air cushion body to operate continuously. In other words, referring to FIG. 55, when the "counting mode" button 2051 is pressed, it will enter the counting mode menu 500, which comprises digital key combination and OK button. The user should enter a desired number to set up the counting quantity and press the OK button to exit. Then he or she can press the start-stop button 201 to effect the counting mode setting, such that the counting module will count for the feeding device of the inflation apparatus for the air cushion body or drive the feeding device of the inflation apparatus for the air cushion body to feed a predetermined quantity of the air cushion bodies. The apparatus under the counting mode will pause its operation when it has operated for the set quantity. When the "continual mode" button 2052 is pressed, it will enter the continual mode. When the start-stop button 201 is then pressed, it will affect the continual mode and the continual module will drive the feeding device of the inflation apparatus for the air cushion body to operate continuously.

Besides, as a further enhanced mode of the operating system of the inflation apparatus for the air cushion body according to the preferred embodiment of the present invention, the man-machine interface panel 200 further comprises a default mode button 206. Correspondingly, the circuit board 300 further comprises a default mode module (not shown in the drawings, hereinafter) electrically connected with the default mode button 206, such that the default mode button 206 can command the default mode module to apply the default operating mode to the inflation apparatus for the air cushion body. It should be noted that when the default mode button 206 and the start-stop button 201 are sequentially pressed, the inflation apparatus for the air cushion body will enter the default mode directly but allow the parameters of operation be changed.

Moreover, according to this preferred embodiment, the man-machine interface panel 200 further comprises a custom button 207 electrically connected with the temperature setting module, the air volume setting module, and the rate setting module on the circuit board 300. When the custom button 207 is pressed, it will enter the custom mode, such that the user may adjust the operating temperature of the heat sealing device of the inflation apparatus for the air cushion body, the inflation volume of the air supply device, and the transfer rate of the conveyor based on the needs until all parameters are optimized. Then the user may press the start-stop button 201 to have the inflation apparatus for the air cushion body operate in its optimized condition.

In other words, when the user notices that the products produced under the default mode that is started after the default mode button is pressed, fail to meet the expected standards, he or she may press the custom button 207 to have the inflation apparatus for the air cushion body enter the custom mode and adjust the operating temperature of the heat sealing device of the inflation apparatus for the air cushion body, the inflation volume of the air supply device, and the transfer rate of the conveyor based on actual needs until the inflation apparatus for the air cushion body has operated in its optimized condition.

It is worth emphasizing that whether the default mode button 206 is pressed for entering the default mode or the custom button 207 is pressed and the operating temperature of the heat sealing device of the inflation apparatus for the air cushion body, the inflation volume of the air supply device, the transfer rate of the conveyor is adjusted, the start-stop button 201 must be pressed after the pressing of the default mode button 206 or custom button 207 and the parameter settings, such that the inflation apparatus for the air cushion body can really enter the corresponding operating mode.

According to a further enhanced mode to the preferred embodiment, the inflation apparatus for the air cushion body further comprises a buzzer (not shown in the drawings, hereinafter) electrically connected with the heat sealing device and the circuit board 300. After the start-stop button 201 of the operating system is pressed, the heat sealing device of the inflation apparatus for the air cushion body will heat up. When the temperature of the heat sealing device has attained the predetermined value, the buzzer will give an alarm and the circuit board 300 will drive the inflation apparatus for the air cushion body to enter the operating mode.

Besides, after the start-stop button 201 of the operating system of the inflation apparatus for the air cushion body is pressed to start the operation of the inflation apparatus for the air cushion body, it is strictly prohibited to have any object contact any high temperature or rotating part of the inflation apparatus for the air cushion body during the operation of the inflation apparatus for the air cushion body, so as to prevent scald or injury caused by the high temperature or rotating part of the inflation apparatus for the air cushion body. Moreover, it is also prohibited to have any object contact any high temperature part of the inflation apparatus for the air cushion body in ten minutes after the inflation apparatus for the air cushion body stops, so as to prevent scald caused by the residual heat of the inflation apparatus for the air cushion body.

Referring to FIG. 53, according to this preferred embodiment, the man-machine interface panel 200 further comprises an accessibility button 208 mainly for controlling the reel of the feeding device in the inflation apparatus for the air cushion body to rotate forward or backward, so as to bring the air cushion body to wind or unwind.

Speaking in detail, the accessibility button 208 comprises a reel forward button 2081 and a reel backward button 2082, while the circuit board 300 also correspondingly have a reel forward module (not shown in the drawings, hereinafter) for controlling the reel to rotate forward and a reel backward module (not shown in the drawings, hereinafter) for controlling the reel to rotate backward. The reel forward button 2081 is electrically connected with the reel forward module so as to send command to the reel forward module to drive the reel of the feeding device of the inflation apparatus for the air cushion body to rotate forward to bring the remained consecutive air cushion bodies on the inflation apparatus for the air cushion body to wind. The reel backward button 2082 is electrically connected with the reel backward module so as to send command to the reel backward module to drive the reel of the feeding device of the inflation apparatus for the air cushion, body to rotate backward to bring the remained consecutive air cushion bodies on the inflation apparatus for the air cushion body to unwind.

Preferably, the reel forward module and the reel backward module of the circuit board 300 are not connected with the heat sealing device. In other words, when the reel forward button 2081 is pressed, the reel forward button 2081 will send a command to the reel forward module to drive the reel of the feeding device of the inflation apparatus for the air cushion body to rotate forward. However, the heat sealing device of the inflation apparatus for the air cushion body will not be heated up at the mean time. Correspondingly, when the reel backward button 2082 is pressed, the reel backward button 2082 will send a command to the reel backward module to drive the reel of the feeding device of the inflation apparatus for the air cushion body to rotate backward. However, the heat sealing device of the inflation apparatus for the air cushion body will not be heated up at the mean time as well. Hence, whether the remained consecutive air cushion bodies is winded or unwind on the inflation apparatus for the air cushion body, they will not be heat sealing by the heat sealing device. This arrangement not only saves energy, but also reduces waste.

More preferably, the man-machine interface panel 200 further comprises a time display 209 and the circuit board 300 further comprises a time module (not shown in the drawings, hereinafter) arranged thereon electrically connected with the time display 209 of the man-machine interface panel 200 for displaying current time and/or continuous operating time of the inflation apparatus for the air cushion body.

It is worth emphasizing that according to the operating system of the inflation apparatus for the air cushion body of the present invention, the buttons of the man-machine interface panel 200 are all virtual buttons, which means that all of the buttons are touch screen buttons arranged on the man-machine interface panel 200. Certainly, person skilled in the art may replace all touch screen buttons into physical keyboards based on actual situation. In addition, person skilled in the art may optionally utilize any one, any combination, or all of the above buttons based on actual contexts or specific requirements. Nonetheless, those utilize identical or similar technical solutions with the present invention, solve identical or similar technical issues with the present invention, and achieve identical or similar technical results with the present invention are all within the scope of protection of the present invention, while specific implementations of the present invention shall not be limited thereto.

The present invention further provides an operational method of the inflation apparatus for the air cushion body, comprising the following steps:

(1) turning on the power of the operating system of the inflation apparatus for the air cushion body;

(2) setting up the operational parameters in the operating system of the inflation apparatus for the air cushion body;

(3) starting or stopping the operation of the set parameters; and (4) turning off the power of the operating system of the inflation apparatus for the air cushion body.

Figure 56:
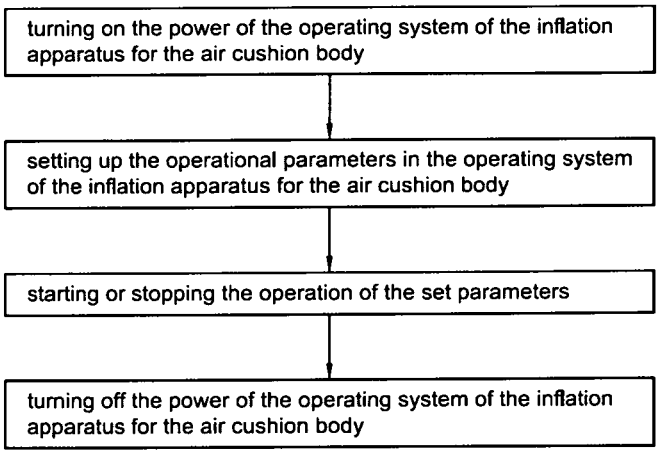
FIG. 56 is a flow diagram illustrating the operational method of the operating system of the inflation apparatus for the air cushion body according to a fourth preferred embodiment of the present invention.

FIG. 56 is a flow diagram illustrating the operational method of the operating system of the inflation apparatus for the air cushion body according to a preferred embodiment of the present invention. According to this preferred embodiment of the present invention, the step of setting up the operational parameters of the inflation apparatus for the air cushion body further comprises a step of setting up the temperature parameter, a step of setting up air volume parameter, a step of setting up rate parameter, and a step of setting up operating mode.

It is worth noticing that there is no particular order or sequence among the steps of setting up the temperature parameter, setting up air volume parameter, setting up rate parameter, and setting up operating mode. Person skilled in the art may adjust the order of the above steps of setting based on actual needs, while the implementation of the present invention shall not be limited thereby.

Also, in the operational method of the operating system of the inflation apparatus for the air cushion body according to the present invention, the step of setting up temperature parameter not only includes a step of directly setting up the default operating temperature of the inflation apparatus for the air cushion body, but also includes a step of increasingly and decreasingly adjusting the operating temperature of the inflation apparatus for the air cushion body in service, so as to increase or decrease the inflation temperature of the inflation apparatus for the air cushion body during the inflation process. Similarly, the step of setting up the air volume further comprises a step of directly setting up the default working air volume of the inflation apparatus for the air cushion body and a step of increasingly and decreasingly adjusting the working air volume of the inflation apparatus for the air cushion body in service, so as to increase or decrease the inflation volume of the inflation apparatus for the air cushion body during the inflation process. Also, the step of setting up the rate parameter further comprises a step of directly setting up the default operating rate of the inflation apparatus for the air cushion body and a step of increasingly and decreasingly adjusting the operating rate of the inflation apparatus for the air cushion body in service, so as to speed up or to slow down the inflating rate of the inflation apparatus for the air cushion body during the inflation process. The step of setting up operating mode comprises a step of setting for counting mode and a step of setting for continual mode, wherein the user may select a specific step based on actual situation.

As an enhanced mode of the preferred embodiment of the present invention, the step of setting up operational parameters of the inflation apparatus for the air cushion body comprises selecting a default mode so as to set up all operational parameters of the inflation apparatus for the air cushion body at once. Especially, if the production process of a product is very stable, the step of applying the default mode can increase the efficiency of the inflation apparatus for the air cushion body for producing the same product.

Person skilled in the art may determine operational method for the air cushion body based on actual contexts or specific requirements. Nonetheless, those utilize identical or similar technical solutions with the present invention, solve identical or similar technical issues with the present invention, and achieve identical or similar technical results with the present invention are all within the scope of protection of the present invention, while specific implementations of the present invention shall not be limited thereto.

One skilled in the art will understand that the embodiment of the present invention as shown in the drawings and described above is exemplary only and not intended to be limiting.

Objectives of the present invention are completely and effectively implemented. Notions of the functions and structures of the present invention have been shown and described in the embodiments, whereas implementations of the present invention may have modifications or changes in any ways without going against the above notions.

What is claimed is:

1. An inflation apparatus for an air cushion body, wherein the air cushion body comprises one or more air storing units formed by at least two air cell films, an inflation valve formed by at least two valve films, and an inflation unit integrally connected with the one or more air storing units and formed by two inflation end portions overlapping with each other, wherein an inflation channel is formed between the two inflation end portions, wherein the inflation valve forms at least one air inlet channel for inflating the corresponding air storing units, wherein the inflation apparatus comprises:

an inflation pipe made of a rigid material and adapted for being connected to an air supply device, wherein the inflation pipe comprises an inflating portion which comprises a main portion having at least one vent hole and a sealed distal end portion extended from the main portion; and a clamping device which comprises a first clamping unit, a second clamping unit, a clamping power source, and at least one holding unit, wherein the inflating portion of the inflation pipe is positioned between the first clamping unit and the second clamping unit, wherein said first clamping unit and said second clamping unit move towards or away from each other under effect of the clamping power source, so as to close or open two ends of the inflation channel of the air cushion body, wherein when the main portion of the inflating portion is arranged in the inflation channel during an inflating process, the two ends of the inflation channel are sealed off by the clamping device to form an inflatable cavity, wherein air is inflated into the inflatable cavity through the at least one vent hole, whereby the air entered the inflatable cavity enters the corresponding air storing units through the at least one air inlet channel, so as to inflate the air cushion body, wherein the first clamping unit comprises two spaced first clamping portions, wherein the second clamping unit comprises two spaced second clamping portions coordinating with the two spaced first clamping portions respectively, wherein each of the first clamping portions has a first clamping surface and a first clamping groove arranged on a bottom thereof, wherein each of the second clamping portions has a second clamping surface and a second clamping groove arranged on a top thereof, wherein in a clamped state, the first clamping portions and the second clamping portions clamp two ends of the inflation unit with the first clamping surfaces and the second clamping surfaces in response to an actuation of the clamping power source, so as to form an entire clamping groove by each of the first clamping groove and the second clamping groove to accommodate the sealed distal end of the inflation pipe, wherein the first clamping unit further comprises a first connecting portion connecting the two first clamping portions, wherein the second clamping unit further comprises a second connecting portion connecting the two second clamping portions, wherein the clamping power source comprises two clamping air cylinders and two driving portions connected with the two clamping air cylinders, wherein the two driving portions are respectively connected with the first connecting portion and the second connecting portion, wherein said two clamping air cylinders drive said first clamping unit and said second clamping unit of said first clamping portion and said second clamping portion respectively to move towards or away from each other, wherein the at least one holding unit comprises two holding blocks and a guide rod arranged between the two holding blocks, wherein each of the first clamping unit and the second clamping unit further has a top-to-bottom through guide rod hole in each of the first connecting portion and the second connecting portion for the guide rod to pass through respectively, such that both the first clamping unit and the second clamping unit are located between the two holding blocks and the two holding blocks are further affixed on the mounting plate.

2. An inflation apparatus for one or more air cushion bodies, wherein each of the one or more air cushion bodies comprises one or more air storing units formed by at least two air cell films, an inflation valve formed by at least two valve films, and an inflation unit integrally connected with the one or more air storing units and formed by two inflation end portions overlapping with each other, wherein an inflation channel is formed between the two inflation end portions, wherein the inflation valve forms at least one air inlet channel for inflating the corresponding air storing units, wherein the inflation apparatus comprises:

an inflation pipe made of a rigid material and adapted for being connected to an air supply device, wherein the inflation pipe comprises an inflating portion which comprises a main portion having at least one vent hole and a sealed distal end portion extended from the main portion;

a clamping device, wherein when the main portion of said inflating portion is arranged in the inflation channel during an inflating process, two ends of the inflation channel are sealed off by the clamping device to form an inflatable cavity, wherein air is inflated into the inflatable cavity through the at least one vent hole, whereby the air entered the inflatable cavity enters the corresponding air storing units through the air inlet channel, so as to inflate the air cushion body, wherein the one or more air cushion bodies are connected to form a continuous type air cushion body;

a conveyor driving the continuous type air cushion body to move forward along the inflating portion of the inflation pipe; and a splitting device which comprises a splitting tool and a holding device, wherein the splitting tool is extended from a proximal end portion of the inflating portion of the inflation pipe to split the inflation unit of each of the one or more air cushion bodies which has been inflated, so as to allow each of the one or more air cushion bodies which has been inflated to be detached from the inflation pipe, wherein the holding device has a mounting hole and the splitting tool is a rotary cutting tool which has a stationary axle rotatably mounting the splitting tool at the mounting hole of the holding device.

3. An inflation apparatus for one or more air cushion bodies, wherein each of the one or more air cushion bodies comprises one or more air storing units formed by at least two air cell films, an inflation valve formed by at least two valve films, and an inflation unit integrally connected with the one or more air storing units and formed by two inflation end portions overlapping with each other, wherein an inflation channel is formed between the two inflation end portions, wherein the inflation valve forms at least one air inlet channel for inflating the corresponding air storing units, wherein the inflation apparatus comprises:

an inflation pipe made of a rigid material and adapted for being connected to an air supply device, wherein the inflation pipe comprises an inflating portion which comprises a main portion having at least one vent hole and a sealed distal end portion extended from the main portion;

a clamping device, wherein when the main portion of said inflating portion is arranged in the inflation channel during an inflating process, two ends of the inflation channel are sealed off by the clamping device to form an inflatable cavity, wherein air is inflated into the inflatable cavity through the at least one vent hole, whereby the air entered the inflatable cavity enters the corresponding air storing units through the air inlet channel, so as to inflate the air cushion body, wherein the one or more air cushion bodies are connected to form a continuous type air cushion body;

a conveyor driving the continuous type air cushion body to move forward along the inflating portion of the inflation pipe;

a splitting device which comprises a splitting tool extended from a proximal end portion of the inflating portion of the inflation pipe to split the inflation unit of each of the one or more air cushion bodies which has been inflated, so as to allow each of the one or more air cushion bodies which has been inflated to be detached from the inflation pipe; and a shifting device, mounted on a mounting plate to drive the one or more air cushion bodies to move along the inflation pipe for a predetermined distance during the inflation process, comprising an actuating mechanism, a clamping mechanism and a shifting mechanism, wherein the actuating mechanism provides a driving force for the clamping mechanism to clamp on the one or more air cushion bodies and the shifting mechanism to drive the one or more air cushion bodies to move along the inflation pipe during the inflation process.

4. The inflation apparatus, as recited in claim 3, wherein the actuating mechanism comprises two second clamping air cylinders, wherein the clamping mechanism comprises a first clamping block and a second clamping block, which are operatively connected with the two second clamping air cylinders respectively, so as to achieve clamping or loosening of the clamping mechanism, wherein the actuating mechanism further comprises two driving air cylinders operatively connected with the shifting mechanism so as to move the shifting mechanism.

* * * * *